US005529866A

United States Patent [19]

Kawamura et al.

[11] Patent Number: 5,529,866

[45] Date of Patent: Jun. 25, 1996

[54] ELECTROPHOTOGRAPHIC SENSITIVE MEMBER

[75] Inventors: Takao Kawamura, 17-11, 1-cho, Takakuradai, Sakai-shi, Osaka-fu; Yoshikazu Nakayama, Hirakata; Yasuo Nishiguchi, Kyoto; Naooki Miyamoto, Yohkaichi; Hiroshi Itoh, Yohkaichi; Hitoshi Takemura, Yohkaichi, all of Japan

[73] Assignees: Kyocera Corporation, Kyoto; Takao Kawamura, Osaka, both of Japan

[21] Appl. No.: 392,936

[22] PCT Filed: Mar. 10, 1989

[86] PCT No.: PCT/JP89/00263

§ 371 Date: Oct. 8, 1993

§ 102(e) Date: Oct. 8, 1993

[30] Foreign Application Priority Data

| | | | |
|---|---|---|---|
| Mar. 11, 1988 | [JP] | Japan | 63-59052 |
| Mar. 17, 1988 | [JP] | Japan | 63-64337 |
| Mar. 18, 1988 | [JP] | Japan | 63-66436 |
| Mar. 24, 1988 | [JP] | Japan | 63-70258 |
| Mar. 24, 1988 | [JP] | Japan | 63-70259 |
| Mar. 24, 1988 | [JP] | Japan | 63-70260 |
| Mar. 24, 1988 | [JP] | Japan | 63-70261 |
| Dec. 28, 1988 | [JP] | Japan | 63-335574 |
| Feb. 14, 1989 | [JP] | Japan | 1-35921 |
| Feb. 14, 1989 | [JP] | Japan | 1-35924 |
| Feb. 14, 1989 | [JP] | Japan | 1-35925 |
| Feb. 14, 1989 | [JP] | Japan | 1-35926 |

[51] Int. Cl.[6] ..... G03G 5/14

[52] U.S. Cl. ..... 430/57; 430/83

[58] Field of Search ..... 430/57, 56, 58, 430/60, 83

[56] References Cited

U.S. PATENT DOCUMENTS

| | | | |
|---|---|---|---|
| 4,906,546 | 3/1990 | Kawamura et al. | 430/59 |
| 4,997,736 | 3/1991 | Kawamura et al. | 430/57 |
| 5,106,711 | 4/1992 | Kawamura et al. | 430/56 |

*Primary Examiner*—John Goodrow
*Attorney, Agent, or Firm*—Loeb & Loeb

[57] ABSTRACT

The present invention provides a high-capacity and high-quality electrophotographic sensitive member comprising an a-SiC photoconductive layer and an organic photosemiconductive layer piled up on an electrically conductive substrate in turn, characterized by that said a-SiC photoconductive layer is composed of elements, such as a Si element and a C element as well as a H element or a halogen element, and said a-SiC photoconductive layer comprises layer zones containing elements of the IIIa group or the Va group in the periodic table in a quantity within an appointed range.

8 Claims, 60 Drawing Sheets

ELECTROPHOTOGRAPHIC SENSITIVE MEMBER

FIELD OF THE INVENTION

The present invention relates to an electrophotographic sensitive member comprising an amorphous silicon carbide photoconductive layer and an organic photosemiconductive layer piled up on said amorphous silicon carbide photoconductive layer.

PRIOR ART

Inorganic materials, such as Se, Se-Te, $As_2Se_3$, ZnO, CdS and amorphous silicon, and various kinds of organic material have been used for photoconductive materials of electrophotographic sensitive members. Of them, Se has been practically used first, and also ZnO, CdS and amorphous silicon have been practically used then. On the other hand, of the organic materials, PVK-TNF has been practically used first, and then a separated function type sensitive member, in which separate materials take partial charge of a function of generating electrical charges and a function of transporting electrical charges, has been proposed, and the development of the organic materials for the organic photosemiconductive layer has made rapid progress on account of this separated function type sensitive member.

On the other hand, also an electrophotographic sensitive member comprising an organic photosemiconductive layer piled up on the above described inorganic photoconductive layer has been proposed.

For example, a built-up sensitive member comprising a Si-layer and an organic photosemiconductive layer has been already practically used but with this sensitive member, disadvantages have occurred in that Se itself is harmful and a sensitivity on a long wavelength side is inferior.

So, a built-up sensitive member comprising an amorphous silicon carbide photoconductive layer and an organic photosemiconductive layer has been proposed in Japanese Patent Laid-Open No. Sho 56-14241. With this sensitive member, the above described points of problem were solved and the freedom from environmental pollution and the high photosensitive characteristics were obtained.

The electrophotographic sensitive member according to the above described Japanese Patent Laid-Open has a construction comprising an amorphous silicon carbide layer expressed by a chemical formula of $Si_{1-x}C_xH_y$ (wherein $0<x<1$, $0.05\leqq y\leqq 0.2$) and an organic photosemiconductive layer piled up on said amorphous silicon carbide layer.

However, the inventors of the present invention have produced such the electrophotographic sensitive member and its photosensitivity, surface potential, residual potential and the like with the results that satisfactory characteristics have not been obtained yet and the further improvement is required.

DISCLOSURE OF THE INVENTION

Accordingly, the present invention has been achieved in view of the above described matters and it is an object of the present invention to provide an electrophotographic sensitive member capable of increasing the photosensitivity and charge acceptance and decreasing the residual potential.

It is a first object of the present invention to provide an electrophotographic sensitive layer comprising an amorphous silicon carbide photoconductive layer (hereinafter amorphous silicon carbide is called a-SiC for short) and an organic photosemiconductive layer piled up on an electrically conductive substrate in this order, characterized by that a constituent element of said a-SiC photoconductive layer is a Si element, C element as well as a H element or halogen element and provided that the H element or halogen element is expressed by an A element and an elemental ratio of said layer is expressed by a composition formula of $[Si_{1-x}C_x]_{1-y}A_y$ $0<x<0.5$ and $0.2<y<0.5$ are held good between x and y.

A second invention of an electrophotographic sensitive member comprising an a-SiC photoconductive layer and an organic photosemiconductive layer piled up on an electrically conductive substrate in this order, characterized by that said a-SiC photoconductive layer comprises a first layer zone and a second layer zone, said first layer containing elements of the IIIa group (hereinafter called the IIIa group elements for short) in the periodic table in a quantity of 1 to 10,000 ppm and additionally a constituent element of said second layer zone being a Si element as well as a C element or a halogen element, and provided that an elemental ratio of said layer is expressed by a compositional formula of $[Si_{1-x}C_x]_{1-y}A_y$ x and y being set within a range of $0<x<0.5$ and $0.2<y<0.5$, respectively.

A third invention relates to an electrophotographic sensitive member comprising an a-SiC photoconductive layer and an organic photosemiconductive layer piled up on an electrically conductive substrate in this order, characterized by that said a-SiC photoconductive layer has a layer construction comprising a first layer zone and a second layer zone piled up in this order, said first layer zone containing the IIIa group elements in a quantity of 1 to 10,000 ppm, and said second layer zone containing the Va group elements in the periodic table (hereinafter called the Va group elements for short) in a quantity of 0 to 500 ppm.

A fourth invention relates to an electrophotographic sensitive member comprising an a-SiC photoconductive layer and an organic photosemiconductive layer piled up on an electrically conductive substrate in this order, characterized by that a constituent element is a Si element, C element as well as H element or a halogen element, and provided that the H element or the halogen element is expressed by an A element and an elemental composition of said layer is expressed by a compositional formula of $[Si_{1-x}C_x]_{1-y}A_y$ x and y being set within a range of $0<x<0.5$ and $0.2<y<0.5$, respectively, and further said layer containing the IIIa group elements in a quantity of 1 to 1,000 ppm.

A fifth invention provides an electrophotographic sensitive member comprising an a-SiC photoconductive layer and an organic semiphotoconductive layer piled up on an electrically conductive substrate in this order, characterized by that said a-SiC photoconductive layer has a layer construction comprising a first layer zone and a second layer zone, said first layer zone containing the Va group elements in a quantity of 5,000 ppm or less, or said first layer zone substantially containing no Va group element but said second layer zone containing the IIIa group elements in a quantity of 1 to 1,000 ppm.

A sixth invention provides an electrophotographic sensitive member comprising an a-SiC photoconductive layer and an organic photosemiconductive layer piled up on an electrically conductive substrate, characterized by that said a-SiC photoconductive layer has a layer construction comprising a first layer zone and a second layer zone, said first layer zone containing the Va group elements in a such a quantity that the largest content may be 10,000 ppm or less and the their content may be gradually reduced from the substrate to a surface of the sensitive member, and said second layer zone containing the IIIa group elements in a quantity of 1 to 1,000 ppm.

PREFERRED EMBODIMENTS OF THE INVENTION

The present invention will be below described in detail.

THE FIRST AND FOURTH INVENTIONS

Figure 1A:
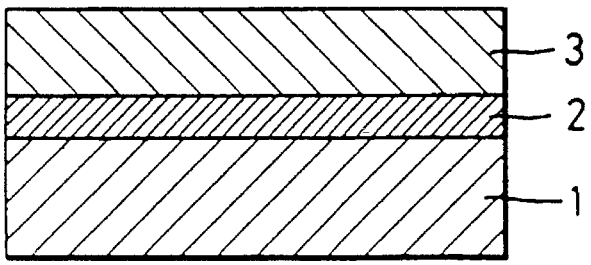
FIG. 1A to 1C is a sectional view showing a layer construction of an electrophotographic sensitive member according to the present invention.

FIG. 1A shows a layer construction of an electrophotographic sensitive member according to the first and fourth inventions. Referring now to FIG. 1A, an a-SiC photoconductive layer (2) and an organic photosemiconductive layer (3) piled up on an electrically conductive substrate (1) in this order. And, the a-SiC photoconductive layer (2) has a function of generating electric charges and the other organic photosemiconductive layer (3) has a function of transporting electric charges.

And, in the case where an elemental ratio of the above described a-SiC photoconductive layer (2) is set within the following range in the first invention and an elemental ratio and a content of IIIa group elements are set within the following ranges in the fourth invention, a photosensitivity of the a-SiC photoconductive layer (2) itself can be remarkably increased, and preferably a sensitive member for use in positive electrification is obtained by the first invention and a sensitive member for use in negative electrification is obtained by the fourth invention, by that the first and fourth inventions are characterized.

Compositional formula:

$$[Si_{1-x}C_x]_{1-y} \quad (1)$$

wherein A is hydrogen or halogen.

$0<x<0.5$, preferably $0.01<x<0.4$ $0.2<y<0.5$, preferably $0.25<y<0.45$.

Content of IIIa group elements: 1 to 1,000 ppm If the above described x value is 0.5 or more, the photoconductivity is remarkably reduced and the exciting function of photocarriers is reduced.

In addition, if the y value is 0.2 or less, there is a tendency that the dark conductivity is increased. Furthermore, there is a tendency that the photoconductivity is reduced, whereby the desired photoconductivity can not be obtained, while, if the y value is 0.5 or more, the adhesion to the substrate is reduced, whereby the separation is apt to occur.

Furthermore, as to the content of the above described IIIa group elements, if it is expressed by a mean value per the whole a-SiC layer and less than 1 ppm, no improvement of photosensitivity is found while if it exceeds 1,000 ppm, the dark conductivity is remarkably increased and a ratio of the photoconductivity to the dark conductivity is reduced, whereby the desired photosensitivity can not be obtained.

Besides, in the case where it is used as the sensitive member for use in positive electrification, the above described content of Ilia group elements may be set within a range of 100 ppm or less. That is to say, if said content is set within said range, electron mobility of excited carriers is high, thereby positive charge charged on a surface of the sensitive member can be smoothly neutralized with the result that the photosensitivity can be enhanced.

When the IIIa group elements are comprised in the a-SiC photoconductive layer (2), their doping distribution may be uniform or not uniform in a direction of layer thickness of the a-SiC photoconductive layer (2). If they are not uniformly doped, there may be layer zones comprising no IIIa group element in a part of said layer (2). In this case, the mean content of the IIIa group elements in the whole a-SiC layer comprising both the IIIa group element-containing a-SiC layer zones and the a-SiC layer zones without containing the IIIa group elements must be 1 to 1,000 ppm.

Said IIIa group elements include B, Al, Ga, In and the like but B is desirable in respect of not only the superior covalent bond and the sensitive changeability of semiconductor characteristics but also the superior charging capacity and photosensitivity.

In addition, also in the respective inventions which will be mentioned later, a B element is preferably used for the IIIa group elements.

Besides, the above described a-SiC photoconductive layer (2) comprises a H element and a halogen element for ends of dangling bonds but the H element is desirable in respect of the easy incorporation thereof into the end, whereby the density of the localized state in the band gap is reduced.

A thickness of the a-SiC photoconductive layer (2) is set within a range of 0.05 to 5 microns, preferably 0.1 to 3 microns. If said thickness is set within said range, the photosensitivity is increased and the residual potential is reduced.

Said substrate (1) includes metallic conductors formed of copper, brass, SUS,Al and the like or insulators, such as glass and ceramics, of which surface is coated with an electrically conductive thin film. Above all, Al is advantageous in respect of economy and adhesion to the a-SiC layer.

In addition, the electrophotographic sensitive member according to the present invention can correspond to the negative electrification type or the positive electrification type by the selection of materials of the organic photosemiconductive layer (3). That is to say, in the case of the negative electrification type electrophotographic sensitive member, the organic photosemiconductive layer (3) is formed of electron donor compounds, while, in the case of the positive electrification type electrophotographic sensitive member, the organic photosemiconductive layer (3) is formed of electron acceptor compounds.

Said electron doner compounds include high molecular compounds, such as poly-N-vinyl carbazol, polyvinyl ptrene, polyvinyl anthracene and pyreneformaldehyde condensation polymer, and low molecular compounds, such as oxadiazol, oxazol, pyrazoline, tripheny methane, hydrazone, triaryl amine, N-phenyl carbazol and stylbene. Said low molecular compounds are used in the form of suspension thereof in binders such as polycarbonate, polyester, methacrylic resin, polyamide resin, acryl epoxy resin, polyethylene resin, phenolic resin, polyurethane resin, butylal resin, polyvinyl acetate resin and urea resin.

Said electron acceptor compounds include 2, 4, 7-trinitrofluorenon and the like.

Thus, according to the first and fourth inventions, the photoconductivity, which is superior to that of the electrophotographic sensitive member proposed by Japanese Patent Laid-Open No. Sho 56-14241, can be obtained and suitable for the positive electrification and the negative electrification.

Figure 1B:
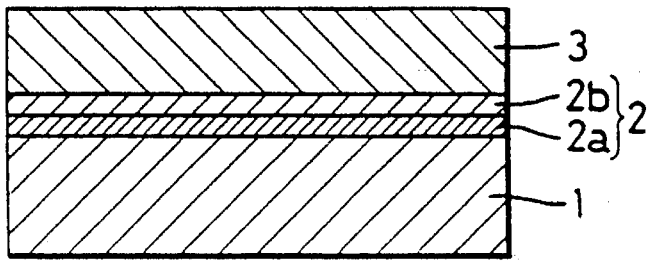

FIG. 1(B) shows layer constructions of the electrophotographic sensitive members according to the second, third, fifth and sixth inventions. In any one of the second, third, fifth and sixth inventions, the a-SiC photoconductive layer (2) comprises a first layer zone (2*a*) and a second layer zone (2*b*) piled up therein in this order differently from that in the first and fourth inventions.

The present invention is characterized by that the first and second layer zones (2*a*), (2*b*) contain the IIIa group elements or the Va group elements in an appointed quantity to improve the photosensitivity, charge acceptance or residual potential.

In addition, the present invention is also characterized by that the electrophotographic sensitive members according to the second and third inventions are suitable for the positive electrification while the electrophotographic sensitive members according to the fifth and sixth inventions are suitable for the negative electrification.

At first, the sensitive member for use in positive electrification will be described.

SECOND INVENTION

The second invention is characterized by that the a-SiC photoconductive layer (2) comprises the first layer zone (2*a*) and the second layer zone (2*b*) piled up therein in this order, the first layer zone (2*a*) containing the IIIa group elements in a quantity within an appointed range, and an elemental ratio of the second layer zone (2*b*) being set within an appointed range, whereby improving the charge acceptance in comparison with the first invention.

The second layer zone (2*b*) has a substantial function of generating photocarriers and if its elemental ratio is set by the compositional formula (1), the photosensitivity of this layer zone itself can be remarkably enhanced. Its reason is above described relating to the compositional formula (1).

A thickness of such the second layer zone (2*b*) is set within a range of 0.05 to 5 microns, preferably 0.1 to 3 microns. With the thickness within such the range, the photosensitivity can be increased and the residual potential can be reduced.

On the other hand, the first layer zone (2*a*) contains the IIIa group elements in a quantity of 1 to 10,000 ppm, preferably 500 to 5,000 ppm, whereby, of the photocarriers generated in the second layer zone (2*b*), positive charges can be smoothly flown toward the substrate side while the carriers on the substrate side, that is, negative charges induced on the substrate side can be prevented from being flown into the second layer zone (2*b*). That is to say, it can be said in respect of the rectification property of the first layer zone (2*a*) for the substrate (1) that the former is brought into a non-ohmic contact with the latter. Accordingly, this non-ohmic contact leads to the enhanced charge acceptance.

Besides, in the case where the content of the IIIa group elements is not uniform in the direction of layer thickness of the first layer zone it is expressed by a mean value thereof.

If such the content of the IIIa group elements is less than 1 ppm, the function of preventing the carriers from being injected from the substrate is reduced, whereby the charge acceptance is not enhanced, while, if it exceeds 10,000 ppm, the internal defects in this layer zone are increased to deteriorate the quality of film, whereby the charge acceptance is reduced and the residual potential is enhanced.

In addition, it is desired that the first layer zone (2*a*) is more concretely set in not only the content of the IIIa group elements but also the thickness.

That is to say, it is desired that the thickness of the first layer zone (2*a*) is set within a range of 0.1 to 5 microns, preferably 0.5 to 3 microns. The setting of the thickness of the first layer zone (2*a*) within such the range leads to an advantage in that not only the residual potential can be reduced but also the voltage-resistance of the sensitive member can be enhanced.

In addition, it is desired that the content of the IIIa group elements, thickness and compositional ratio of SiC of the first layer zone (2*a*) are set as follows:

That is to say, provided that the compositional ratio of SiC is expressed by the compositional formula $Si_{1-x}C_x$ it is desired that $0.1<x<0.5$ holds good. Thereupon, the charge acceptance can be enhanced and the adhesion to the substrate can be enhanced.

In addition, when the ratio of C element is set in the above described manner, it is desired that said ratio is larger in comparison with that in the second layer zone (2*b*). Thereupon, an advantage occurs in that the charge acceptance can be enhanced and the adhesion to the substrate can be enhanced.

Thus, with the electrophotographic sensitive member according to the second invention, of the carriers generated in the a-SiC photoconductive layer (2), negative charges are directed to the organic photosemiconductive layer (3) while positive charges to the substrate (1). Accordingly, the positive electrification type electrophotographic sensitive member is obtained.

THIRD INVENTION

The third invention is characterized by that the a-SiC photoconductive layer (2) comprises the first layer zone (2*a*) and the second layer zone (2*b*) piled up therein in this order, the first layer zone (2*a*) containing the IIIa group elements in a quantity within an appointed range, and the second layer zone (2*b*) containing the Va group elements in a quantity within an appointed range, whereby improving the photoconductivity in comparison with that in the second invention.

It is desired that the a-SiC photoconductive layer (2) comprises an amorphous Si element and an amorphous C element as well as a hydrogen element or a halogen element introduced into an end portion of a dangling bond of said Si element and C element and its compositional formula is expressed by the above described formula (1).

Next, the first layer zone (2*a*) contains the IIIa group elements in a quantity of 1 to 10,000 ppm, preferably 500 to 5,000 ppm, whereby the p-type semiconductor is obtained, of photocarriers generated in the a-SiC photoconductive layer (2), positive charges being able to be smoothly flown toward the substrate side while carriers on the substrate side can be prevented from being flown into the a-SiC photoconductive layer (2). That is to say, it can be said in respect of the rectification property of the first layer zone (2*a*) for the substrate (1) that the former is brought into a non-ohmic contact with the latter.

Accordingly, this non-ohmic contact leads to the enhanced charge acceptance.

In addition, if the content of the IIIa group elements in the first layer zone (2*a*) is not uniform in the direction of layer thickness of the first layer zone (2*a*), it is expressed by its mean value.

If the content of the IIIa group elements is less than 1 ppm, the function of preventing the carriers from being injected into the first layer zone (2*a*) from the substrate, whereby the charge acceptance is not enhanced, while, if said content exceeds 10,000 ppm, the internal defects in this layer zone are increased to deteriorate the film quality, whereby the charge acceptance is reduced and the residual potential is increased. The present inventors confirmed that the desirable range of the above described content of the IIIa group elements is 500 to 5,000 ppm and at this time both characteristics of the charge acceptance and the photosensitivity are improved.

In addition, it is desired that the first layer zone (2*a*) is more concretely set in not only content of the IIIa group elements but also thickness.

That is to say, the thickness of the first layer zone (2*a*) is set within a range of 0.05 to 5 microns, preferably 0.1 to 3 microns, and the setting of the thickness of the first layer zone (2*a*) within the above described range leads to an advantage that the residual potential can be reduced and the voltage resistance of the sensitive member can be enhanced.

Besides, it is desirable that the first layer zone (2*a*) is set in compositional ratio of SiC as follows in addition to content of the IIIa group elements and thickness.

That is to say, if the compositional ratio of SiC is expressed by the compositional formula $Si_{1-x}C_x$ it is desirable that $0.1<x<0.5$ holds good, and at this time the charge acceptance and the adhesion to the substrate can be enhanced.

Furthermore, when the ratio of C element is set in the above described manner, it is desirable that said ratio is larger than that in the second layer zone (2*b*), and at this time an advantage occurs in that the charge acceptance and the adhesion to the substrate can be enhanced.

The second layer zone (2*b*) contains the Va group elements in a quantity of 0 to 500 ppm, preferably 0 to 100 ppm, and at this time the n-type semiconductor layer is formed on the side of the organic photosemiconductive layer (3) within the a-SiC photoconductive layer (2) to be able to smoothly flow the photocarriers, in particular the negative charges, generated in said layer (2) toward the organic photosemiconductive layer (3), whereby enhancing the photosensitivity. In addition, the above described content of the Va group elements of expresses the substantial absence of the Va group elements and this is excluded in the third invention.

In addition, if the content of the Va group elements in the second layer zone (2*b*) is not uniform in the direction of layer thickness of the second layer zone (2*b*), said content is expressed by a mean value.

If such the content of the Va group elements exceeds 500 ppm, the capability of generating photoexcited carriers is reduced and the photosensitivity is reduced.

Furthermore, it is desirable that the second layer zone (2*b*) is more concretely set in not only content of the Va group elements but also thickness.

That is to say, it is desirable that the thickness is set within a range of 0.05 to 5 microns, preferably 0.1 to 3 microns, and at this time the photosensitivity is enhanced and the residual potential is reduced.

The above described Va group elements include N, P, As, Sb and Bi but P is preferably used in respect of its superior covalent bond and sensitive chargeability of semiconductor characteristics as well as superior chargeability and photosensitivity. In addition, also in the respective inventions, which will be mentioned later, it is desirable that the P element is used as the Va group elements.

Thus, with the electrophotographic sensitive member according to the third invention, a p-n junction is formed in the a-SiC photoconductive layer (2), whereby, of carriers generated in this layer (2), negative charges are directed toward the organic photosemiconductive layer (3), while, positive charges are directed toward the substrate (1), whereby obtaining the electrophotographic sensitive member of positive charge type.

In addition, the above described p-n junction construction led to the remarkable improvement of photosensitivity in comparison with the second invention.

In the electrophotographic sensitive member according to the third invention the content of the Ilia group elements in the first layer zone (2*a*) and the content of the Va group elements in the second layer zone (2*b*) may be changed in the direction of layer thickness of the first layer zone (2*a*) and the second layer zone (2*b*). It is illustrated in FIGS. 7 to 12 and FIGS. 17 and 78.

Referring to these drawings, an axis of abscissa designates a direction of layer thickness, d designating a boundary surface of the substrate (1) and the first layer zone (2*a*), a designating a boundary surface of the first layer zone (2*a*) and the second layer zone (2*b*), e designating a boundary surface of the second layer zone (2*b*) and the organic photosemiconductive layer (3), and an axis of ordinate designating a content of the IIIa group elements or the Va group elements.

When the content of the IIIa group elements in the first layer zone (2*a*) and the content of the Va group elements in the second layer zone (2*b*) are changed in the direction of layer thickness, said contents correspond to a mean content per the whole respective layer zones (2*a*), (2*b*).

In addition, when the content of the IIIa group elements and the content of the Va group elements are changed in the above described manner, a intrinsic semiconductor layer is formed between the first layer zone (2*a*) and the second layer zone (2*b*) according to circumstances.

Furthermore, according to the third invention, the first layer zone (2*a*) may contain the IIIa group elements so that the maximum content may be 1 to 10,000 ppm, preferably 500 to 5,000 ppm, and their doping distribution may be gradually reduced in the direction of layer thickness from the substrate to the surface of the sensitive member. Also this leads to the formation of the p-type semiconductor and of the photocarriers generated in the a-SiC photoconductive layer (2), in particular the positive charges can be smoothly flown toward the substrate side and the carriers on the substrate side can be prevented from being flown into the a-SiC photoconductive layer (2). That is to say, it can be said in respect of the rectification property of the first layer zone (2*a*) for the substrate (1) that the former is brought into non-ohmic contact with the latter. And, such the non-ohmic contact leads to a still more reduced residual potential.

If the first layer zone (2*a*) is expressed by the largest content of the IIIa group elements in such the manner, in the case where this largest content is less than 1 ppm, the function of preventing the carriers from being injected from the substrate is reduced, whereby the charge acceptance is not enhanced, while, in the case where it exceeds 10,000 ppm, the internal defects in this layer zone are increased to reduce the film quality, whereby reducing the charge acceptance and increasing the residual potential.

Also in the case where the doping distribution of the IIIa group elements in the first layer zone (2*a*) is gradually reduced in the direction of layer thickness from the substrate toward the surface of the sensitive member, as above described, both the content of the IIIa group elements in the first layer zone (2*a*) and the content of the Va group elements in the second layer zone (2*b*) may be changed in the direction of layer thickness. Its examples are shown in FIGS. 19 to 23.

Referring to these drawings, an axis of abscissa designates a direction of layer thickness, d designating a boundary surface of the substrate (1) and the first layer zone (2*a*), a designating a boundary surface of the first layer zone (2*a*) and the second layer zone (2*b*), e designating a boundary surface of the second layer zone (2*b*) and the organic photosemiconductive layer (3), and an axis of ordinate designating a content of the IIIa group elements or the Va group elements.

FIFTH INVENTION

The fifth invention is characterized by that the a-SiC photoconductive layer (2) comprises the first layer zone (2*a*) and the second layer zone (2*b*) piled up in this order therein, the first layer zone (2*a*) containing the Va group elements in a quantity within an appointed range or substantially no containing the Va group elements, and the second layer zone (2*b*) containing the IIIa group elements in a quantity within an appointed range, whereby improving the charge acceptance in comparison with that in the fourth invention.

At first, it is desirable that the a-SiC photoconductive layer (2) comprises an amorphous Si element and an amorphous C element as well as a H element or a halogen element introduced into an end portion of a dangling bond of said amorphous Si element and said amorphous C element and its composition is set so that said compositional formula (1) may hold good.

The first layer zone (2*a*) contains the Va group elements in a quantity of 0 to 5,000 ppm (0 ppm means the substantial absence of the Va group elements), preferably 0 to 3,000 ppm, whereby obtaining a n-type semiconductor, being able to smoothly flow photocarriers, in particular negative charges, generated in the a-SiC photoconductive layer (2) toward the substrate side, and being able to prevent carriers on the substrate side from being flown into the a-SiC photoconductive layer (2). That is to say, it can be said in respect of the rectification property of the first layer zone (2*a*) for the substrate (1) that the former is brought into non-ohmic contact with the latter.

Accordingly, this non-ohmic contact leads to the enhanced charge acceptance.

If the content of the Va group elements exceeds 5,000 ppm, the internal defects in this layer zone are increased to reduce the film quality, whereby reducing the charge acceptance and increasing the residual potential.

In addition, it is desirable that the first layer zone (2*a*) is more concretely set in thickness in addition to content of the Va group elements.

That is to say, it is desirable that the thickness of the first layer zone (2*a*) is set within a range of 0.05 to 5 microns, preferably 0.1 to 3 microns, At this time, an advantage occurs in that not only the residual potential can be reduced but also the voltage resistance of the sensitive member can be increased.

Moreover, it is desirable that the first layer zone (2*a*) is set in compositional ratio of SiC as follows in addition to content of the Va group elements and thickness.

That is to say, if the composition of the first layer zone (2*a*) is expressed by the compositional formula $Si_{1-x}C_x$ it is desirable that $0.1<x<0.5$ holds good. At this time, the charge acceptance and the adhesion to the substrate can be enhanced.

In addition, it is desirable that when the ratio of the C element is set in the above described manner, it is increased in comparison with that in the second layer zone (2*b*). At this time, an advantage occurs in that the charge acceptance and adhesion to the substrate can be enhanced.

The second layer zone (2*b*) contains the IIIa group elements in a quantity of 1 to 1,000 ppm, preferably 30 to 300 ppm, whereby a p-type semiconductor layer is formed on the side of the organic photosemiconductive layer (3) within the a-SiC photoconductive layer (2) and photocarriers, in particular positive charges, generated in this layer (2) can be smoothly flown into the organic photosemiconductive layer (3). As a result, the photosensitivity is enhanced and the residual potential is reduced.

Such the content of the IIIa group elements is less than 1 ppm, the photosensitivity can not be sufficiently improved, while, if it exceeds 1,000 ppm, the capacity of generating photoexcited carriers is reduced and the photosensitivity is reduced.

In addition, it is desirable that the second layer zone (2*b*) is more concretely set in thickness in addition to content of the IIIa group elements.

That is to say, it is desirable that the thickness of the second layer zone (2*b*) is set within a range of 0.05 to 5 microns, preferably 0.1 to 3 microns. At this time, the photosensitivity is enhanced and the residual potential is reduced.

Accordingly, with the electrophotographic sensitive member according to the fifth invention, the p-n junction is formed in the a-SiC photoconductive layer (2) and of carriers generated in this layer (2), positive charges are directed toward the organic photosemiconductive layer (3) while negative charges are directed toward the substrate (1). Accordingly, the electrophotographic sensitive member of negatively charged type is obtained.

In addition, the above described p-n junction leads to a remarkable improvement of the charge acceptance in comparison with that in the fourth invention.

In the electrophotographic sensitive member according to the fifth invention the content of the Va group elements in the first layer zone (2*a*) and the content of the IIIa group elements in the second layer zone (2*b*) may be changed in the direction of layer thickness. Its examples are shown in FIGS. 7 to 16.

Referring to these drawings, an axis of abscissa designates a direction of layer thickness, d designating a boundary surface of the substrate and the first layer zone (2*a*), a designating a boundary surface of the first layer zone (2*a*) and the second layer zone (2*b*), e designating a boundary surface of the second layer zone (2*b*) and the organic photosemiconductive layer (3), and an axis of ordinate designating a content of the Va group elements or the IIIa group elements.

When the content of the Va group elements in the first layer zone (2*a*) and the content of the IIIa group elements in the second layer zone (2*b*) are changed in the direction of layer thickness in the above described manner, said contents correspond to mean values per the respective whole layer zones (2*a*), (2*b*).

In addition, in the case where the content of the Va group elements is changed in the above described manner, a intrinsic semiconductive layer is formed between the first layer zone (2*a*) and the second layer zone (2*b*) according to circumstances.

SIXTH INVENTION

The sixth invention is characterized by that the a-SiC photoconductive layer (2) comprises the first layer zone (2*a*) and the second layer zone (2*b*) formed therein in this order, the first layer zone (2*a*) containing the Va group elements in a quantity within an appointed range, and the second layer zone (2*b*) containing the IIIa group elements in a quantity within an appointed range, whereby improving the charge acceptance and photosensitivity in comparison with the fifth invention.

At first, it is desirable that the a-SiC photoconductive layer (2) comprises an amorphous Si element and an amorphous C element as well as a H element or a halogen element introduced into an end portion of a dangling bond of said Si element and said C element and its composition is expressed by said compositional formula (1).

Next, the first layer zone (2*a*) contains the Va group elements so that their maximum content may be 0 to 10,000 ppm (excluding 0), preferably 0 to 3,000 ppm, and their doping distribution is gradually reduced in the direction of layer thickness from the substrate toward the surface of the sensitive member, whereby a n-type semiconductor is formed and of photocarriers generated in the a-SiC photoconductive layer (2), negative charges can be smoothly flown toward the substrate side while carriers on the substrate side can be prevented from being flown into the a-SiC photoconductive layer (2). That is to say, it can be said in respect of the rectification property of the first layer zone (2*a*) for the substrate (1) that the former is brought into non-ohmic contact with the latter.

And, this non-ohmic contact leads to the still more reduced residual potential.

In addition, when the first layer zone (2*a*) is expressed by the largest content of the Va group elements, if this largest content exceeds 10,000 ppm, the internal defects in this layer zone are increased to reduce the film quality, whereby the charge acceptance is reduced and the residual potential is increased.

Besides, it is desirable that the first layer zone (2*a*) is more concretely set in thickness in addition to largest content of the Va group elements.

That is to say, it is desirable that the thickness of the first layer zone (2*a*) is set within a range of 0.05 to 5 microns, preferably 0.1 to 3 microns. At this time, an advantage occurs in that the residual potential can be reduced and the voltage resistance of the sensitive member can be enhanced.

In addition, it is desirable that the first layer zone (2*a*) is set in compositional ratio of SiC as follows in addition to largest content of the Va group elements and thickness.

That is to say, when it is expressed by the compositional formula $Si_{1-x}C_x$ it is desirable that $0.1<x<0.5$ holds good. At this time, the charge acceptance and the adhesion to the substrate can be enhanced.

In addition, it is desirable that said ratio is larger than that in the second layer zone (2*b*) when the ratio of C element is set in the above described manner. At this time, an advantage occurs in that the charge acceptance and the adhesion to the substrate can be enhanced.

The second layer zone (2*b*) contains the IIIa group elements in a quantity of 1 to 1,000 ppm, preferably 3 to 300 ppm, whereby a p-type semiconductive layer is formed on a side of the organic photosemiconductive layer (3) in the a-SiC photoconductive layer (2), and, of carriers generated in this layer (2), positive charges can be smoothly flown toward the organic photosemiconductive layer (3), and as a result, the photosensitivity is enhanced and the residual potential is reduced.

In addition, when the content of the Ilia group elements in the second layer zone (2*b*) is not uniform in the direction of layer thickness of the second layer zone (2*b*), it is expressed by a mean value.

If such the content of the Ilia group elements is less than 1 ppm, the photosensitivity can not be sufficiently improved, while, if it exceeds 1,000 ppm, the capacity of generating photoexcited carriers and the photosensitivity are reduced.

In addition, it is desirable that the second layer zone (2*b*) is more concretely set in thickness in addition to content of the Ilia group elements.

That is to say, it is desirable that the thickness of the second layer zone (2*b*) is set within a range of 0.05 to 5 microns, preferably 0.1 to 3 microns. At this time, the photosensitivity is enhanced and the residual potential is reduced.

Thus, with the electrophotographic sensitive member according to the sixth invention, a p-n junction is formed in the a-SiC photoconductive layer (2), and, of carriers generated in this layer (2), positive charges are directed toward the organic photosemiconductive layer (3) while negative charges are directed toward the substrate (1). Accordingly, the negative charge type electrophotographic sensitive member is obtained.

In addition, such the p-n junction leads to a remarkable reduction of residual potential in comparison with that in the fifth invention.

Besides, in the electrophotographic sensitive member according to the sixth invention both the content of the Va group elements in the first layer zone (2*a*) and the content of the IIIa group elements in the second layer zone (2*b*) may be changed in the direction of layer thickness. Its examples are shown in FIGS. 19 to 23.

Referring to these drawings, an axis of abscissa designates a direction of layer thickness, d designating a boundary surface of the substrate and the first layer zone (2*a*), a designating a boundary surface of the first layer zone (2*a*) and the second layer zone (2*b*), e designating a boundary surface of the second layer zone (2*b*) and the organic photosemiconductive layer (3), and an axis of ordinate designating a content of the Va group elements or the IIIa group elements.

When the content of the Va group elements in the first layer zone (2*a*) and the content of the IIIa group elements in the second layer zone (2b) are changed in the direction of layer thickness, said contents correspond to the respective mean values per the respective whole layer zones (2a), (2b).

As above described, the electrophotographic sensitive member according to the present invention could be developed as the second to sixth inventions by setting the doping by the Va group elements and/or the IIIa group elements of the a-SiC photoconductive layer (2) within the appointed range.

Next, according to the present invention, the content of C element may be changed in the direction of layer thickness of the a-SiC photoconductive layer (2).

Figure 1C:
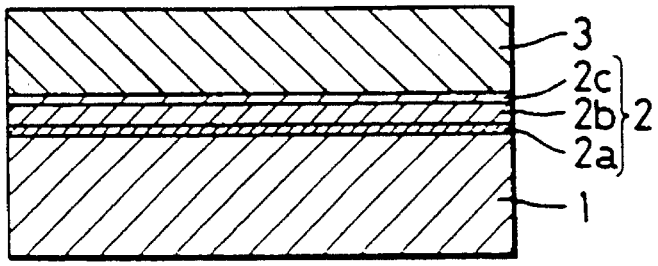

For example, as to the electrophotographic sensitive members according to the second to sixth inventions, a layer zone containing a large quantity of C element may be formed between the second layer zone (2b) and the organic photosemiconductive layer (3), as shown in FIG. 1C. At this time, a difference between the second layer zone (2b) and the organic photosemiconductive layer (3) in dark conductivity is remarkably reduced, whereby the carriers are difficult to be trapped on the boundary surface of both layers (2b), (3).

That is to say, the dark conductivity of the second layer zone (2b) is about $10^{-11}$ to $10^{-13}$ $(ohm \cdot cm)^{-1}$ while that of the organic photosemiconductive layer (3) is about $10^{-14}$ to $10^{-15}$ $(ohm \cdot cm)^{-1}$. Accordingly, the carriers generated in the second layer zone (2b) are apt to be smoothly flown toward the organic photosemiconductive layer (3) due to such a great difference of dark conductivity. Consequently, the present inventors have found that the formation of the layer zone (2c) containing a large quantity of C element leads to a reduced dark conductivity of this layer zone (2c) and a reduced difference between both layers (2c), (3), whereby both characteristics of the photosensitivity and the residual potential can be improved.

Such the layer zone (2c) containing a large quantity of C element is expressed by a ratio of C element contained and a thickness as follows:

The ratio of C element contained is a value of x in $Si_{1-x}C_x$ and it is desirable that x is set within a range of 0.2 to 0.5, preferably 0.3 to 0.5. If the value of x is less than 0.2, the difference between both layers (2b), (3) in dark conductivity can not be reduced in a desired manner, whereby the characteristics of photosensitivity and residual potential can not be improved, while, if the value of x is 0.5 or more, the carriers are apt to be trapped in the layer zone (2c) containing a large quantity of C element and the photosensitivity characteristics are reduced.

In addition, it is desirable that the thickness of the layer zone (2c) containing a large quantity of C element is set within a range of 10 to 2,000 Å, preferably 500 to 1,000 Å. There is a tendency that if the thickness is less than 10 Å, the characteristics of photosensitivity and residual potential can not be improved, while, if it exceeds 2,000 Å, the residual potential is increased.

The content of C element of such the second layer zone (2b) and the layer zone (2c) containing a large quantity of C element may be changed in the direction of layer thickness. Its examples are shown in for example FIGS. 24 to 29. Referring to these drawings, an axis of abscissa designates a direction of layer thickness, a designating a boundary surface of the first layer zone (2a) and the second layer zone (2b), b designating a boundary surface of the second layer zone (2b) and the layer zone (2c) containing a large quantity of C element, c designating a boundary surface of the layer zone (2c) containing a large quantity of C element and the organic photosemiconductive layer (3), and an axis of ordinate designating a content of C element.

In addition, when the content of C element in the second layer zone (2b) or the layer zone (2c) containing a large quantity of C element is changed in the direction of layer thickness, the ratio of C element contained (the value of x) corresponds to mean ratios of C element contained per the respective whole layer zones (2b), (2c).

PRODUCTION METHODS ACCORDING TO THE PRESENT INVENTION

Thin-film forming methods, such as glow discharge decomposition method, ion plating method, reactive sputtering method, vacuum vapor deposition method and CVD method, have been used as a method of forming an a-SiC layer. In the case where the glow-discharge decomposition method is used, a Si element-containing gas is combined with a C element-containing gas and the resulting mixture gas is subjected to a plasma decomposition to form a film. Said Si element-containing gas includes $SiH_4$, $Si_2H_6$, $Si_3H_8$, $SiF_4$, $SiCl_4$, $SiHCl_3$ and the like while said C element-containing gas includes $CH_4$, $C_2H_2$, $C_3H_8$ and the like but above all $C_2H_2$ is desirable in respect of the speedy film formation.

In addition, in the case where the $C_2H_2$ gas and the Si element-containing gas are subjected to the glow-discharge decomposition in combination to form the a-SiC layer, the film-forming speed is reduced or increased by changing a flow rate of gases, a mixture ratio of gases, a high-frequency electric power and the like. However, even in the case where the film-forming speed is reduced, the film-forming speed, which is sufficiently high in comparison with that in the use of other C element-containing gases, can be obtained.

It could be confirmed from the repeated experiments by the present inventors that comparing at the same C element-content, the a-SiC photoconductive layer obtained at the reduced film-forming speed was superior to that obtained at the increased film-forming speed in photoconductive characteristic.

However, also the a-SiC photoconductive layer obtained at the increased film-forming speed has sufficient photoconductive characteristics.

Figure 2:
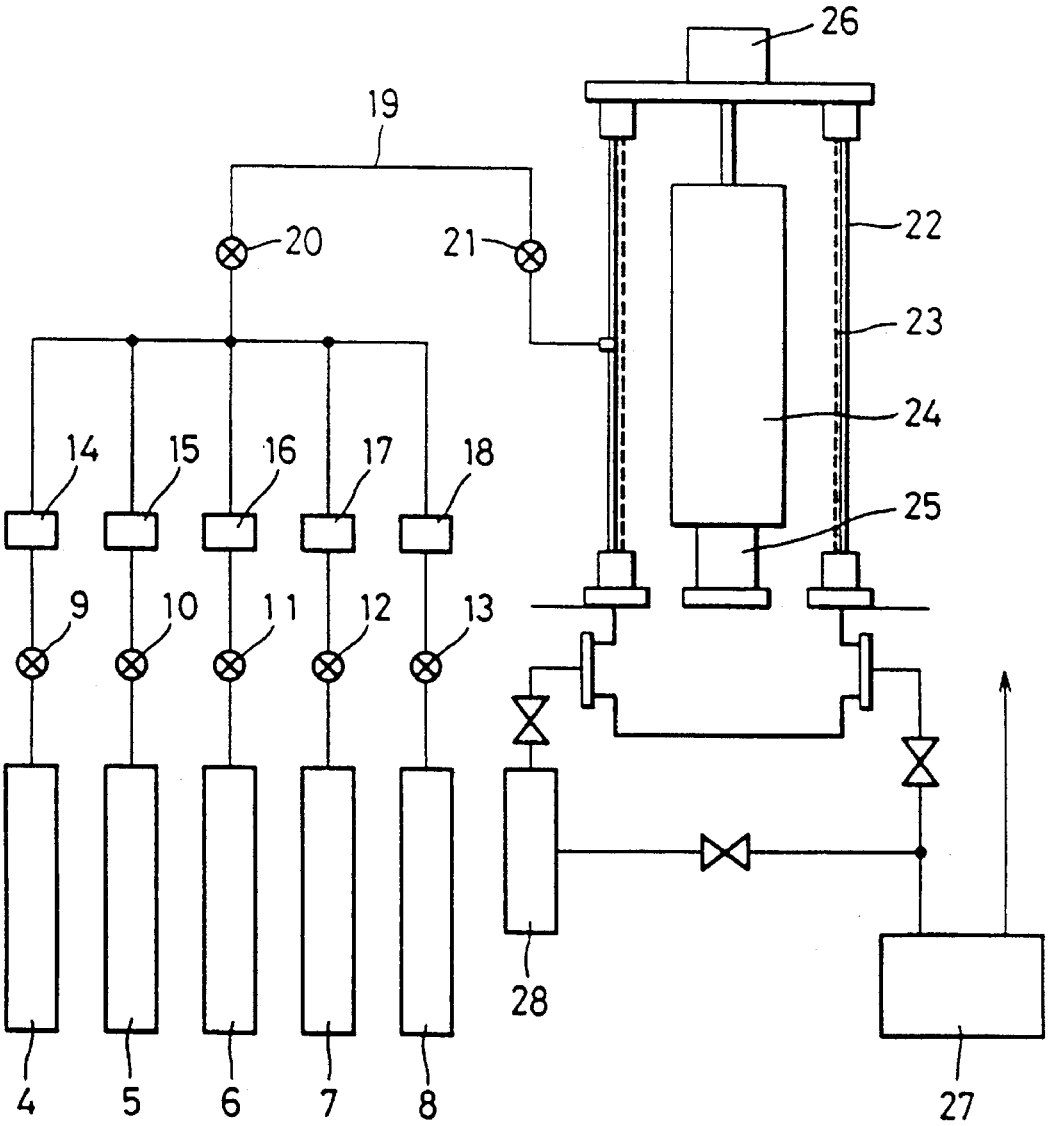
FIG. 2 is a schematic drawing showing a glow-discharge decomposition apparatus used in preferred embodiments of the present invention.

The glow-discharge decomposition apparatus used in the present preferred embodiments is described with reference to FIG. 2 illustrating one example thereof.

Referring to FIG. 2, a first tank (4), a second tank (5), a third tank (6), a fourth tank (7) and a fifth tank (8) comprises a $SiH_4$ gas, a $C_2H_2$ gas, a $PH_3$ gas, $B_2H_6$ gas (the $PH_3$ gas and the $B_2H_6$ gas are all diluted with a hydrogen gas) and $H_2$ in a leaktight manner, respectively. These gases are discharged by opening the respective corresponding first adjusting valve (9), a second adjusting valve (10), a third adjusting valve (11), a fourth adjusting valve (12) and a fifth adjusting valve (13). Flow rates of the discharged gases are controlled by the respective mass flow controllers (14), (15), (16), (17), (18) and the respective gases are mixed to be sent to a main pipe (19). In addition, reference numerals (20), (21) designate a stop valve.

The gas passing through the main pipe (19) is flown into a reaction tube (22) but said reaction tube (22) is provided with a capacitively couple type discharge electrode (231 disposed therein, a cylindrical film-forming substrate (24) being placed on a substrate-supporting member (25), and said substrate-supporting member (25) being rotatably driven by means of a motor (26), whereby the the substrate (24) is rotated. And, a high-frequency electric power having an electric power of 50 w to 3 Kw and a frequency of 1 to 50 MHz is applied to the electrode (23) and the substrate (24) is heated to about 200° to 400° C., preferably about 200° to 350° C., by means of a suitable heating means.

In addition, the reaction tube (22) is connected to a rotary pump (27) and a diffusion pump (28), whereby a depressed condition (a gas pressure during the discharge of 0.01 to 2.0 Tort), which is required during the film-formation, can be maintained.

In the case where for example a P element containing a-SiC layer is formed on the substrate (24) by the use of the glow-discharge decomposition apparatus having such the construction, the adjusting valve (9), the second adjusting valve (10), the third adjusting valve (11) and the fifth adjusting valve (13) are opened to discharge the $SiH_4$ gas, the $C_2H_2$ gas, the $PH_3$ gas and the $H_2$ gas, respectively, and the discharged quantities of said gases are controlled by means of the mass flow controllers (14), (15), (16) and (18), respectively. The respective gases are mixed and the resulting mixture gas is flown into the reaction tube (22) through the main pipe (19). And, upon setting the vacuousity within the reaction tube, the substrate temperature and the high-frequency electric power applied to the electrode at appointed conditions, the glow-discharge is generated and the gas is decomposed to form the P element-containing a-SiC film on the substrate at a high speed.

After the a-SiC layer is formed by the above described thin-film forming method, the organic photosemiconductive layer is formed.

The organic photosemiconductive layer is formed by the dipping method or the coating method. The former is a method in which a sensitive material is dipped in a dispersion of coating agents in solvents and then pulled up at a constant speed followed by subjecting to the natural dehydration and the thermal aging (about one hour at about 150° C.). In addition, according to the latter coating method, a sensitive material dispersed in a solvent is applied by the use of a coater and then the thermal dehydration is carried out.

The present invention will be below described with reference to the preferred embodiments.

EXAMPLE 1

The a-SiC film (having a film-thickness of about 1 micron) was formed by the glow-discharge in the glow-discharge decomposition apparatus shown in FIG. 2 with setting a flow rate Of the $SiH_4$ gas at 200 sccm, a flow rate of the $H_2$ gas at 270 sccm, the gas pressure at 0.6 Tort, the high-frequency electric power at 150 W and the substrate temperature at 250° C. but changing a flow rate of the $C_2H_2$ gas.

Figure 3:
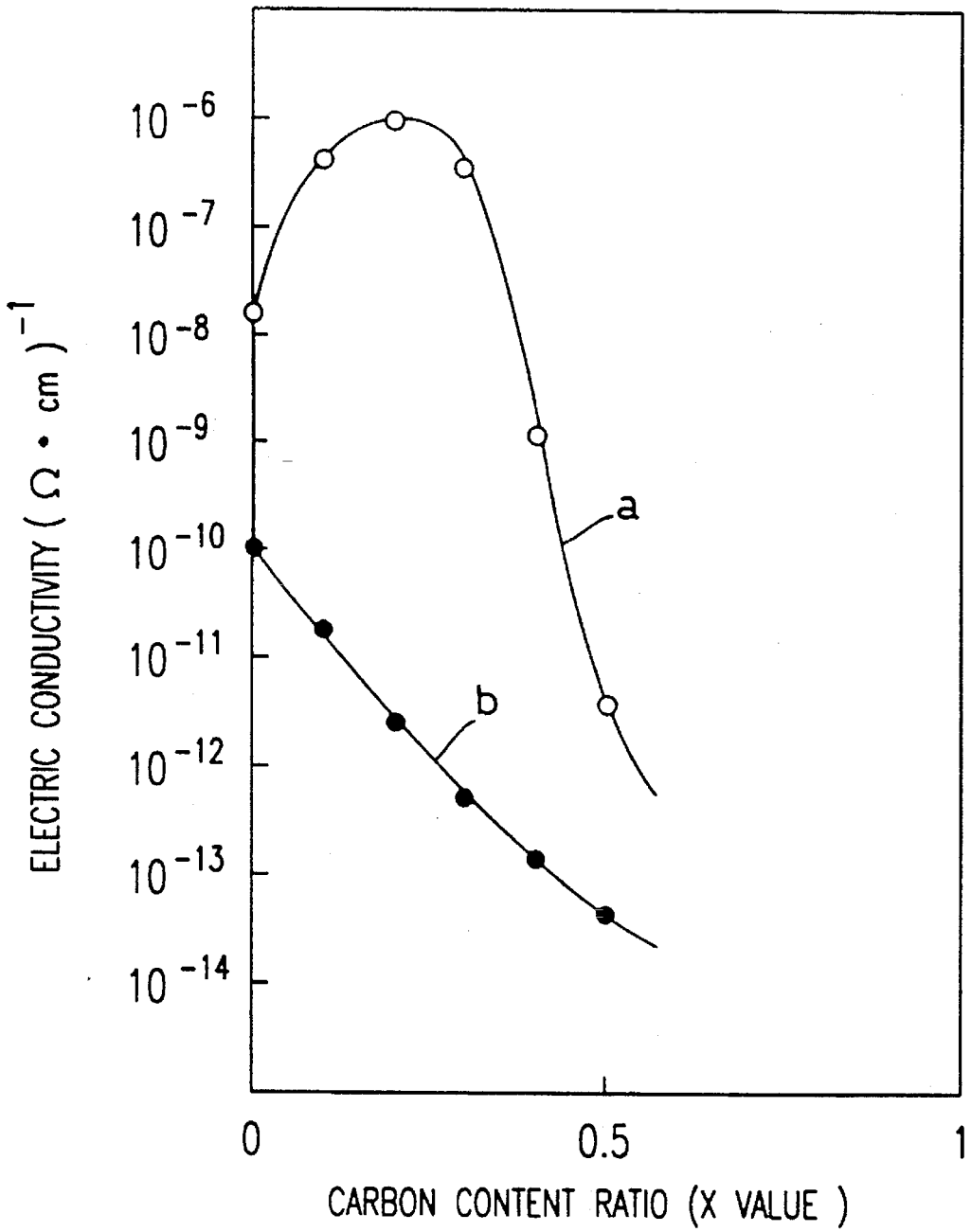
FIG. 3 is a graph showing a relation between a carbon content ratio and an electric conductivity.

The C-content of the a-SiC film was changed in such the manner and a quantity of C in the film was measured by the XMA method and in addition the the photoconductivity and the dark conductivity were measured with the results as shown in FIG. 3.

Referring to FIG. 3, an axis of abscissa designates the C-content, that is, the value of x in $Si_{1-x}C_x$ an axis of ordinate designating the conductivity, ○ marks designating a plot of the photoconductivity for an exposure wavelength of 550 nm (luminous quantity: 50 micronW/cm$^2$), ● marks designating a plot of the dark conductivity, and a, b designating characteristic curves thereof.

Figure 4:
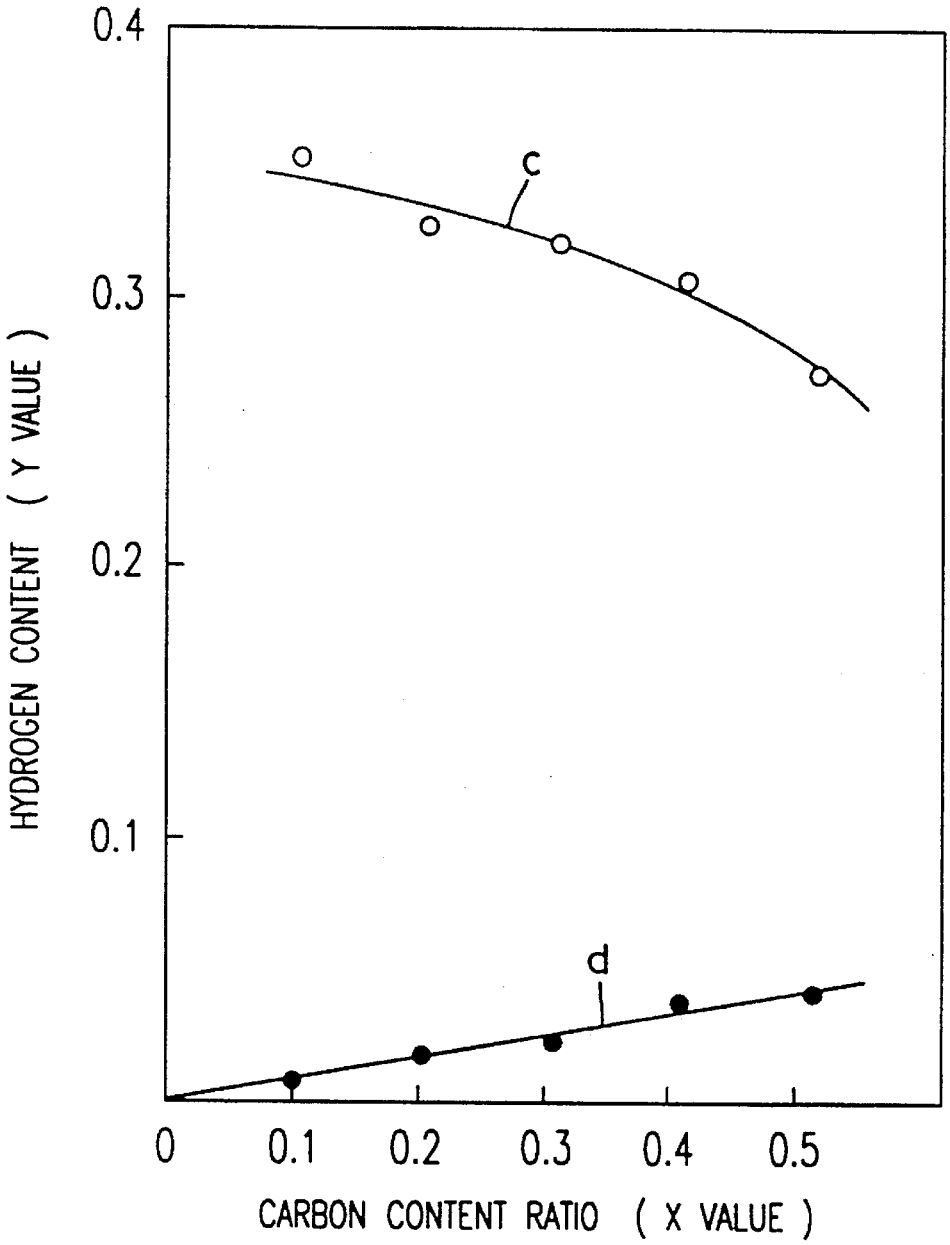
FIG. 4 is a graph showing a relation between a carbon content ratio and a hydrogen content.

In addition, the H-content of the above described respective a-SiC films was measured by the infrared absorption method with the results as shown in FIG. 4.

Referring to FIG. 4, an axis of abscissa designates the value x in $Si_{1-x}C_x$ an axis of ordinate designating the H-content, that is, a value of y in $[Si_{1-x}C_x]_{1-y}H_y$ ○ marks designating a plot of a quantity of H joined to Si atoms, ● marks designating a plot of a quantity of H joined to C atoms, and c, d designating characteristic curves thereof.

It is clearly found from FIG. 4 that the values of y of the a-SiC films according to the present EXAMPLE are all within a range of 0.3 to 0.4.

In addition, it is clear from FIG. 3 that if the C-content x is within a range of 0 to 0.5, a ratio of the photoconductivity to the dark conductivity is remarkably increased, whereby the superior photosensitivity is obtained.

EXAMPLE 2

Next, in the present EXAMPLE the a-SiC film (having a film-thickness of about 1 micron) was formed by the glow-discharge with setting the flow rate of the $SiH_4$ gas at 200 sccm, the flow rate of the $C_2H_2$ gas at 20 sccm, the flow rate of the $H_2$ gas at 0 to 1,000 sccm, the high-frequency electric power at 50 to 300 W and the gas pressure at 0.3 to 1.2 Torr.

Figure 5:
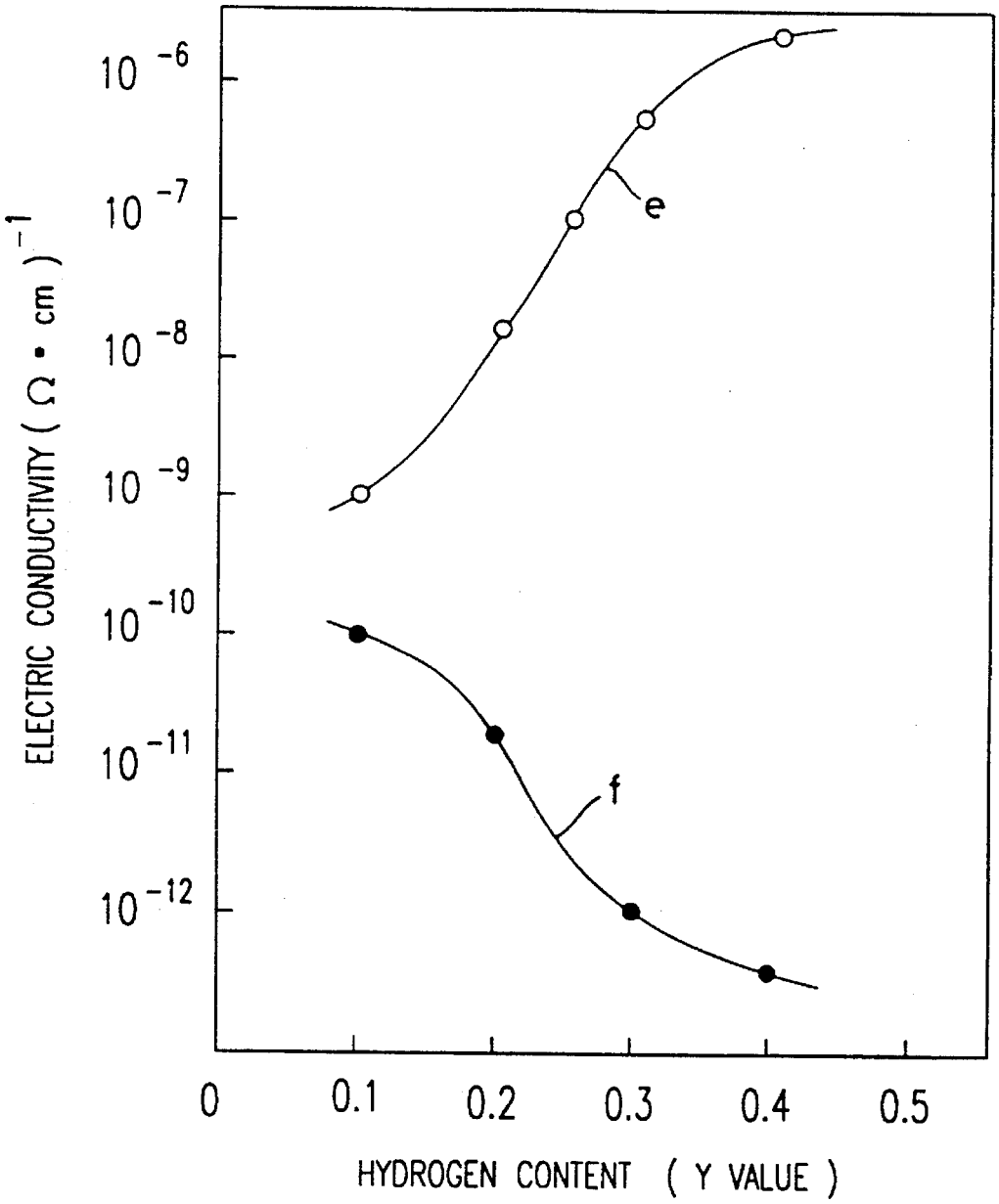
FIG. 5 is a graph showing a relation between a hydrogen content and an electric conductivity.

Thus, various kinds of a-SiC film, of which C-content x was set at 0.3 and H-content y was varied, were formed and their photoconductivity and dark conductivity were measured with the results as shown in FIG. 5.

Referring to FIG. 5, an axis of abscissa designates the H-content, that is, the value y in $[Si_{0.7}C_{0.3}]_{1-y}H_y$ an axis of ordinate designating the conductivity, ○ marks designating a plot of the photoconductivity for the exposure wavelength of 550 nm (luminous quantity: 50 microW/cm$^2$), ● marks designating a plot of the dark conductivity, and e, f designating characteristic curves thereof.

It is clear from FIG. 5 that if the value of y exceeds 0.2, the photoconductivity is increased and the dark conductivity is reduced.

EXAMPLE 3

In the present EXAMPLE the B element-containing a-SiC film (having a film-thickness of about 1 micron) was formed by the glow-discharge with setting the flow rate of the $SiH_4$ gas at 200 sccm, the flow rate of the $C_2H_2$ gas at 20 sccm, the flow rate of the $B_2H_6$ gas diluted with $H_2$ (having a concentration of 0.2% or 40 ppm) at 5 to 500 sccm, the flow rate of the $H_2$ gas at 200 sccm, the high-frequency electric power at 150 W, and the gas pressure at 0.6 Torr.

Figure 6:
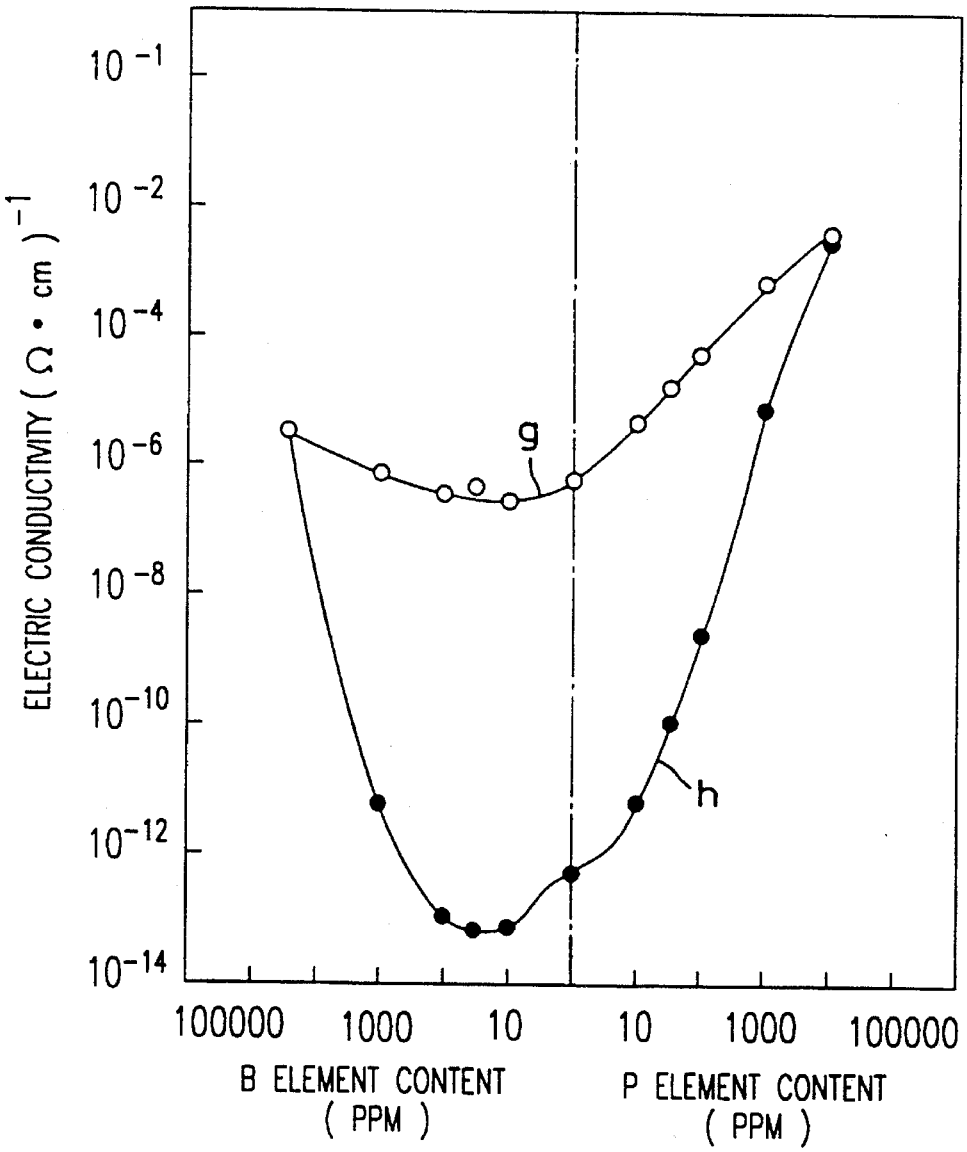
FIG. 6 is a graph showing a relation between a content of IIIa group elements or Va group elements and an electric conductivity.
Figure 7:
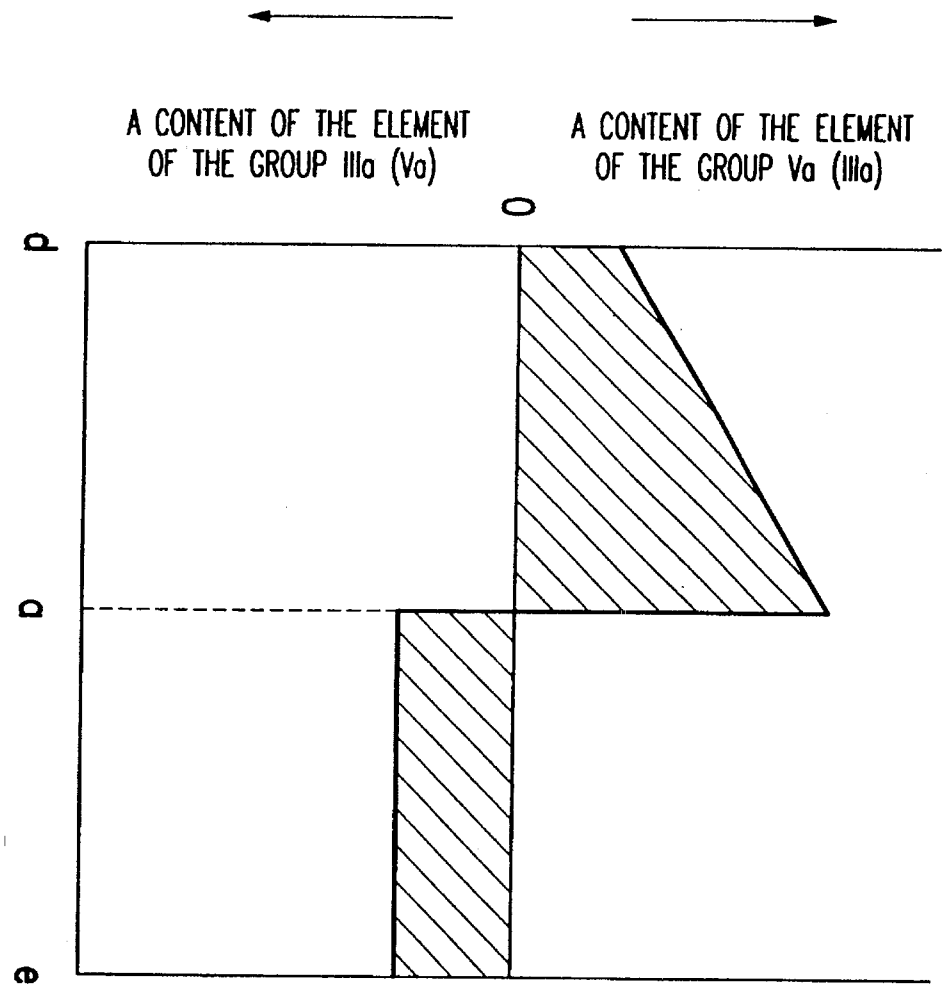
FIGS. 7 to 23 are graphs showing a content of Va group elements and that of IIIa group elements in a direction of layer thickness of an a-SiC photoconductive layer.
Figure 8:
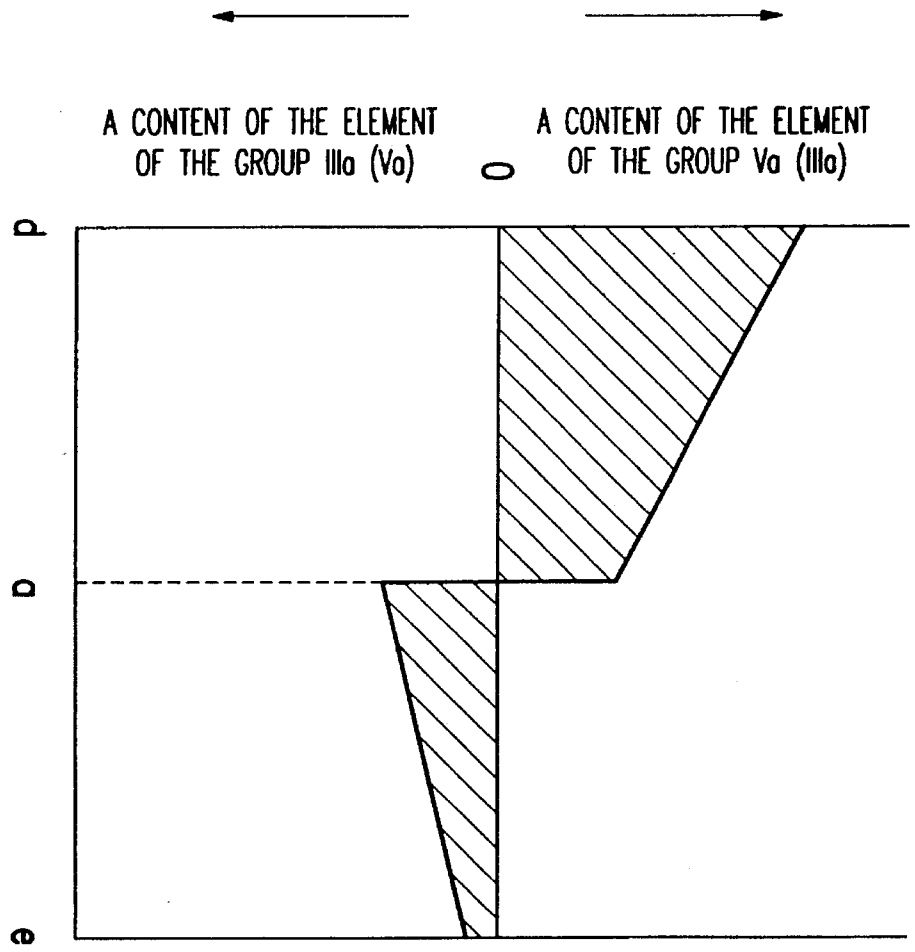
Figure 9:
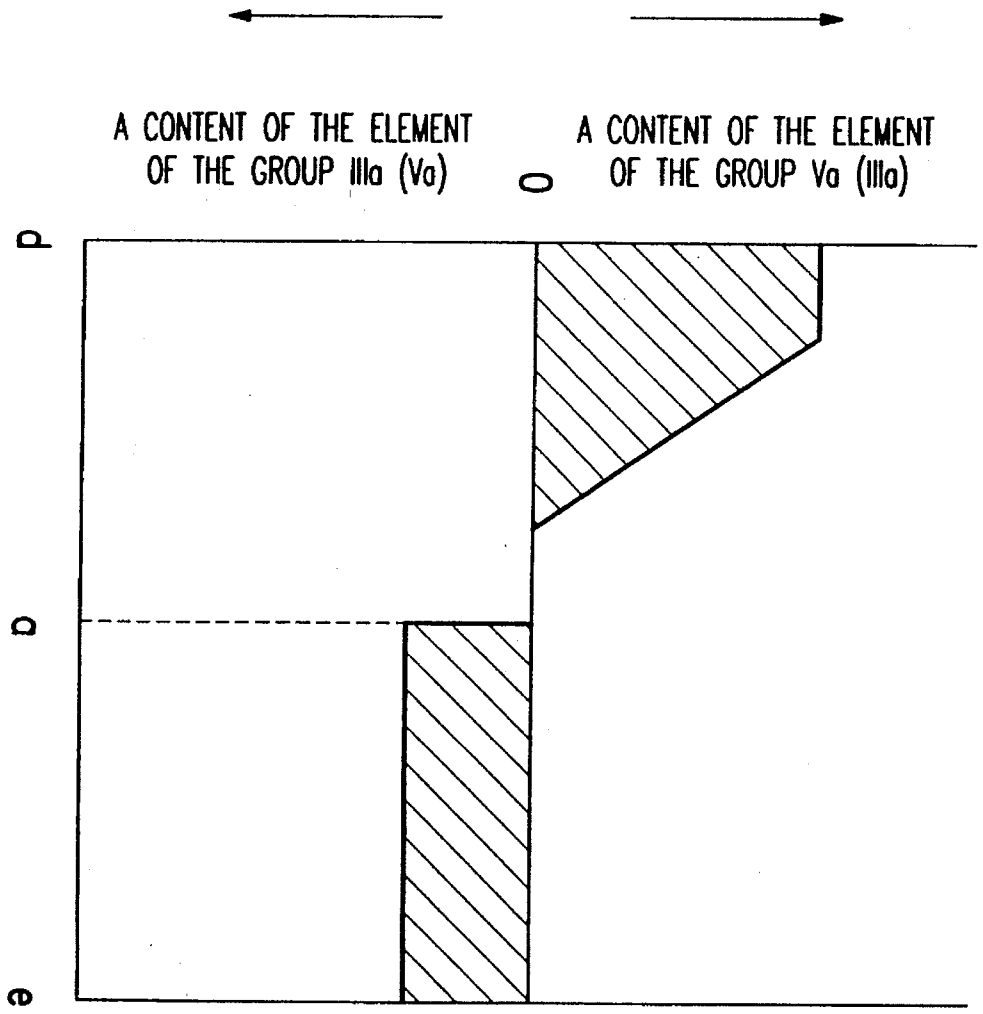
Figure 10:
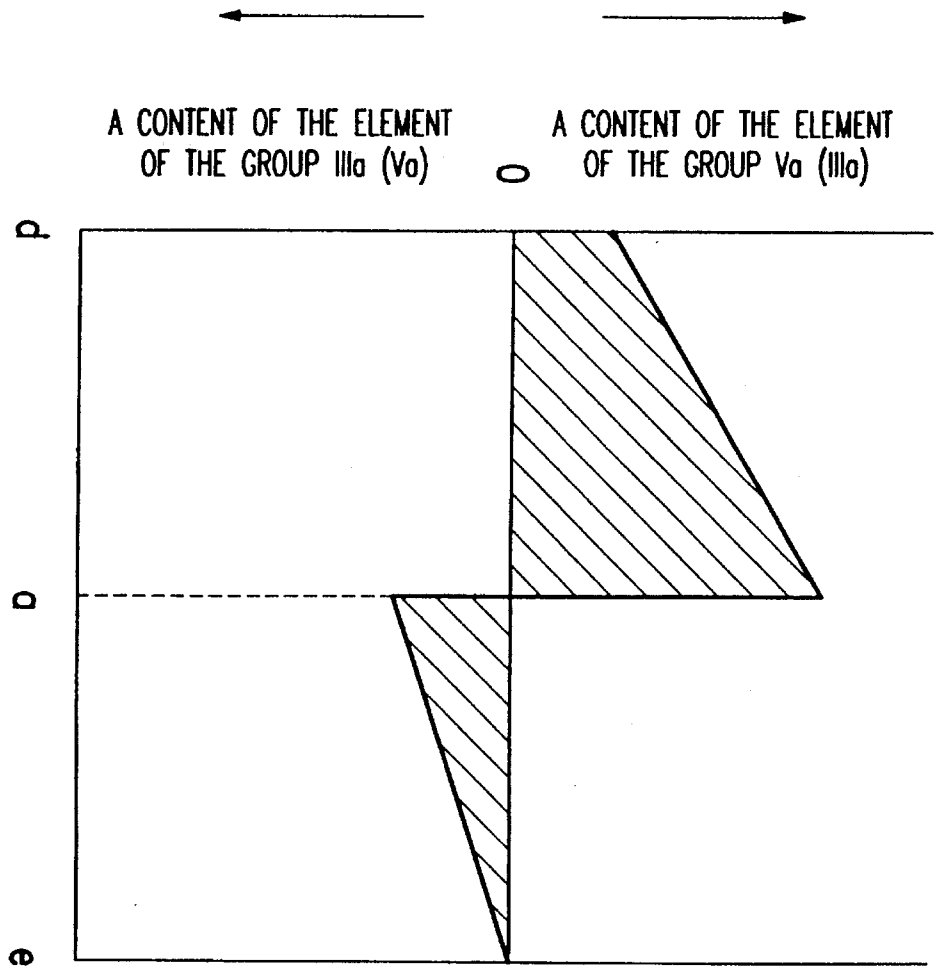
Figure 11:
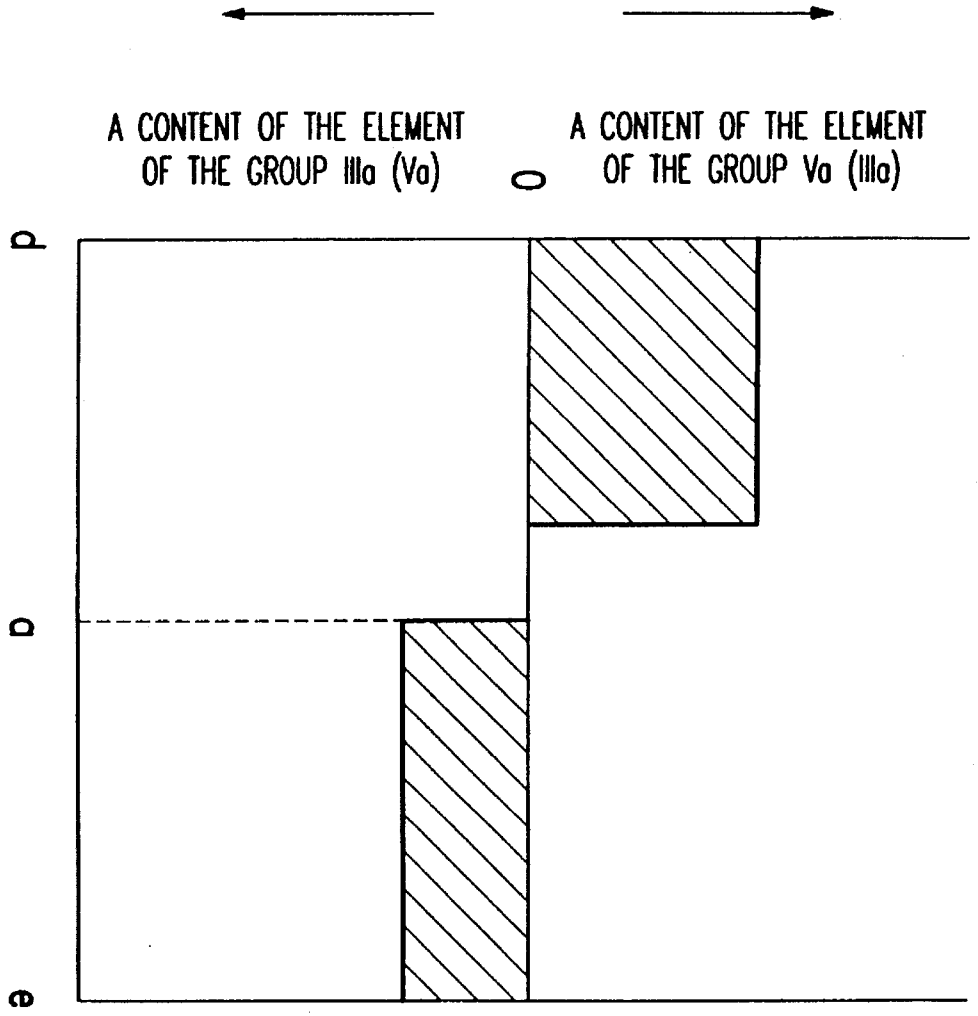
Figure 12:
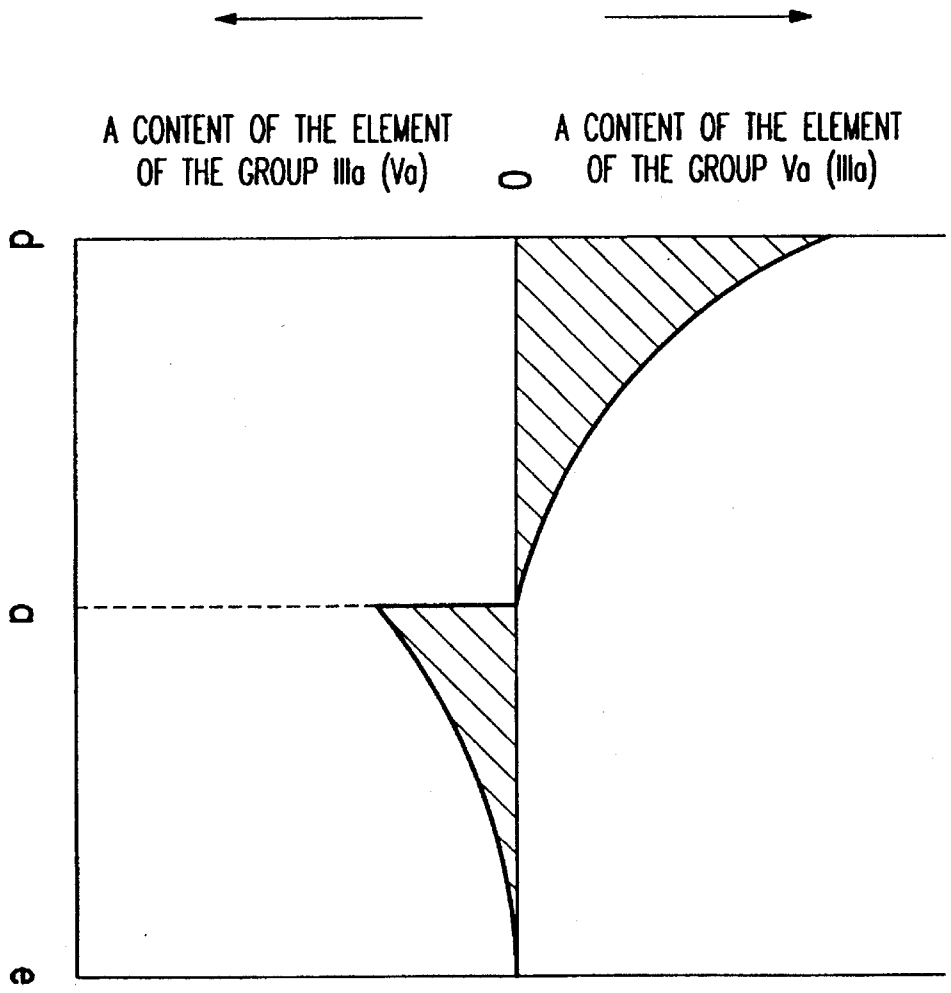
Figure 13:
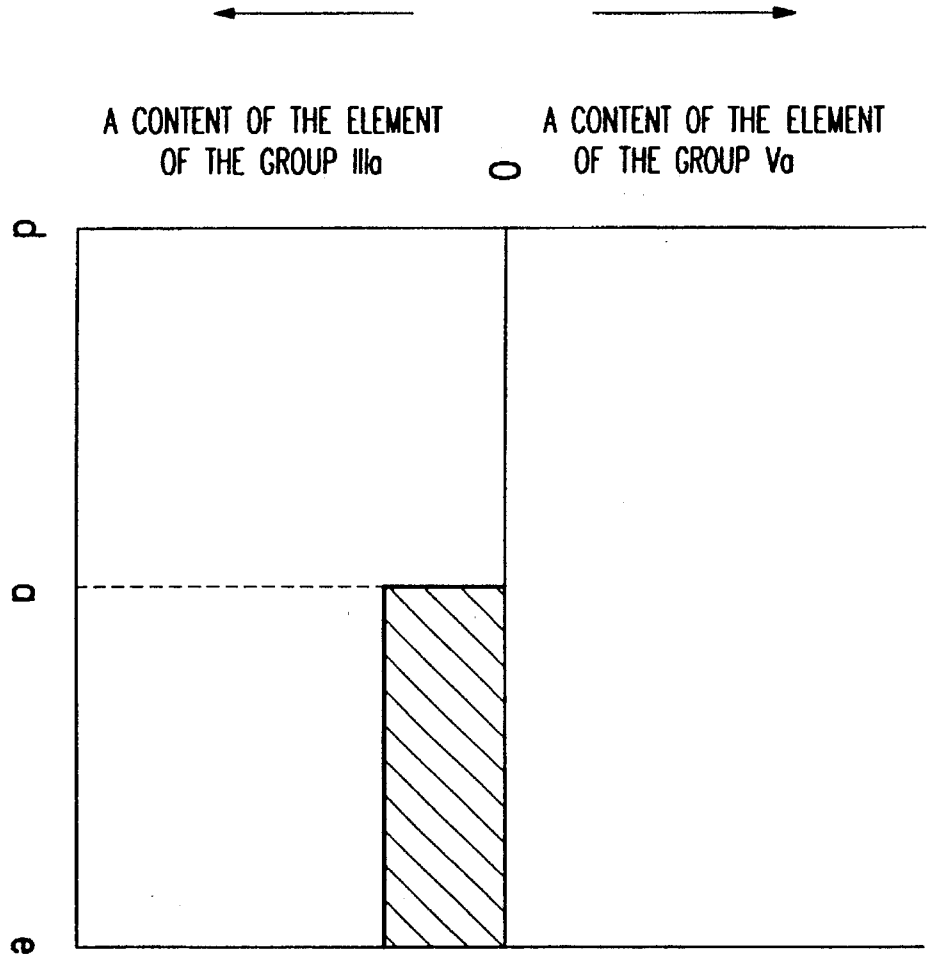
Figure 14:
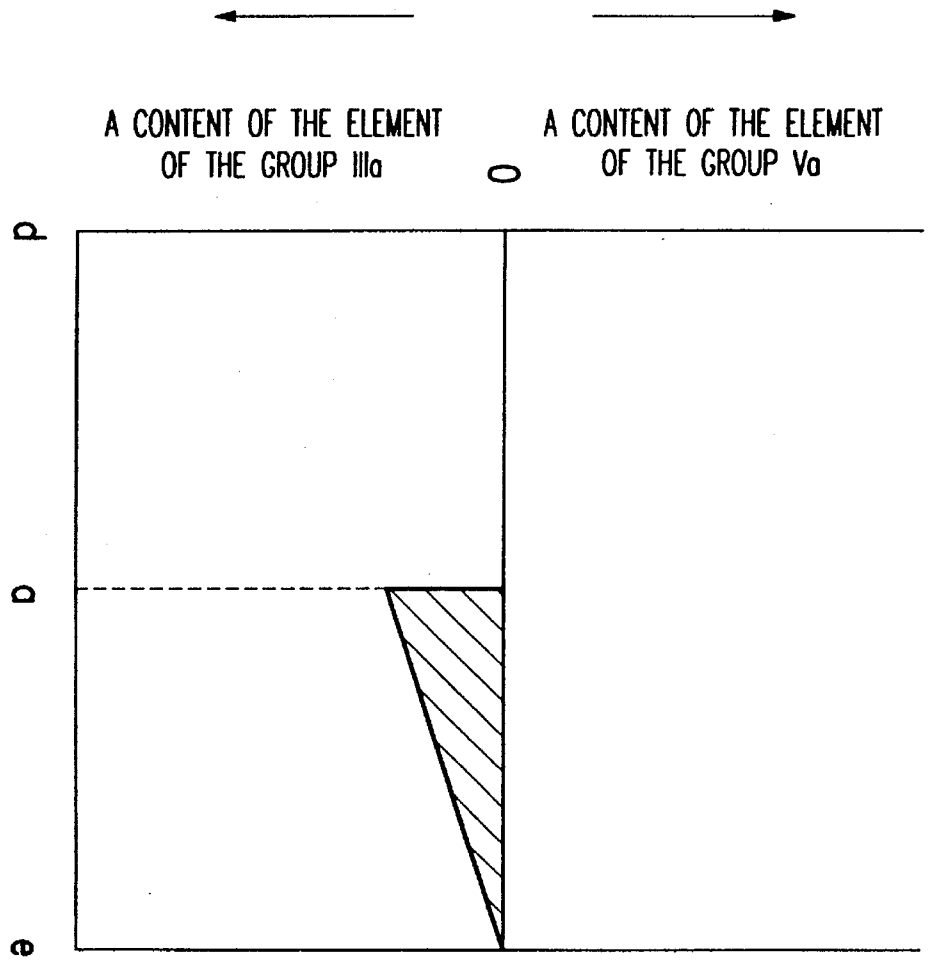
Figure 15:
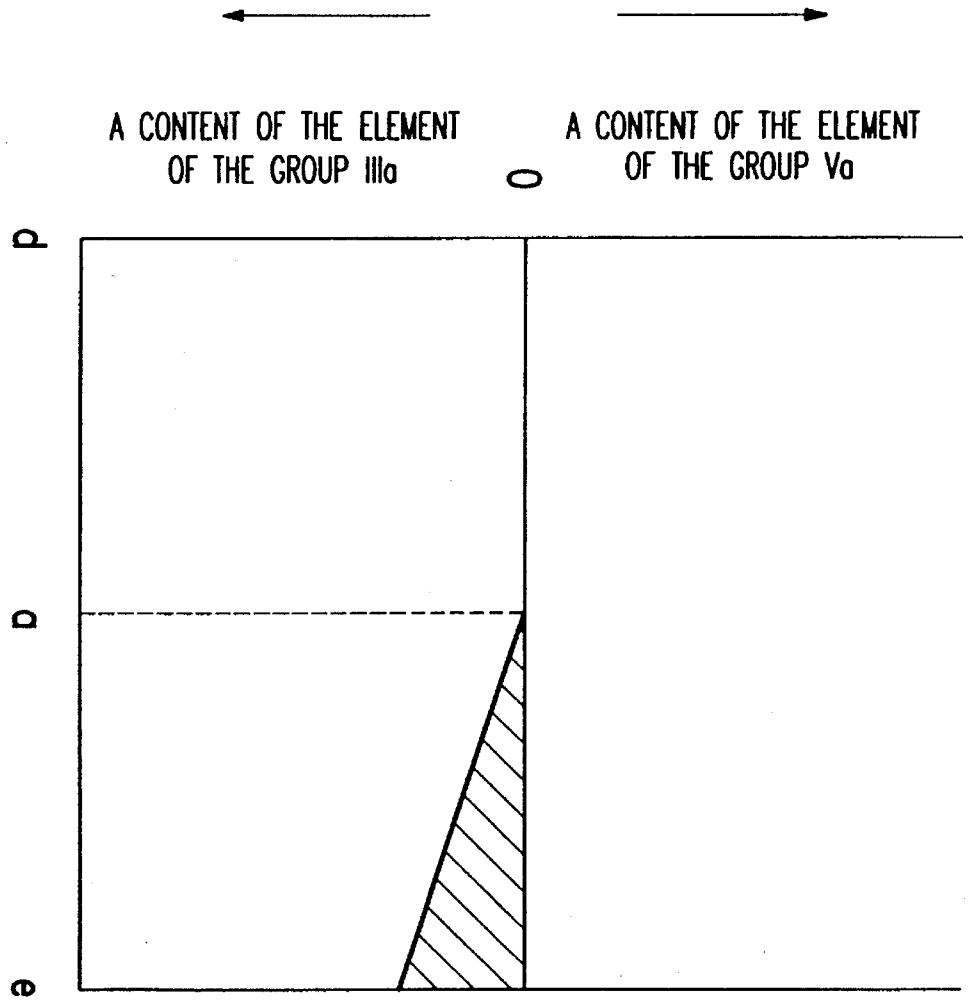
Figure 16:
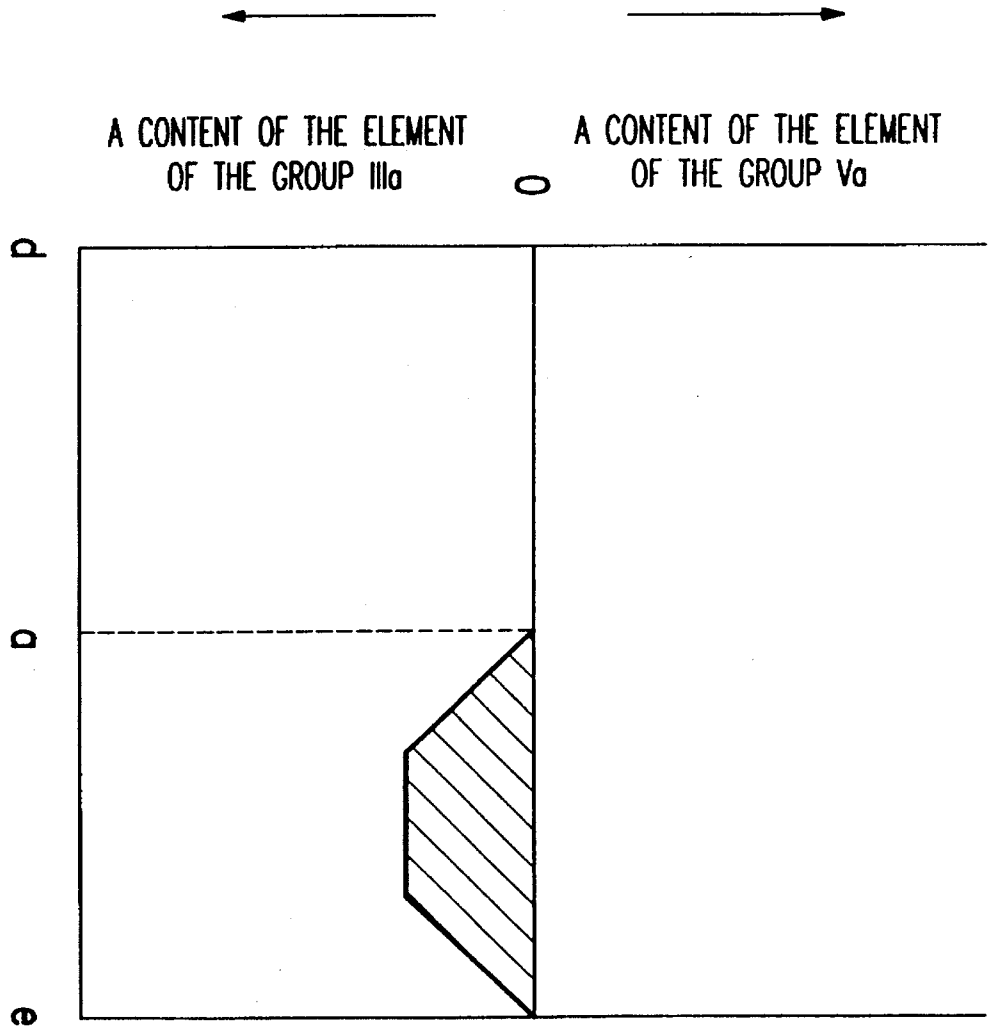
Figure 17:
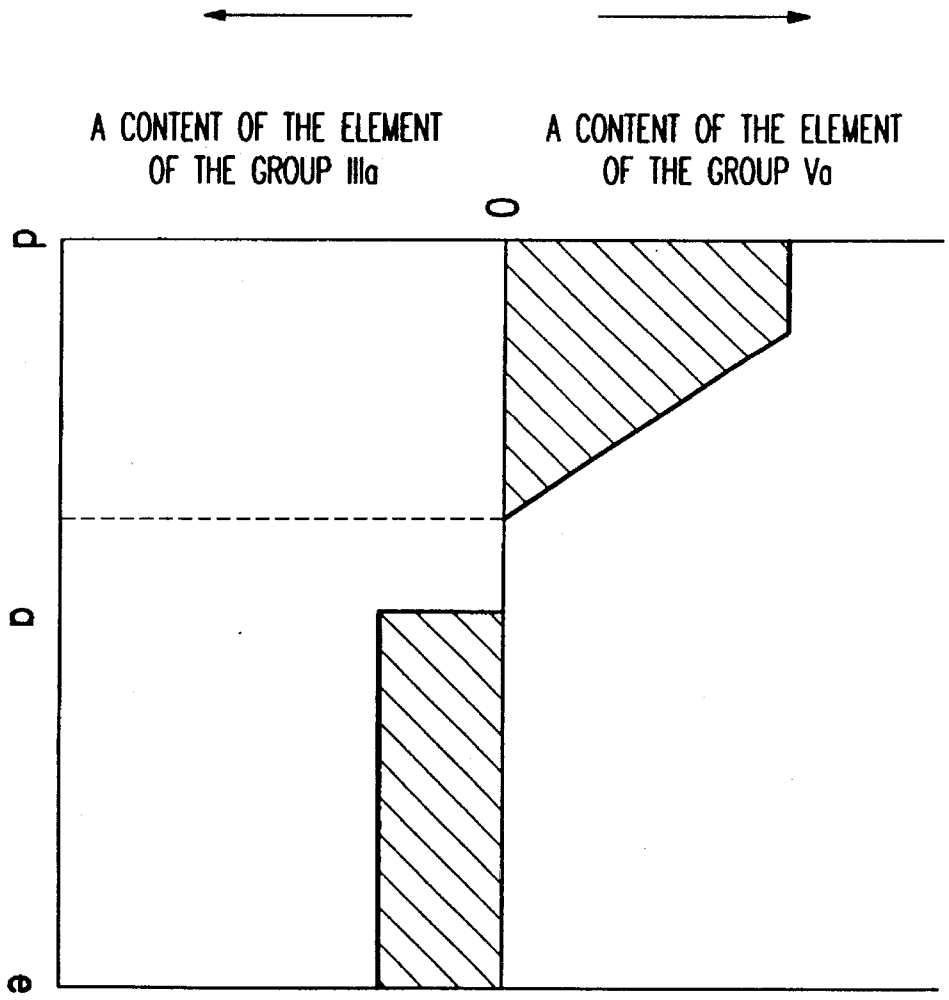
Figure 18:
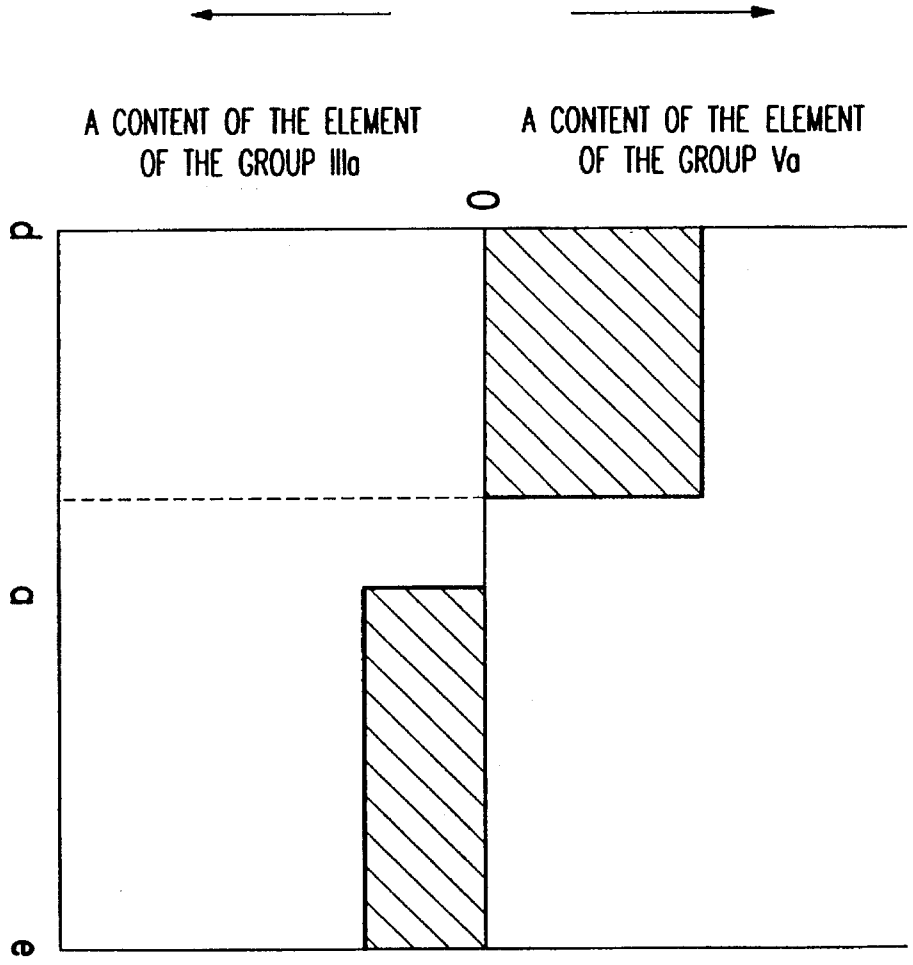
Figure 19:
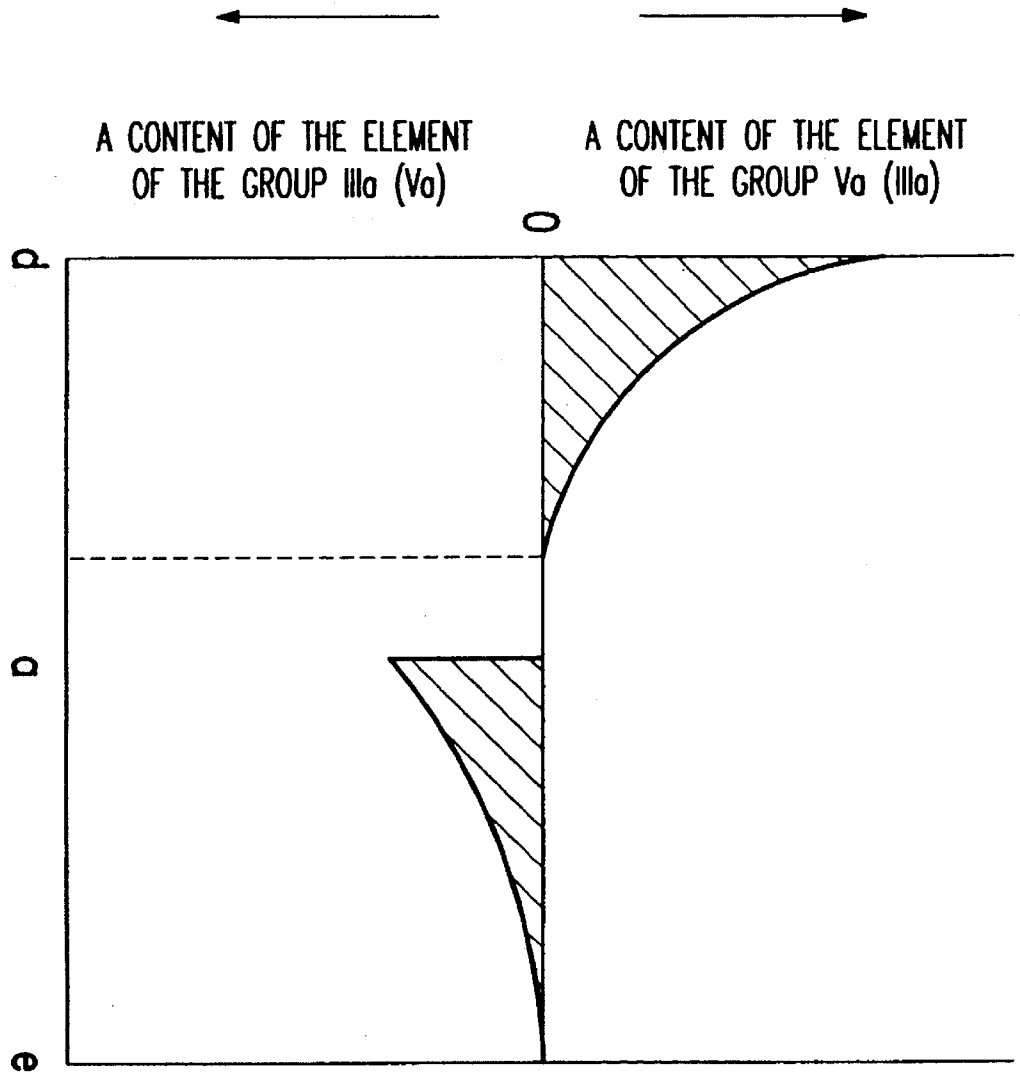
Figure 20:
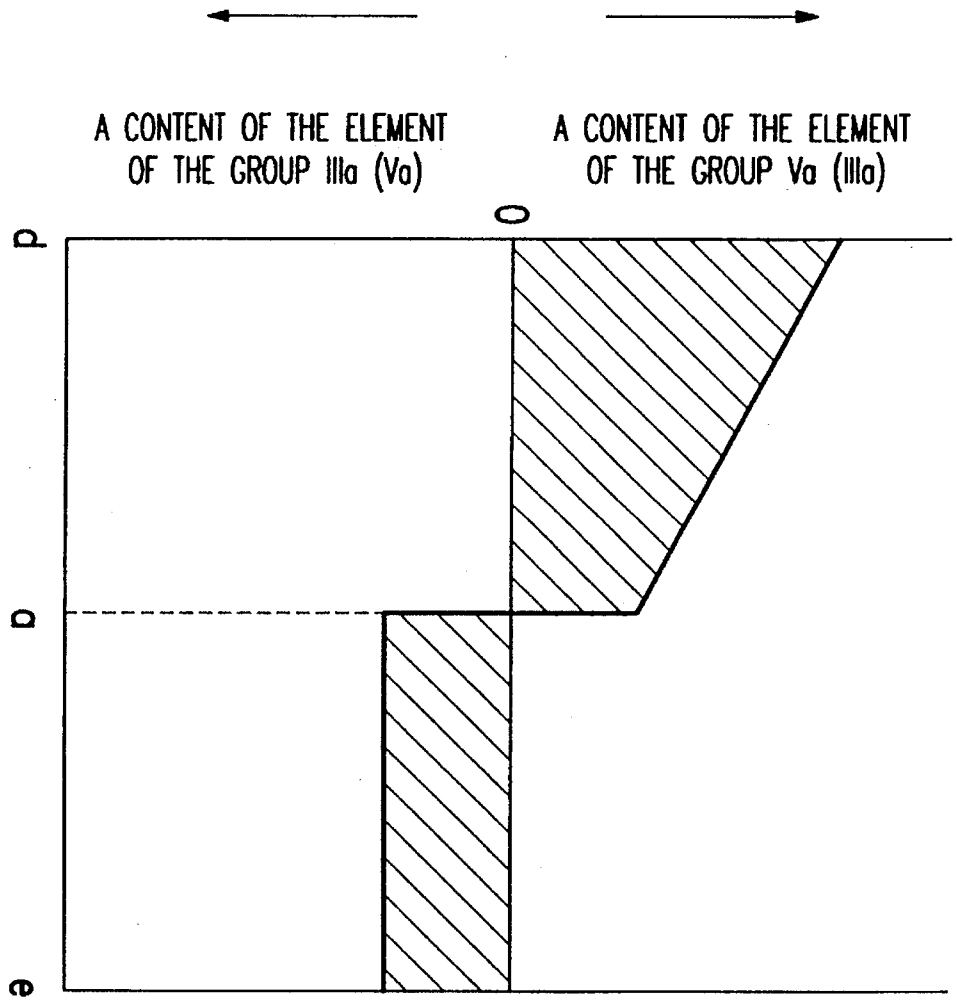
Figure 21:
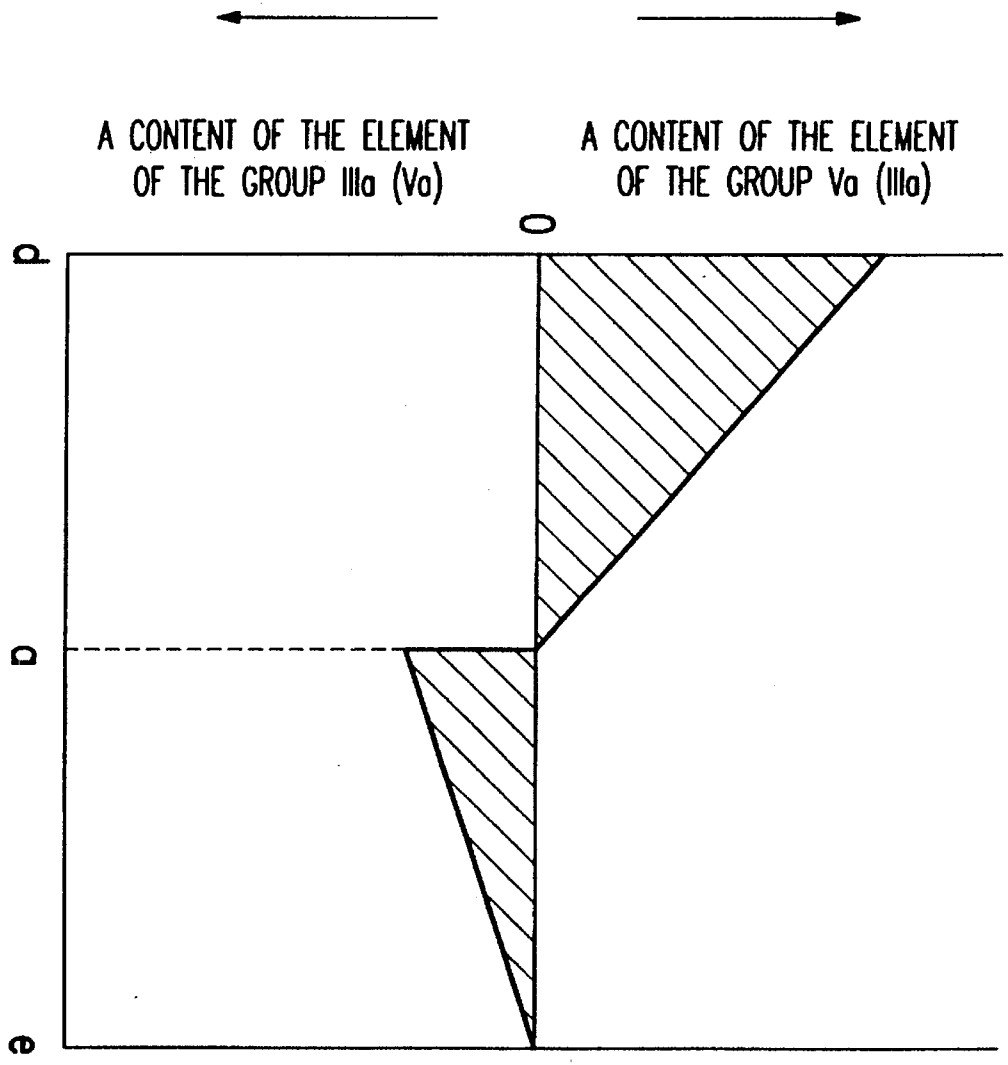
Figure 22:
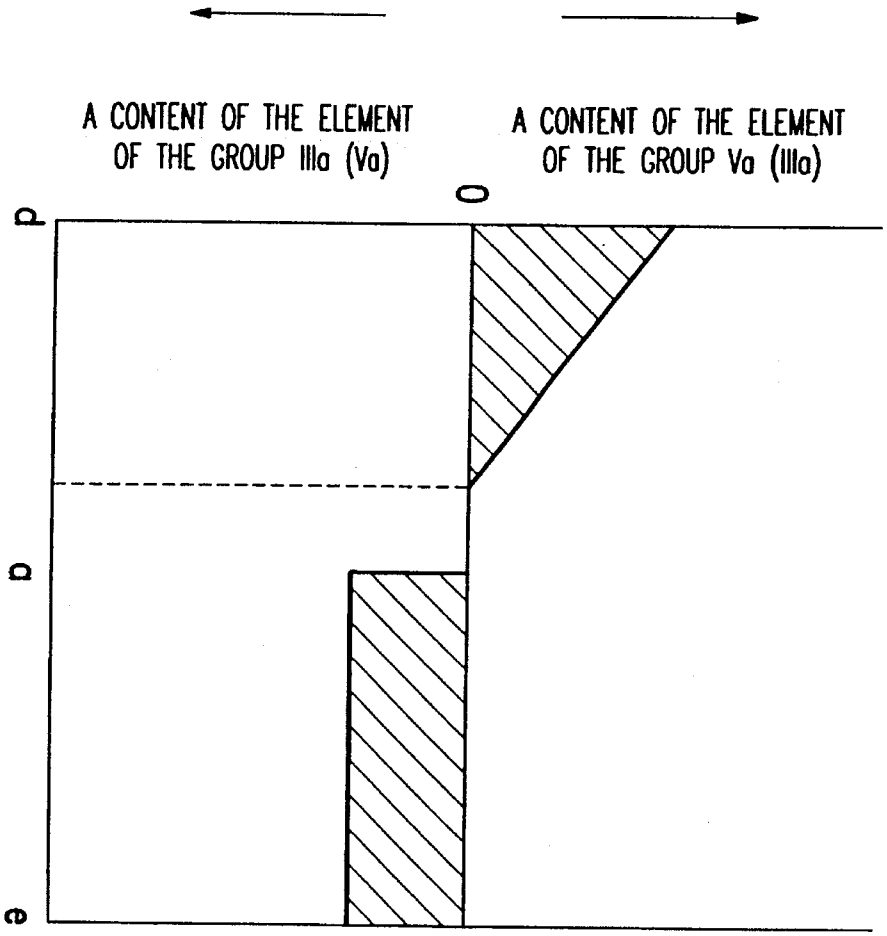
Figure 23:
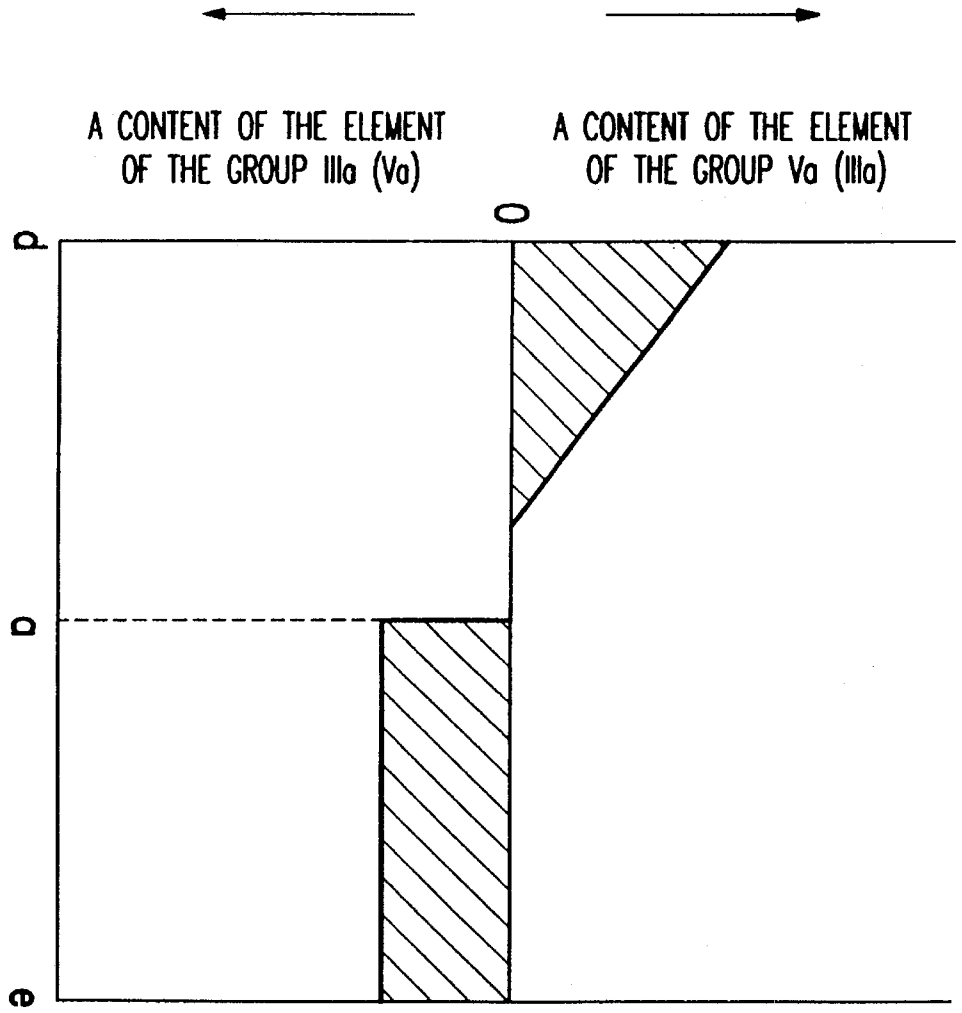
Figure 24:
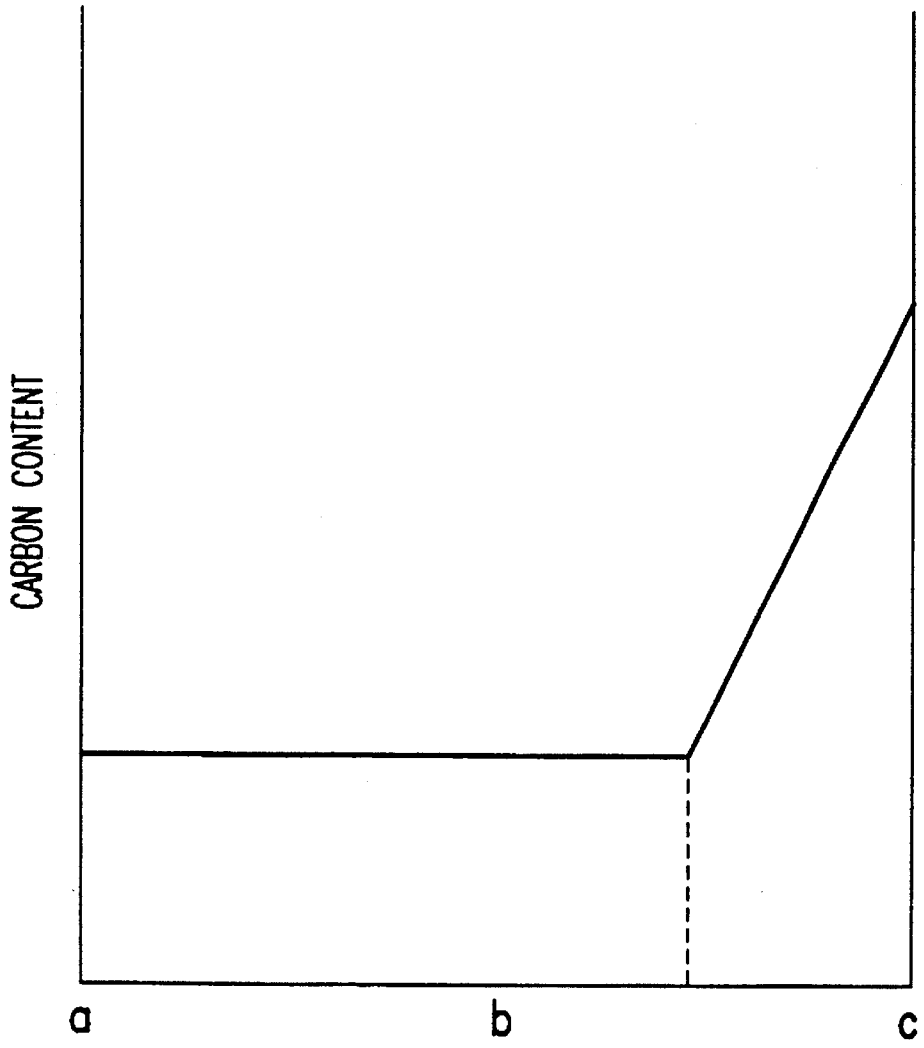
FIGS. 24 to 29 are graphs showing a carbon content in a direction of layer thickness of an a-SiC photoconductive layer.
Figure 25:
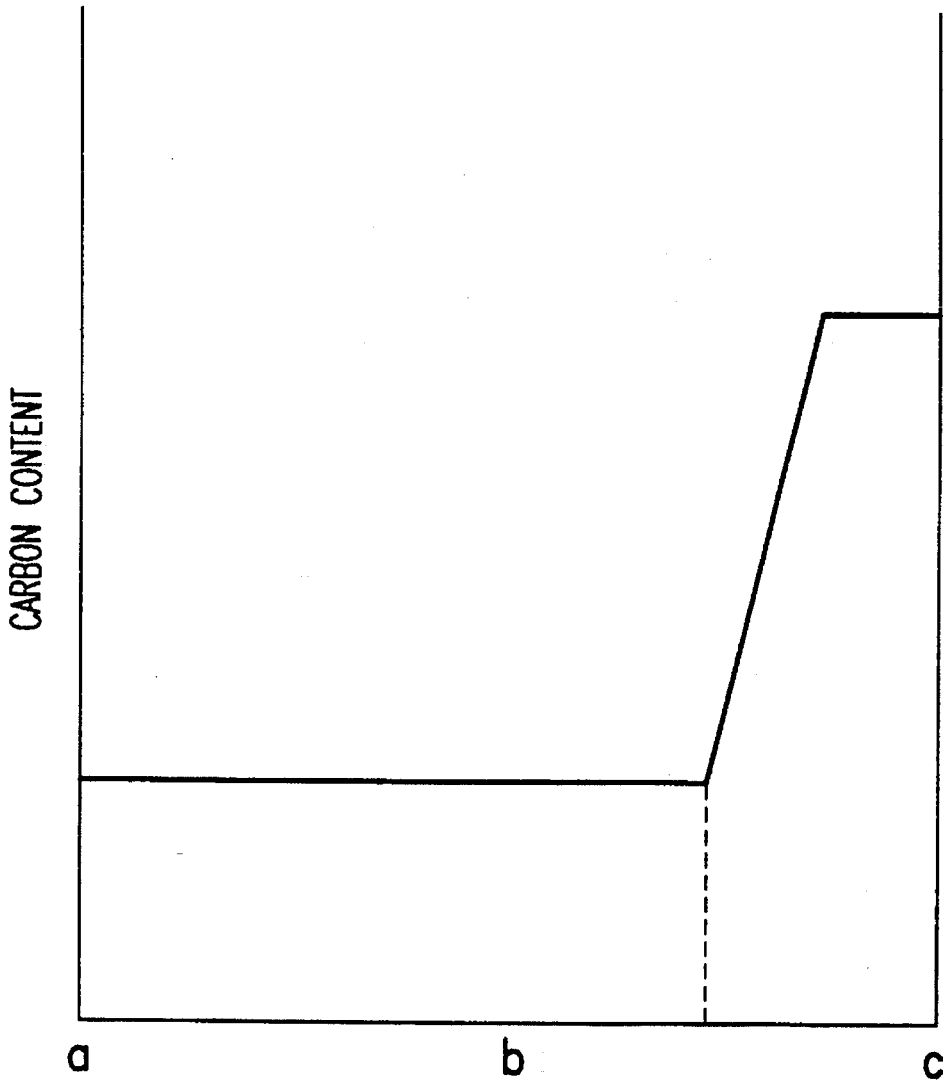
Figure 26:
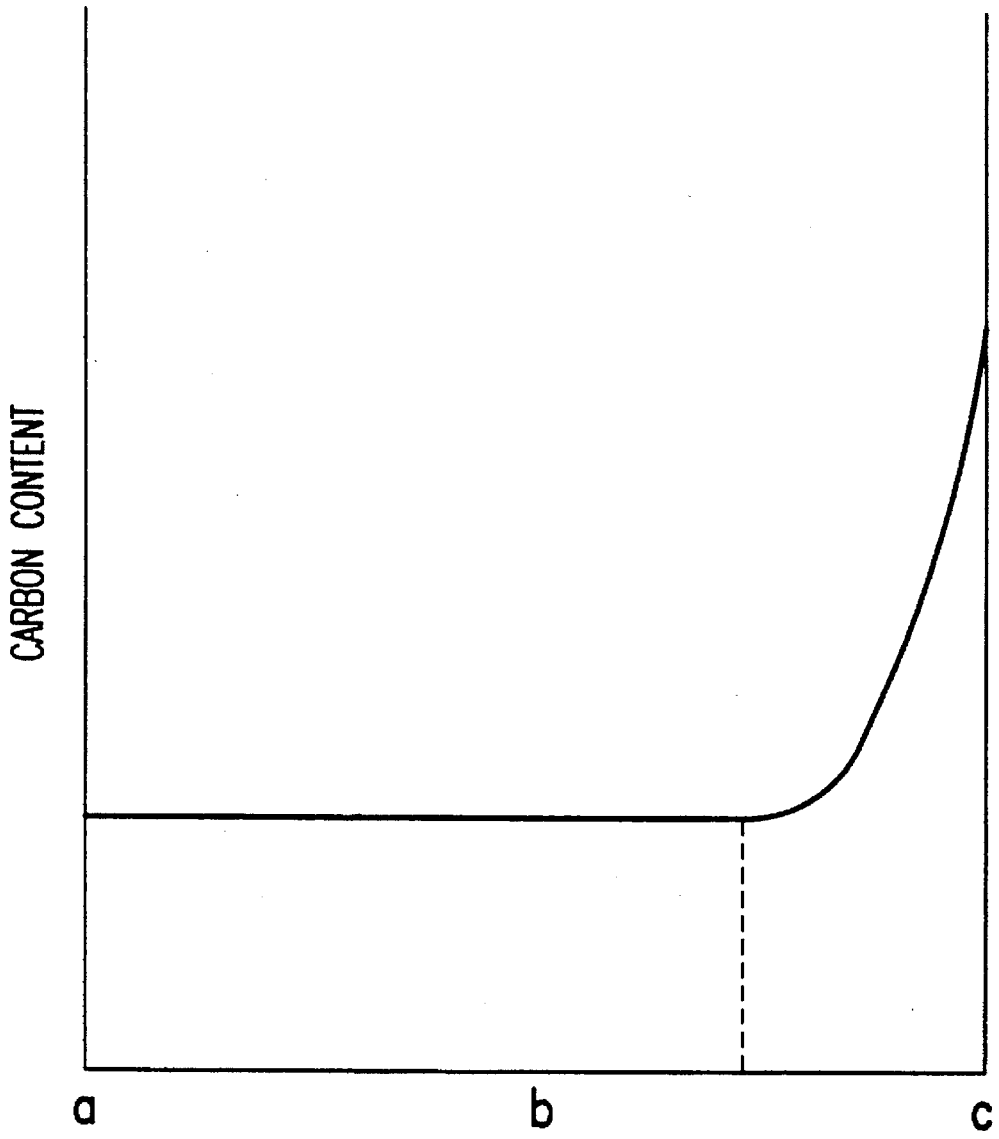
Figure 27:
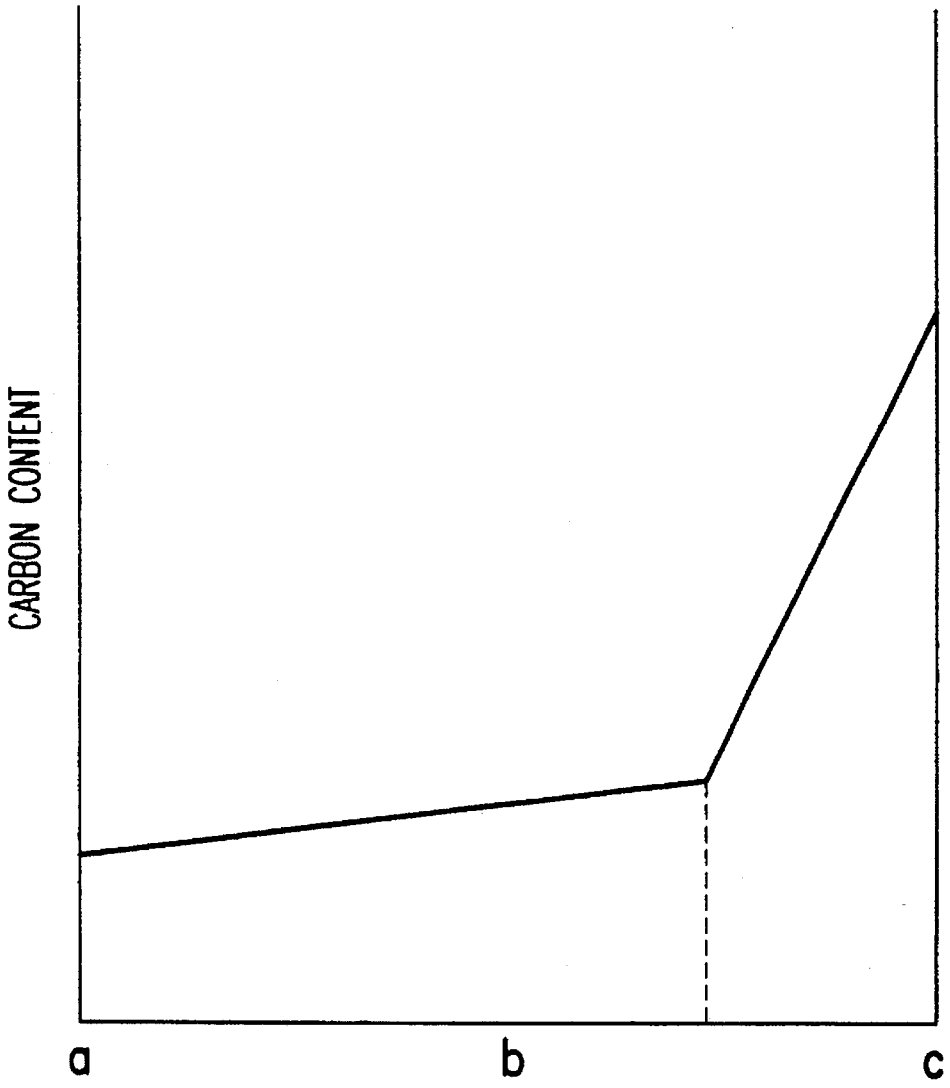
Figure 28:
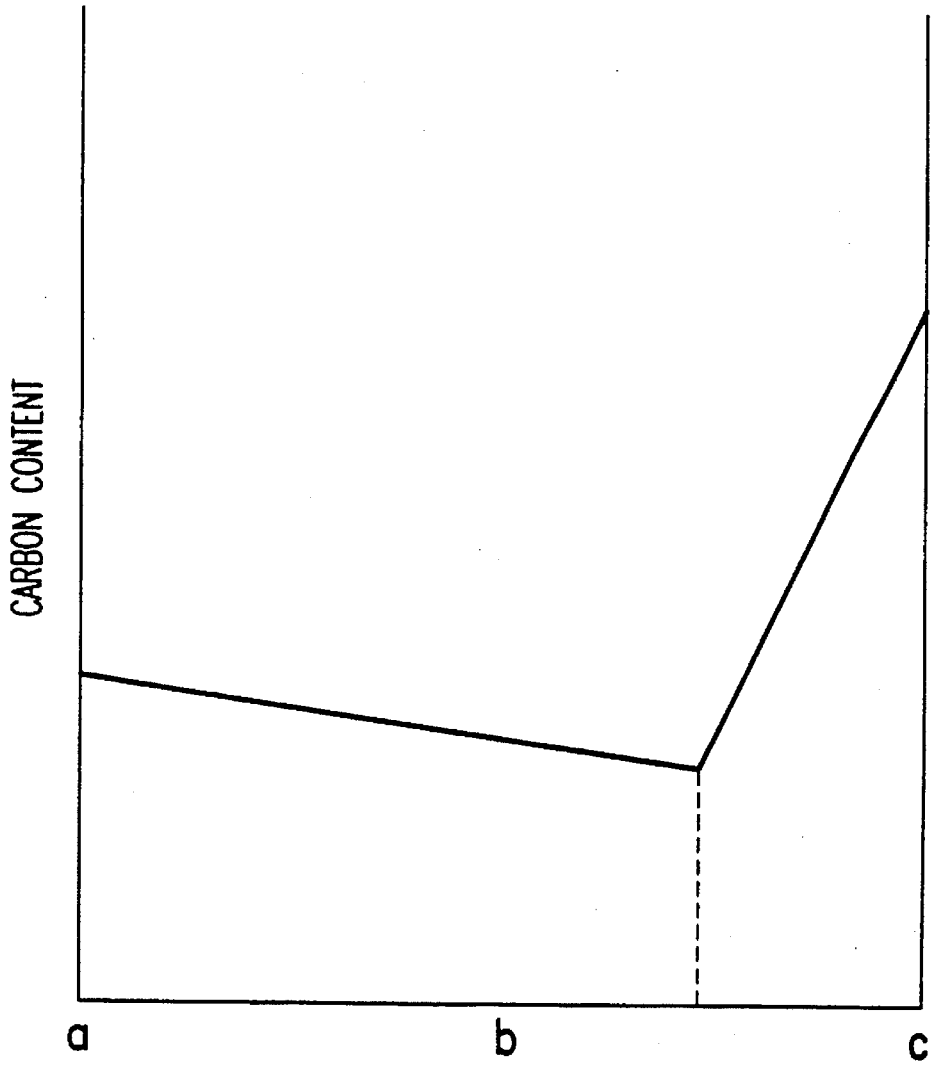
Figure 29:
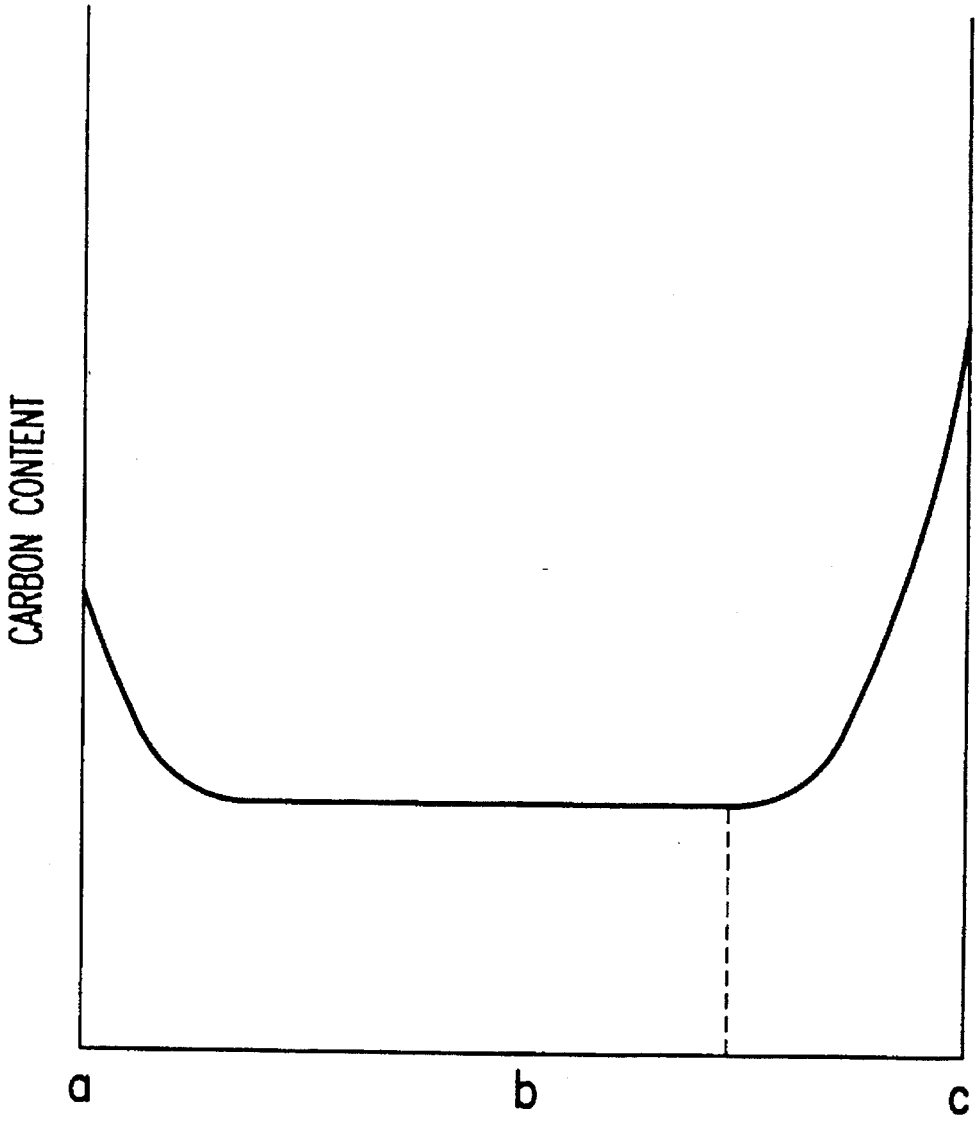

Thus, various kinds of a-SiC film, of which C-content x was set at 0.2 and B element-content was varied, were formed and their photoconductivity and dark conductivity were measured with the results as shown in FIG. 6.

In the present EXAMPLE the $PH_3$ gas was used in place of the above described $B_2H_6$ gas to form various kinds of a-SiC film, of which P element-content was varied, also and their photoconductivity and dark conductivity were measured.

Referring to FIG. 6, an axis of abscissa designates the B element-content (or the P element-content), an axis of ordinate designating the conductivity, ○ marks designating a plot of the photoconductivities for the exposure wavelength of 550 nm (luminous quantity: 50 microW/cm$^2$), ● marks designating a plot of the dark conductivities, and g, h designating characteristic curves thereof.

It is clear from FIG. 6 that if the B element is contained at 1 to 1,000 ppm, the ratio of the photoconductivity to the dark conductivity is remarkably increased, and, if the B element is contained in a quantity exceeding 1,000 ppm, the dark conductivity is increased.

In addition, as for the P element, the photoconductivity and dark conductivity were still more remarkably increased.

In addition, the C-content x and the H-content y of every a-SiC film according to the present EXAMPLE is 0.30 and 0.35, respectively.

Thus, it could be confirmed that the valence electron of the above described a-SiC films was controlled by the B element and the P element, whereby the superior film quality for semiconductor was obtained.

EXAMPLE 4

In the present EXAMPLE various kinds of a-SiC photoconductive layer (Sample Nos. A-1 to A-8) were formed under the comparatively reduced film-forming speed condition shown in Table 1. And, their C-content, that is, the value of x, was measured with the results as shown in Table 1.

The sample Nos. marked with * are outside of the scope of the present invention.

TABLE 1

| Sample No | Raw material gas $SiH_4$ sccm | Raw material gas $C_2H_2$ sccm | Diluent gas $H_2$ sccm | Pressure Torr | Electric power W | Time minute | Temperature °C. | Film-thickness μm | Carbon-content X |
|---|---|---|---|---|---|---|---|---|---|
| A-1 | 20 | 1 | 700 | 1.2 | 100 | 30 | 250 | 1.0 | 0.1 |
| A-2 | 20 | 2 | 700 | 1.2 | 100 | 30 | 250 | 1.0 | 0.2 |
| A-3 | 20 | 4 | 700 | 1.2 | 100 | 30 | 250 | 1.0 | 0.3 |
| A-4 | 20 | 8 | 700 | 1.2 | 100 | 30 | 250 | 1.0 | 0.4 |
| A-5* | 20 | 12 | 700 | 1.2 | 100 | 30 | 250 | 1.0 | 0.55 |
| A-6* | 20 | 16 | 700 | 1.2 | 100 | 30 | 250 | 1.0 | 0.6 |
| A-7* | 20 | 20 | 700 | 1.2 | 100 | 30 | 250 | 1.0 | 0.65 |
| A-8* | 20 | 25 | 700 | 1.2 | 100 | 30 | 250 | 1.0 | 0.7 |

Figure 30:
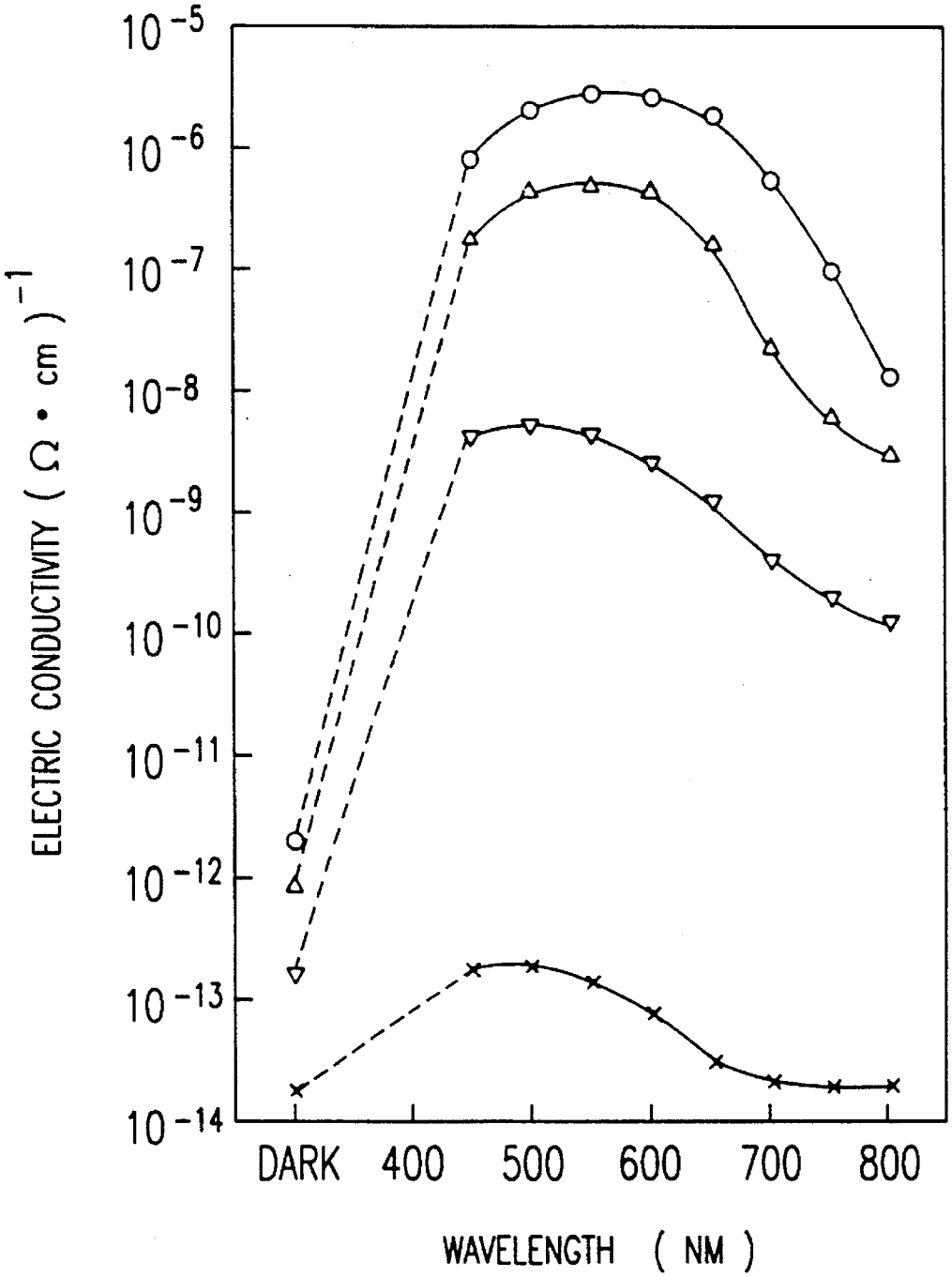
FIGS. 30 to 32 and FIGS. 35 to 37 are graphs showing a relation between a wavelength and an electric conductivity.

The spectral sensitivity characteristics of the sample Nos. A-1, A-2, A-3 and A-7 shown in Table 1 were measured with the results as shown in FIG. 30. These measurements were carried out under the condition that the luminous quantity was 50 microW/cm$^2$ for each wavelength. In addition, the H-content (the value of y) was measured for the respective samples with the results that the H-content of the samples A-1, A-2, A-3 and A-7 was within a range of 0.2 to 0.4.

Referring to FIG. 30, an axis of abscissa designates a wavelength, an axis of ordinate designating the conductivity, and ○ marks, Δ marks, ∇ marks and x marks designating a plot of the measured values for the sample No. A-1, A-2, A-3 and A-7, respectively.

It is clear from FIG. 30 that the sample Nos. A-1, A-2 and A-3 according to the present invention have a high photoconductivity, in particular the sample No. A-1 has the highest photoconductivity.

EXAMPLE 5

In the present EXAMPLE various kinds of a-SiC photoconductive layer (Sample Nos. B-1 to B-5) were formed under the comparatively higher film-forming speed condition. And, the C-content, that is, the value of x, in each a-SiC photoconductive layer was measured with the results as shown in Table 2.

The sample Nos. marked with * are outside of the scope of the present invention.

TABLE 2

| Sample No | Raw material gas $SiH_4$ sccm | Raw material gas $C_2H_2$ sccm | Diluent gas $H_2$ sccm | Pressure Torr | Electric power W | Time minute | Temperature °C. | Film-thickness μm | Carbon-content X |
|---|---|---|---|---|---|---|---|---|---|
| B-1 | 200 | 10 | 300 | 1.2 | 100 | 6 | 250 | 1.0 | 0.15 |
| B-2 | 200 | 20 | 300 | 1.2 | 100 | 6 | 250 | 1.0 | 0.25 |
| B-3 | 200 | 40 | 300 | 1.2 | 100 | 6 | 250 | 1.0 | 0.35 |
| B-4* | 200 | 80 | 300 | 1.2 | 100 | 6 | 250 | 1.0 | 0.55 |
| B-5* | 200 | 120 | 300 | 1.2 | 100 | 6 | 250 | 1.0 | 0.65 |

Figure 31:
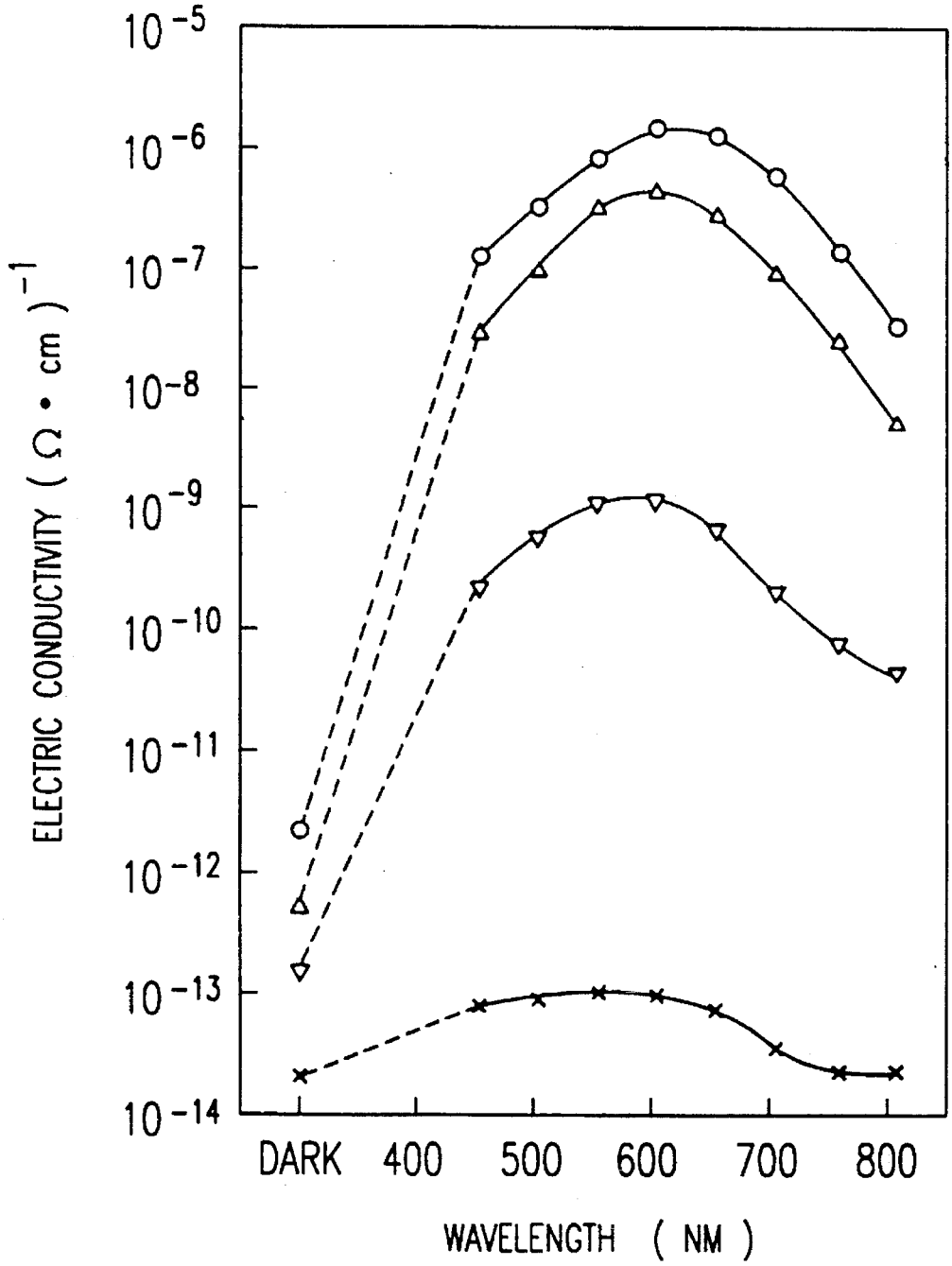

As for the sample Nos. B-1, B-2, B-3 and B-5 shown in Table 2, the spectral sensitivity characteristics were measured with the results as shown in FIG. 31. In addition, the H-content (the value of y) of the respective samples was measured with the results that the H-content of the sample Nos. B-1, B-2, B-3 and B-5 is within a range of 0.2 to 0.4.

Referring to FIG. 31, an axis of abscissa designates a wavelength, an axis of ordinate designating the conductivity, and ○ marks, Δ marks, ∇ marks and x marks designating a plot of measured values for the sample No. B-1, B-2, B-3 and B-5, respectively.

It is clear from FIG. 31 that the sample Nos. B-1, B-2 and B-3 according to the present invention have the high photoconductivity, in particular the sample No. B-1 has the highest photoconductivity.

EXAMPLE 6

Next, the present inventors produced various kinds of a-SiC photoconductive layer (Sample Nos. C-1 to C-5) by the use of the $CH_4$ gas in place of the $C_2H_2$ gas under the film-forming conditions shown in Table 3. And, the C-content (the value of x) and the H-content (the value of y) of the respective samples were measured with the results as shown in Table 3.

TABLE 3

| Sample No | Raw material gas $SiH_4$ sccm | Raw material gas $C_2H_2$ sccm | Diluent gas $H_2$ sccm | Pressure Torr | Electric power W | Time minute | Temperature °C. | Film-thickness μm | Carbon-content x | Hydrogen-content y |
|---|---|---|---|---|---|---|---|---|---|---|
| C-1 | 10 | 10 | 300 | 1.2 | 100 | 60 | 250 | 1.0 | 0.05 | 0.15 |
| C-2 | 10 | 20 | 300 | 1.2 | 100 | 60 | 250 | 1.0 | 0.1 | 0.13 |
| C-3 | 10 | 40 | 300 | 1.2 | 100 | 60 | 250 | 1.0 | 0.15 | 0.12 |
| C-4 | 10 | 80 | 300 | 1.2 | 100 | 60 | 250 | 1.0 | 0.3 | 0.10 |
| C-5 | 10 | 120 | 300 | 1.2 | 100 | 60 | 250 | 1.0 | 0.5 | 0.10 |

The spectral sensitivity characteristics of the sample Nos. C-1, C-2 and C-3 shown in Table 3 were measured with the results as shown in FIG. 32.

Figure 32:
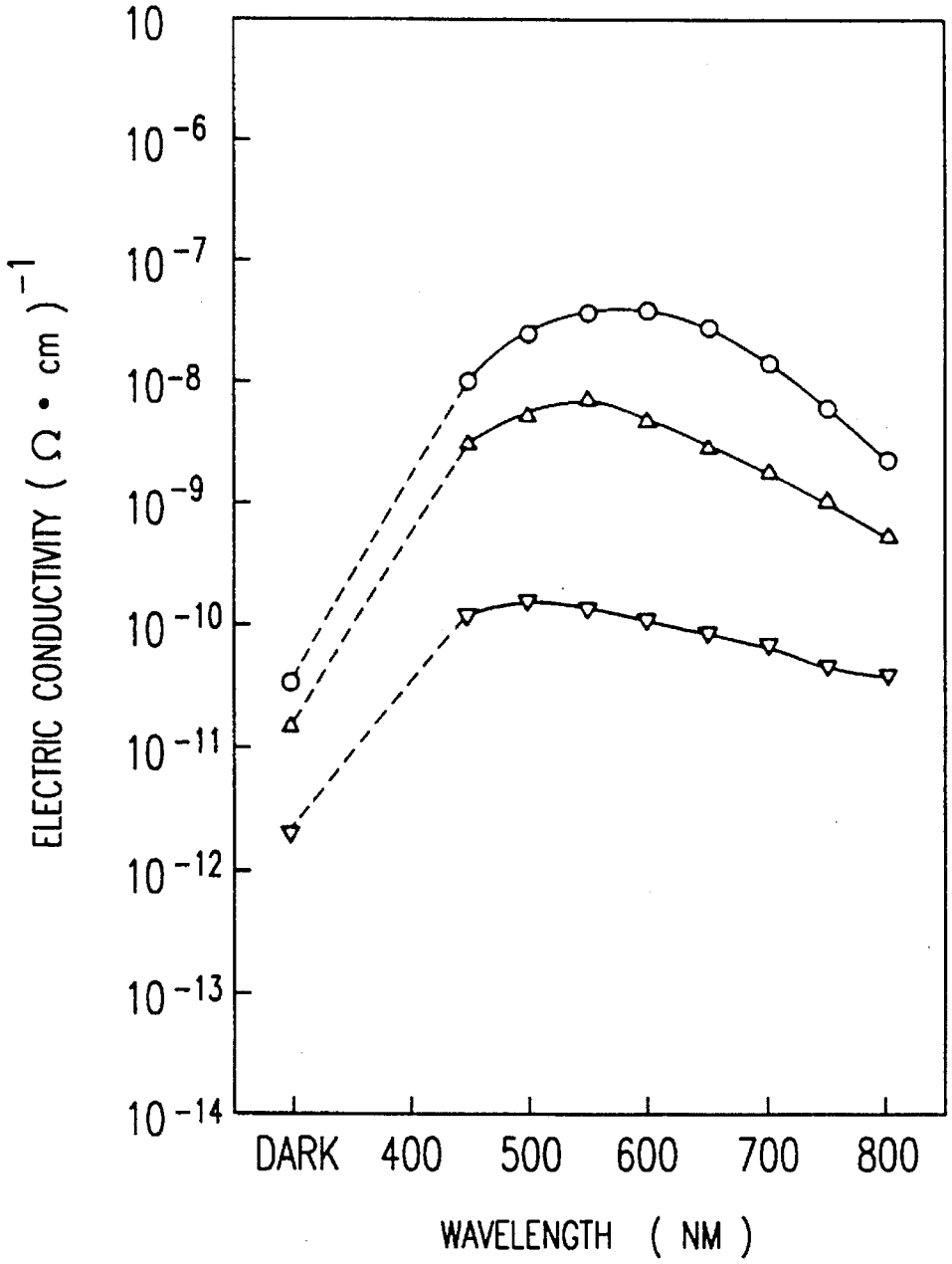

Referring to FIG. 32, an axis of abscissa designates a wavelength, an axis of ordinate designating the photoconductivity, and ○ marks, Δ marks and ∇ marks designating a plot of measured values for the sample Nos. C-1, C-2 and C-3.

It is clear from FIG. 32 that the a-SiC film having the value of y less than 0.2 has not the sufficient photoconductive characteristics even though the value of x is within the preferable range.

Preferred Embodiment of the First Invention

EXAMPLE 7

Next, the present inventors formed two kinds of a-SiC photoconductive layer on an electrically conductive aluminum substrate in a manner shown in Table 4 and piled up the organic photosemiconductive layer (having a thickness of 15 microns) on said respective layers by the coating method in the following manner.

Method of Coating the Organic Photosemiconductive Layer 2, 4, 7-trinitrofluorenon (hereinafter called TNF for short) was dissolved in 1,4-dioxane as a solvent and additionally a polyester resin [LEXAN-LS2-11] was added followed by being subjected to the ultrasonic dispersion for 40 minutes. And, the resulting dispersion was coated on both a-SiC photoconductive layers by means of a bar coater and then dried at 80° C. by a hot wind.

Thus, two kinds of positive charge type electrophotographic sensitive member according to the present invention (the sensitive members A, B) were produced.

TABLE 4

| Sensitive member | Raw material gas $SiH_4$ sccm | Raw material gas $C_2H_2$ sccm | Diluent gas $H_2$ sccm | Pressure Torr | Electric power W | Time minute | Temperature °C. | Film-thickness μm |
|---|---|---|---|---|---|---|---|---|
| A | 20 | 1 | 700 | 1.2 | 100 | 30 | 250 | 1.0 |
| B | 200 | 10 | 300 | 0.8 | 100 | 8 | 250 | 1.0 |

Figure 33:
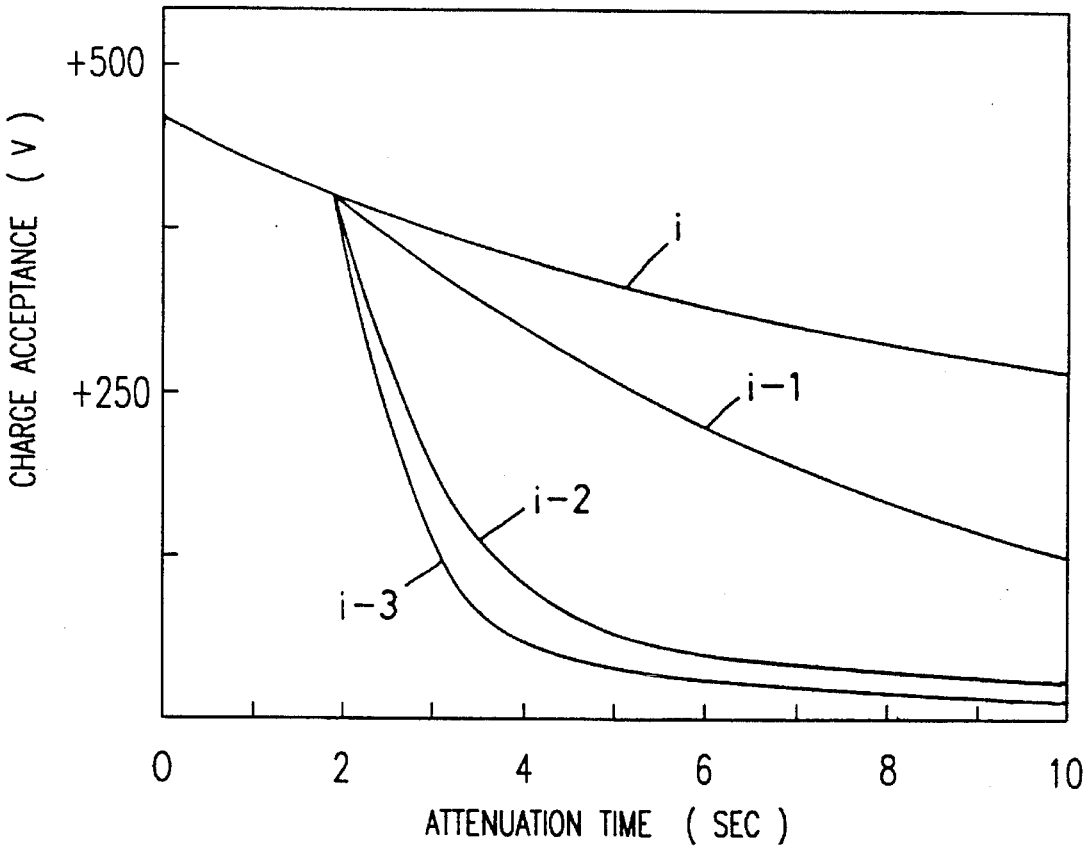
FIGS. 33, 38, 43, 47, 51, 55 and 59 are graphs showing a relation between an attenuation time and a charge acceptance.
Figure 34:
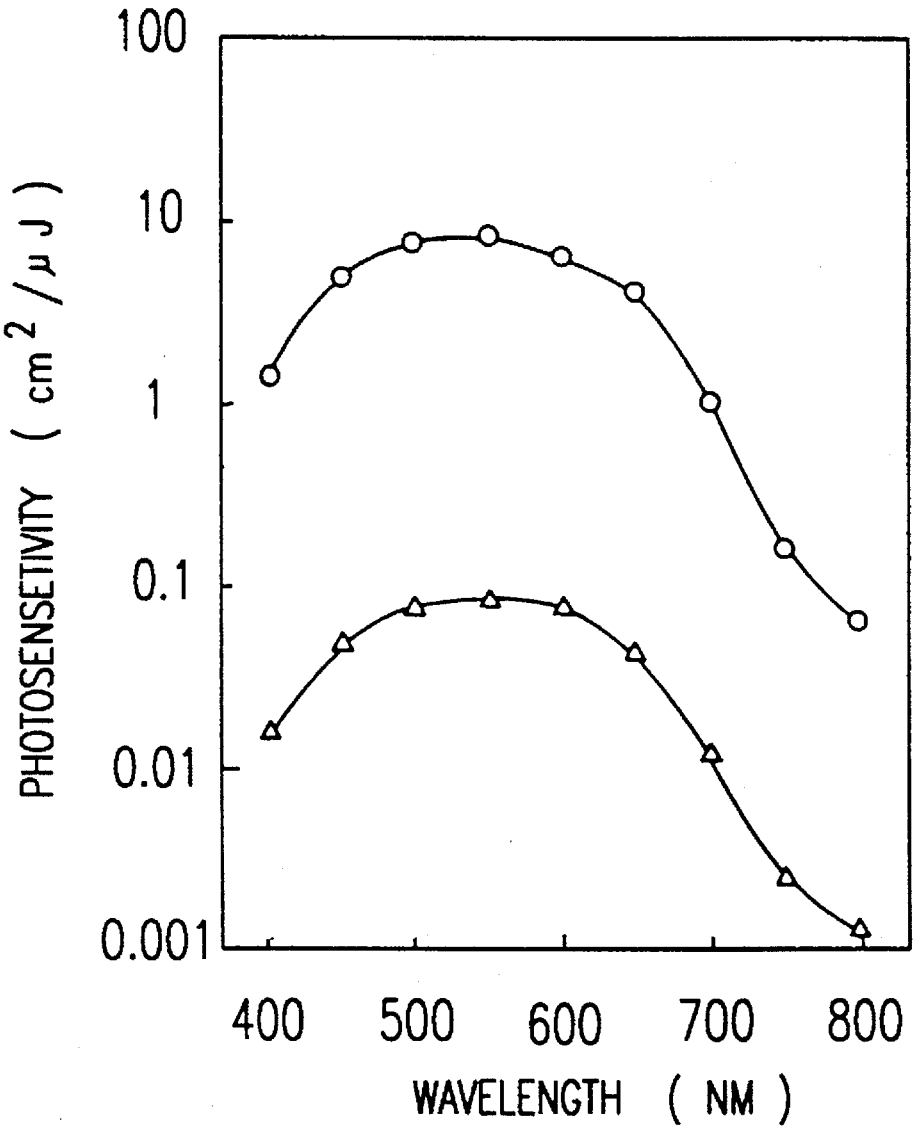
FIGS. 34, 39, 44, 48, 52, 56 and 60 are graphs showing a relation between a wavelength and a photosensitivity.

The dark- and photoattenuation characteristics of the sensitive member A were measured with the results as shown in FIG. 33. In addition, the spectral sensitivity characteristics of the sensitive member A were measured with the results as shown in FIG. 34.

Referring to FIG. 33, an axis of abscissa designates an attenuation time (sec), an axis of ordinate designating the charge acceptance (volt), i designating a dark attenuation curve, and i-1, i-2 and i-3 designating a photoattenuation curve at the exposure wavelength of 400 nm, 450 nm and 550 nm, respectively.

As to the measuring conditions, the electrification was carried out by the use of the corona charger with a voltage of +6 kV applied and the exposure was carried out with setting the luminous quantity for the respective wavelengths at 0.15 microw/cm$^2$. And, the change of charge acceptance was measured by the use of the surface potentiometer provided with a phototransmission type measuring probe.

In addition, the measurements of the positive charge sensitive member, which will be mentioned later, were carried out in the same manner as the above described. The measurements of the negative charge sensitive member were carried out with applying a voltage of −6 kV.

It is clear from FIG. 33 that the electrophotographic sensitive members have the sufficient charge characteristics and dark attenuation characteristics and the superior photoattenuation characteristics.

In addition, referring to FIG. 34, an axis of abscissa designates a wavelength, an axis of ordinate designating the photosensitivity, and ○ marks designating a plot of measured values for the sensitive member A. In addition, for comparison, the organic photosemiconductive layer was formed on the sample No. C-1 as the a-SiC photoconductive layer by the same method as in the present EXAMPLE to produce the electrophotographic sensitive member. A plot of measured values for this sensitive member is shown by Δ marks.

It is clear from FIG. 34 that the sensitive member A is remarkably superior in photosensitivity.

In addition, the present inventors measured the dark- and photoattenuation characteristics of also the sensitive member B with the superior characteristics similarly to the sensitive member A.

Preferred Embodiment of the Fourth Invention

EXAMPLE 8

In the present EXAMPLE various kinds of a-SiC photoconductive layer (Sample Nos. D-1 to D-5) were formed under the lower film-forming speed conditions shown in Table 5. And, the C-content, that is, the value of x,0and the B element-content of said respective a-SiC photoconductive layer were measured with the results as shown in Table 5.

The sample Nos. marked with * are outside of the scope of the present invention.

Flow rate marked with ** is a flow rate of the $B_2H_6$ gas diluted with the $H_2$ gas at a concentration of 400 ppm.

TABLE 5

| Sample No | Raw material gas $SiH_4$ sccm | Raw material gas $C_2H_2$ sccm | Diluent gas $H_2$ sccm | Impurity gas $B_2H_6$ ※ sccm | Pressure Torr | Electric power W | Time minute | Temperature °C. | Film-thickness μm | Carbon-content x | β-element-content ppm |
|---|---|---|---|---|---|---|---|---|---|---|---|
| D-1 | 20 | 1 | 700 | 0.2 | 1.2 | 100 | 30 | 250 | 1.0 | 0.1 | ※2 |
| D-2 | 20 | 1 | 700 | 2 | 1.2 | 100 | 30 | 250 | 1.0 | 0.1 | 20 |
| D-3 | 20 | 1 | 700 | 20 | 1.2 | 100 | 30 | 250 | 1.0 | 0.1 | 200 |
| D-4 | 20 | 1 | 700 | 40 | 1.2 | 100 | 30 | 250 | 1.0 | 0.1 | 500 |
| D-5※ | 20 | 1 | 700 | 100 | 1.2 | 100 | 30 | 250 | 1.0 | 0.1 | 1500 |

Figure 35:
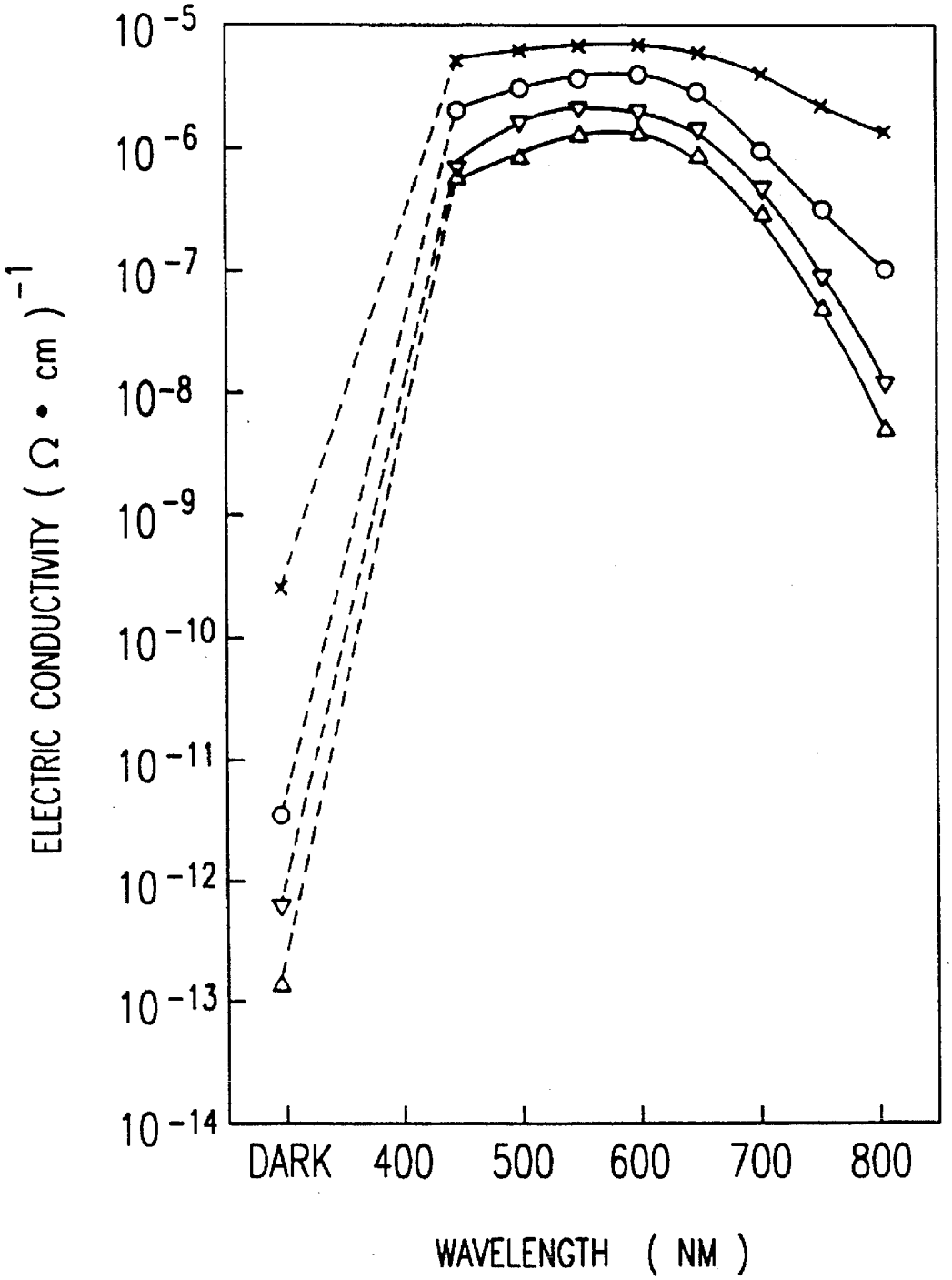

The spectral characteristics of the sample Nos. D-1, D-2, D-4 and D-5 shown in Table 5 were measured with the results as shown in FIG. 35. In addition, the H-content (the value of y) of the respective samples was measured with the results that it was within a range of 0.2 to 0.4 in every case.

Referring to FIG. 35, an axis of abscissa designates a wavelength, an axis of ordinate designating the conductivity, and ○ marks, Δ marks, ▽ marks and x marks designating a plot of measured values for the sample No. D-1, D-2, D-4 and D-5, respectively.

It is clear from FIG. 35 that the Sample Nos. D-1, D-2 and D-4 according to the present invention have the enhanced photoconductivity.

EXAMPLE 9

In the present EXAMPLE various kinds of a-SiC photoconductive layer (Sample Nos. E-1 to E-5) were formed under the higher film-forming speed conditions shown in Table 6. And, the C-content (the value of x) and the B element-content of the respective a-SiC photoconductive layers were measured with the results as shown in Table 6.

The sample Nos. marked with * are outside of the scope of the present invention.

Flow rate marked with ** is a flow rate of the $B_2H_6$ gas diluted with the $H_2$ gas at a concentration of 0.4%.

TABLE 6

| Sample No | Raw material gas $SiH_4$ sccm | Raw material gas $C_2H_2$ sccm | Diluent gas $H_2$ sccm | Impurity gas $B_2H_6$ ※ sccm | Pressure Torr | Electric power W | Time minute | Temperature °C. | Film-thickness μm | Carbon-content x | β-element-content ppm |
|---|---|---|---|---|---|---|---|---|---|---|---|
| E-1 | 200 | 20 | 300 | 0.2 | 1.2 | 100 | 6 | 250 | 1.0 | 0.25 | ※2 |
| E-2 | 200 | 20 | 300 | 2 | 1.2 | 100 | 6 | 250 | 1.0 | 0.25 | 20 |
| E-3 | 200 | 20 | 300 | 20 | 1.2 | 100 | 6 | 250 | 1.0 | 0.25 | 200 |
| E-4 | 200 | 20 | 300 | 40 | 1.2 | 100 | 6 | 250 | 1.0 | 0.25 | 500 |
| E-5※ | 200 | 20 | 300 | 100 | 1.2 | 100 | 6 | 250 | 1.0 | 0.25 | 1500 |

Figure 36:
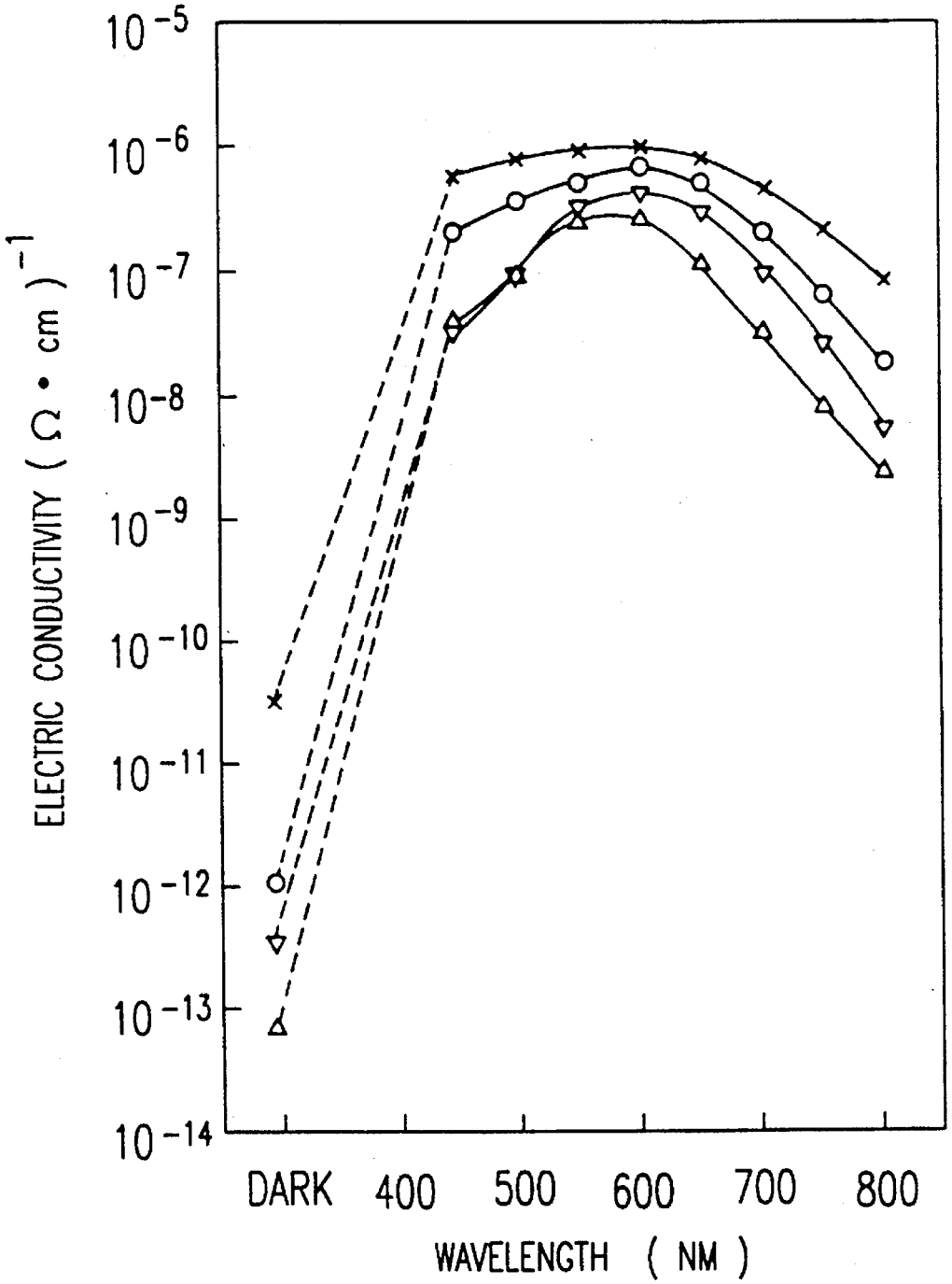

The spectral sensitivity characteristics of the Sample Nos. E-1, E-2, E-4 and E-5 shown in Table 6 were measured with the results as shown in FIG. 36. In addition, the H-content (the value of v) of the respective samples was measured with the results that it was within a range of 0.2 to 0.4.

Referring to FIG. 36, an axis of abscissa designates a wavelength, an axis of ordinate designating the conductivity, and ○ marks, Δ marks, ▽ marks and x marks designating a plot of measured values for the Sample Nos. E-1, E-2, E-4 and E-5, respectively.

It is clear from FIG. 36 that the samples according to the present invention have the enhanced photoconductivity.

EXAMPLE 10

Next, the present inventors produced various kinds of a-SiC photoconductive layer (Sample Nos. F-1 to F-5) by the use of the $CH_4$ gas in place of the $C_2H_2$ gas under the film-forming conditions shown in Table 7. And, the C-content (the value of x), the H-content (the value of y) and the B element-content of the respective samples were measured with the results as shown in Table 7.

Flow rate marked with * is a flow rate of the $B_2H_6$ gas diluted with the $H_2$ gas at a concentration of 100 ppm.

TABLE 7

| Sample No | Raw material gas $SiH_4$ sccm | Raw material gas $C_2H_2$ sccm | Diluent gas $H_2$ sccm | Impurity gas $B_2H_6$※※ sccm | Pressure Torr | Electric power W | Time minute | Temperature °C. | Film-thickness μm | Carbon-content x | Hydrogen-content y | β-element-content ppm |
|---|---|---|---|---|---|---|---|---|---|---|---|---|
| F-1 | 10 | 10 | 300 | 5 | 1.2 | 100 | 60 | 250 | 1.0 | 0.05 | 0.15 | 20 |
| F-2 | 10 | 20 | 300 | 10 | 1.2 | 100 | 60 | 250 | 1.0 | 0.1 | 0.13 | 20 |
| F-3 | 10 | 40 | 300 | 20 | 1.2 | 100 | 60 | 250 | 1.0 | 0.15 | 0.12 | 20 |
| F-4 | 10 | 80 | 300 | 40 | 1.2 | 100 | 60 | 250 | 1.0 | 0.3 | 0.10 | 20 |
| F-5 | 10 | 120 | 300 | 60 | 1.2 | 100 | 60 | 250 | 1.0 | 0.5 | 0.10 | 20 |

The spectral sensitive characteristics of the Sample Nos. F-1, F-2 and F-3 shown in Table 7 were measured with the results as shown in FIG. 37.

Figure 37:
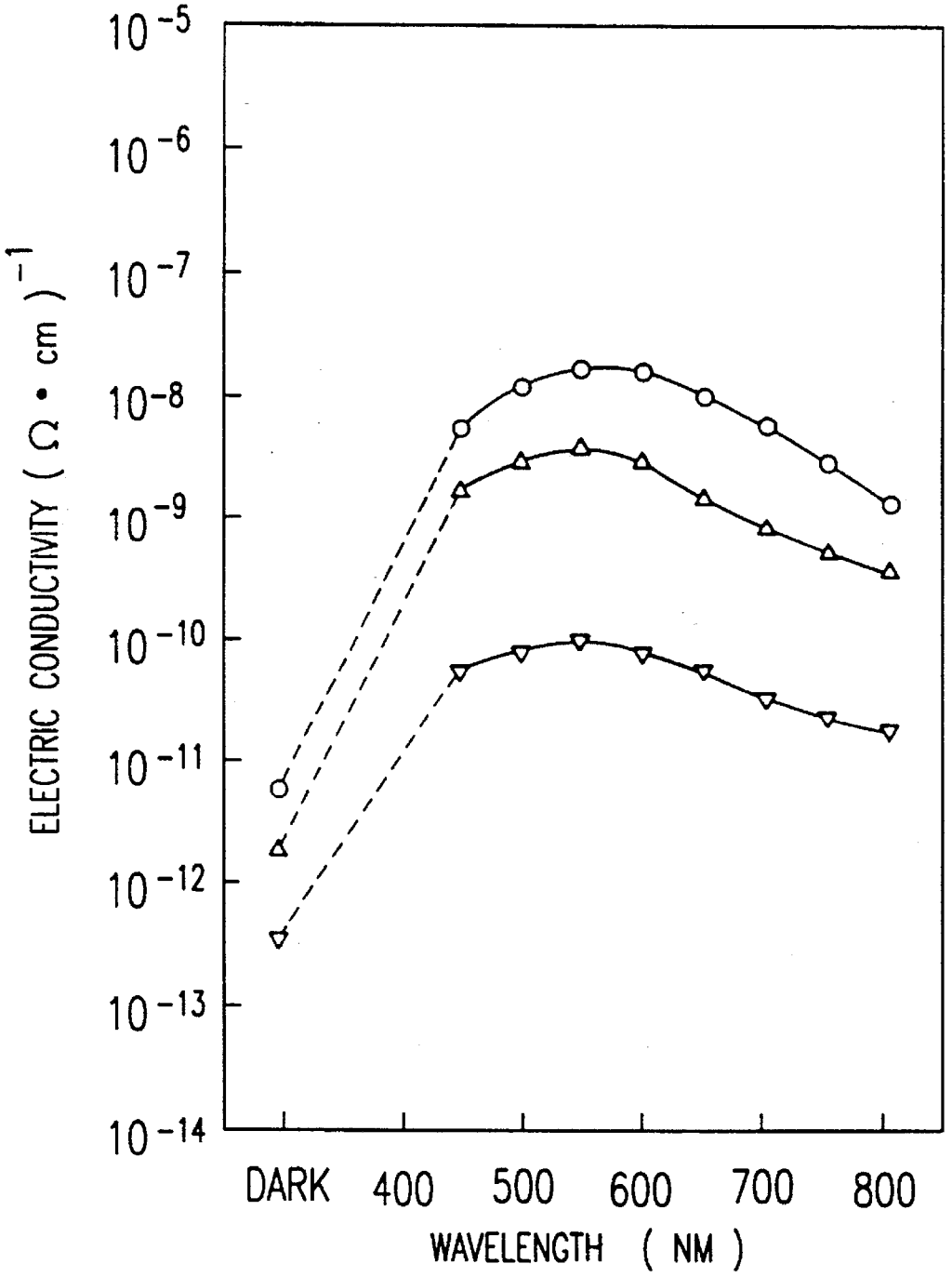

Referring to FIG. 37, an axis of abscissa designates a wavelength, an axis of ordinate designating the conductivity, and ○ marks, Δ marks, ▽ marks and x marks designating a plot of measured values for the Sample No. F-1, F-2 and F-3, respectively.

It is clear from FIG. 37 that every sample can not have the enhanced conductivity.

EXAMPLE 11

Next, the present inventors formed two kinds of a-SiC photoconductive layer on the electrically conductive Al substrate, as shown in Table 8, and the organic photosemiconductive layer (having a thickness of 15 microns) was piled up on said respective layers as follows:

Method of Coating the Organic Photosemiconductive Layer

Hydrazone was dissolved in 1,4-dioxane as a solvent and a polyester resin [Lexan-LS2-11] was added in the same quantity as hydrazone followed by the ultrasonic dispersion for 40 minutes. And, the resulting dispersion was coated on both a-SiC photoconductive layers by the use of a bar coater and then subjected to the hot wind drying.

Thus, two kinds of negative charge type electrophotographic sensitive member according to the fourth invention were produced (the sensitive members C, D).

Flow rate marked with * is a flow rate of the $B_2H_6$ gas diluted with the $H_2$ gas at a concentration of 100 ppm.

TABLE 8

| Sensitive member | Raw material $SiH_4$ sccm | Raw material $C_2H_2$ sccm | Diluent gas $H_2$ sccm | Impurity gas $B_2H_6$※ sccm | Pressure Torr | Electric power W | Time minute | Temperature °C. | Film-thickness μm |
|---|---|---|---|---|---|---|---|---|---|
| C | 20 | 1 | 700 | 10 | 1.2 | 100 | 30 | 250 | 1.0 |
| D | 200 | 20 | 300 | 100 | 0.8 | 100 | 8 | 250 | 1.0 |

Figure 38:
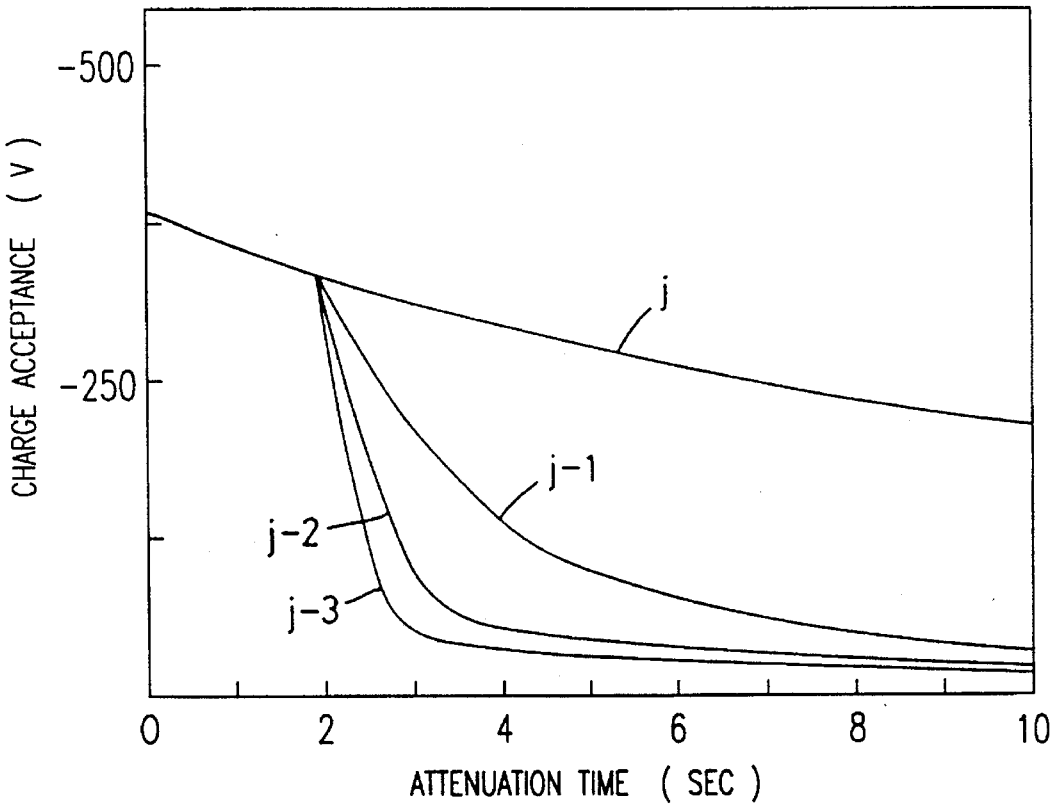

The dark- and photosensitive attenuation characteristics of the sensitive member C were measured with the results as shown in FIG. 38. In addition, the spectral sensitivity characteristics were measured with the results as shown in FIG. 39.

Referring to FIG. 38, an axis of abscissa designates an attenuation time (second), an axis of ordinate designates a surface potential (volt), j designating dark attenuation curves, and j-1, j-2 and j-3 designating a photoattenuation curve in the case where the exposure wavelength is 400 nm, 450 nm and 550 nm, respectively.

It is clear from FIG. 38 that the charge acceptance was slightly reduced in comparison with that of the sensitive member A but the photoattenuation curve shows superior characteristics and the photosensitivity was improved.

Figure 39:
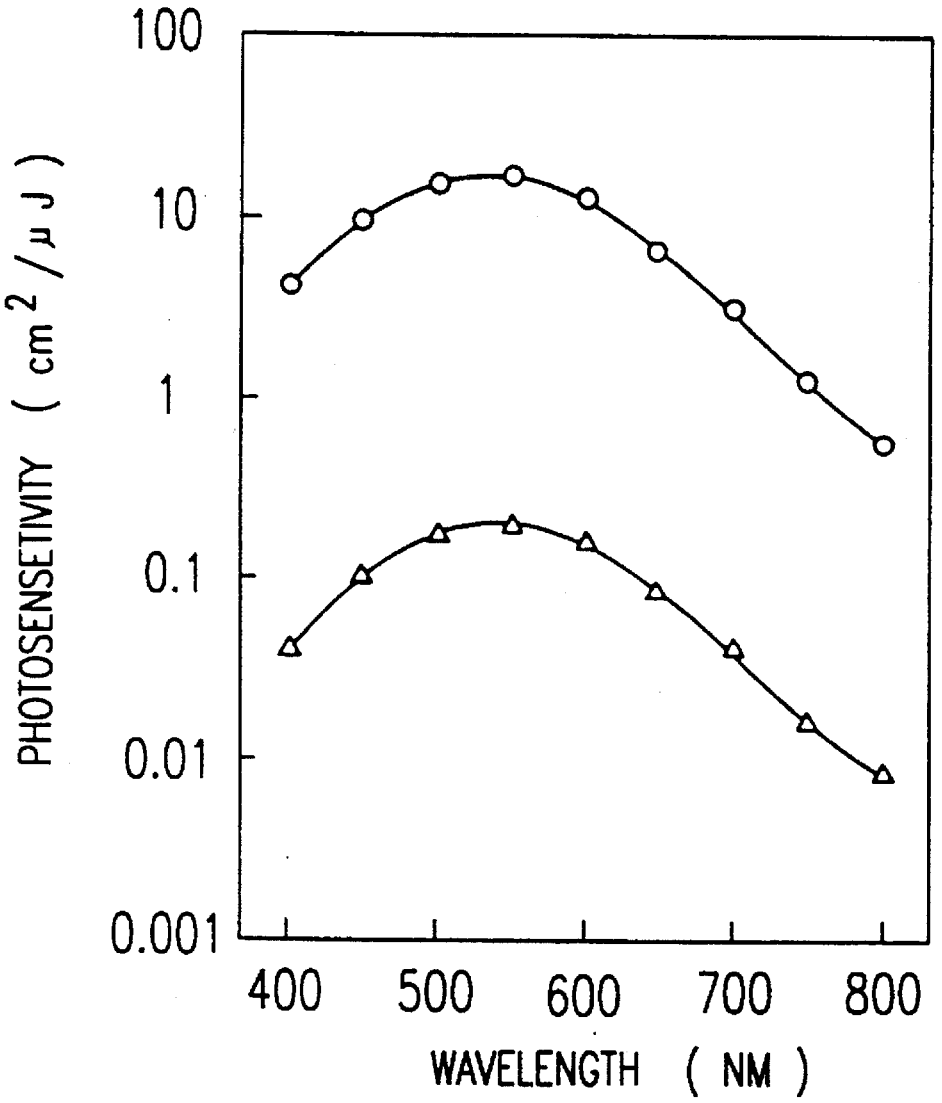

In addition, referring to FIG. 39, an axis of abscissa designates a wavelength, an axis of ordinate designating the photoconductivity, and ○ marks designating a plot of measured values for the sensitive member C. Furthermore, for comparison, the organic photosemiconductive layer was formed on the sample No. F-1 as the a-SiC photosemiconductive layer to produce the electrophotographic sensitive member. A plot of measured value of this sensitive member is shown by Δ marks.

It is clear from FIG. 39 that the sensitive member C is remarkably superior in photosensitivity.

In addition, the present inventors measured the dark-and photoattenuation characteristics as well as the spectral sensitivity characteristics of also the sensitive member D with the results that every sensitive member D has superior characteristics similarly to the sensitive member C.

Preferred Embodiment of the Second Invention

EXAMPLE 12

Figure 40:
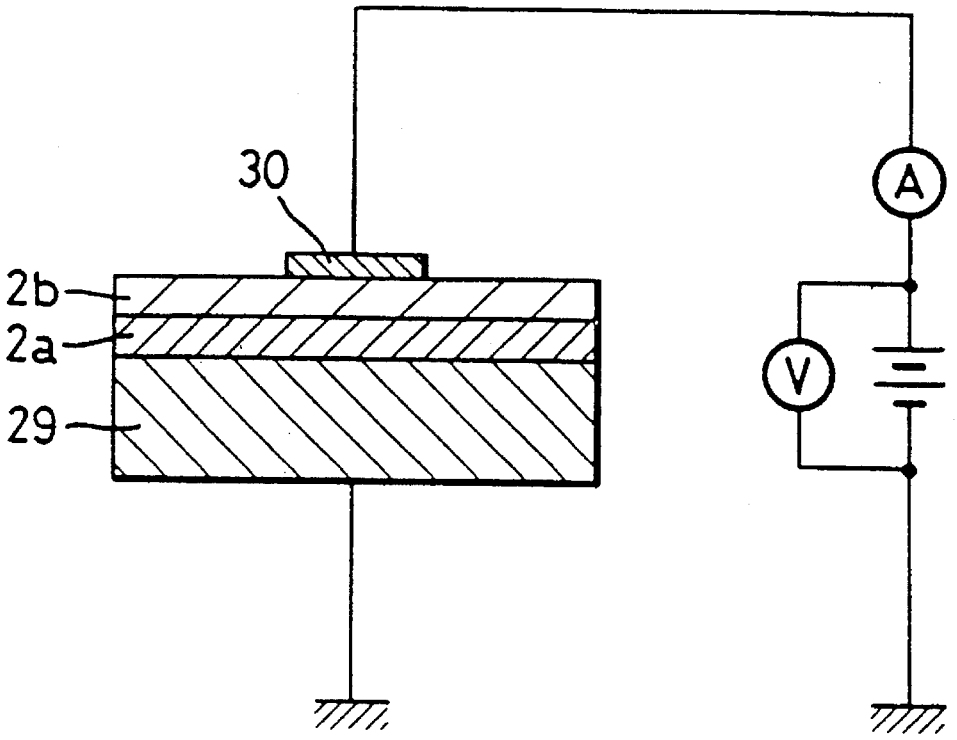
FIG. 40 is a diagram showing a measurement of voltage-electric current characteristics of a photoconductive member.

An Al flat plate (25 mm×50 mm) with a surface polished was disposed in an interior of the reaction tube of the glow-discharge decomposition apparatus and the first layer zone (2*a*) and the second layer zone (2*b*) were formed on said flat plate in turn under the high-speed film-forming conditions shogun in Table 9. Subsequently, a disk-like Al electrode (3 mm ø) was formed by the vacuum vapor deposition method to produce the photoconductive member as shown in FIG. 40. In addition, referring to FIG. 40, reference numeral (29) and (30) designates the flat plate and the Al electrode, respectively.

$B_2H_6$ gas marked with *, is diluted with the $H_2$ gas at a concentration of 0.2%.

TABLE 9

| Kind of layer | Flow rate of gas introduced (sccm) $SiH_4$ | $C_2H_2$ | $H_2$ | $B_2H_6$※ | Gas pressure (Torr) | High-frequency electric power (W) | Substrate temperature (°C.) | Thickness (μm) |
|---|---|---|---|---|---|---|---|---|
| Second layer zone | 200 | 20 | 270 | — | 0.60 | 150 | 250 | 1.0 |
| First layer zone | 80 | 10 | 350 | 120 | 0.45 | 80 | 250 | 1.0 |

The C-content and the B element-content of thus formed first layer zone (2*a*) and second layer zone (2*b*) were measured with the results as shown in Table 10.

TABLE 10

| Kind of layer | Value of x in $Si_{1-x}C_x$ | B element-content (ppm) |
|---|---|---|
| Second layer zone | 0.17 | — |
| First layer zone | 0.23 | 3000 |

Figure 41:
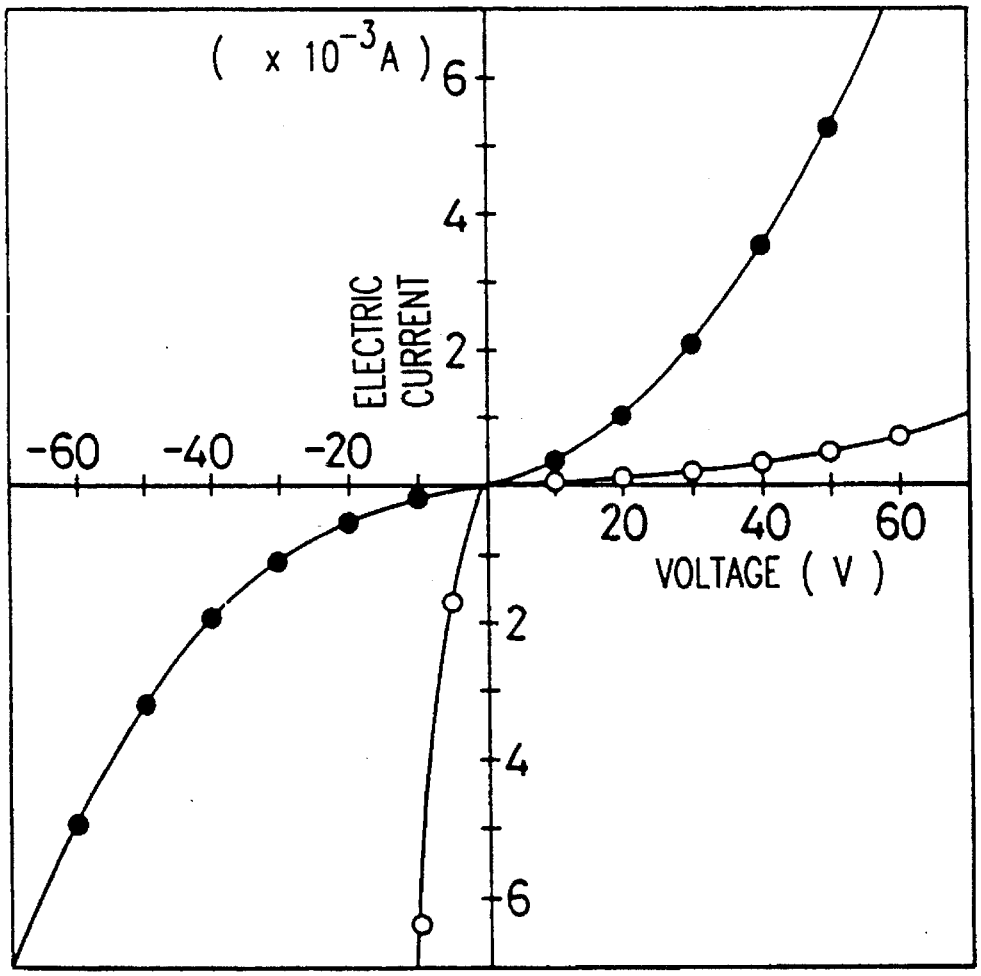
FIGS. 41, 42, 45, 46, 49, 50, 53, 54, 57 and 58 are graphs showing voltage-electric current characteristics.

The voltage-electric current characteristics of thus obtained a-SiC photoconductive member were measured with applying a voltage to the side of Al electrode (30) and connecting the flat plate (29) to the earth side, as shown in FIG. 40, with the results as shown in FIG. 41.

In addition, in the present EXAMPLE the the $B_2H_6$ gas was not introduced and other film-forming conditions were set quite identically with those in the present EXAMPLE in the formation of the first layer zone, whereby the a-SiC photoconductive member having the first layer zone containing no B element was produced, and this was used as COMPARATIVE EXAMPLE of which voltage-electric current characteristics were also measured.

Referring to FIG. 41, an axis of abscissa designates a voltage applied to the Al electrode (30), an axis of ordinate designating a value of electric current, ○ marks designating a plot of measured values for the a-SiC photoconductive member according to the present invention, and ● marks designating a plot of measured values for the a-SiC photoconductive member according to COMPARATIVE EXAMPLE.

It is clear from FIG. 41 that with the a-SiC photoconductive member according to the present invention, even though the positive voltage is applied to the Al electrode (30), an electric current is hardly flown, but, if the negative voltage is applied to the electrode (30), a remarkably large electric current is flown.

EXAMPLE 13

The same a-SiC photoconductive layer as in EXAMPLE 12 was formed on the Al substrate and then the organic photosemiconductive layer (having a film-thickness of about 15 microns) mainly comprising TNF similarly to EXAMPLE 7 was formed to obtain the positive charge type electrophotographic sensitive member.

The characteristics of thus obtained electrophotographic sensitive member were measured by means of the electrophotographic characteristic-measuring apparatus with the results that not only the superior photosensitivity and charge acceptance but also the reduced residual voltage were obtained.

EXAMPLE 14

In the production of the above described electrophotographic sensitive member according to EXAMPLE 13 the a-SiC photoconductive layer according to EXAMPLE 12 (COMPARATIVE EXAMPLE) was formed and then the same organic photosemiconductive layer was formed to produce the electrophotographic sensitive member.

The photosensitivity of thus obtained electrophotographic sensitive member was measured with the results that the photosensitivity was reduced by about 10% and the residual potential is slightly increased in comparison with the electrophotographic sensitive member according to EXAMPLE 13.

EXAMPLE 15

In addition, the present inventors varied the flow rate of the $B_2H_6$ gas in the production of the electrophotographic sensitive member according to EXAMPLE 13 to produce 11 kinds of electrophotographic sensitive member (sensitive members E-1 to E-11) of which B element-content of the first layer zone was varied, as shown in Table 11.

The photosensitivity, surface potential and residual potential of these electrophotographic sensitive members were measured with the results as shown in Table 11.

Referring to Table 11, the photosensitivity is divided into three ranks expressed by ⊙ marks, ○ marks and Δ marks by the relative evaluation. ⊙ marks show the most superior photosensitivity, ○ marks showing the somewhat superior photosensitivity, and Δ marks showing the photosensitivity slightly inferior to other cases.

Also the evaluation of the charge acceptance is divided into three ranks expressed by ⊙ marks, ○ marks and Δ marks. ⊙ marks show the least charge acceptance, ○ marks showing the somewhat higher charge acceptance and Δ marks showing the charge acceptance lower than other cases.

Furthermore, also the evaluation of the residual potential is divided into three ranks by the relative evaluation. ⊙ marks shown the least residual potential, ○ marks showing the somewhat reduced residual potential, and Δ marks showing the residual potential higher than that in other cases.

The above described evaluation method is same also in EXAMPLES which will be mentioned later.

Sensitive members marked with * are outside of the scope of the present invention.

TABLE 11

| Sensitive member | B element-content of the first layer zone (ppm) | Photosensitivity | Charge acceptance | Residual potential |
|---|---|---|---|---|
| E-1※ | 0.1 | Δ | Δ | ○ |
| E-2 | 3 | ○ | Δ | ○ |

TABLE 11-continued

| Sensitive member | B element-content of the first layer zone (ppm) | Photo-sensi-tivity | Charge accept-ance | Residual potential |
|---|---|---|---|---|
| E-3 | 50 | ○ | Δ | ○ |
| E-4 | 200 | ○ | ○ | ○ |
| E-5 | 400 | ○ | ○ | ○ |
| E-6 | 700 | ◎ | ◎ | ◎ |
| E-7 | 1500 | ◎ | ◎ | ◎ |
| E-8 | 3500 | ◎ | ◎ | ◎ |
| E-9 | 6000 | ◎ | ○ | ○ |
| E-10 | 8000 | ○ | ◎ | ◎ |
| E-11※ | 13000 | Δ | Δ | Δ |

It is clear from Table 11 that the sensitive members E-2 to E-10 show the superior photosensitivity and the reduced residual potential. Above all, the sensitive members E-4 to E-10 showed the higher charge acceptance.

However, the sensitive member E-1 is inferior in photosensitivity and charge acceptance and the sensitive member E-11 is not improved in photosensitivity, charge acceptance and residual potential.

EXAMPLE 16

Figure 42:
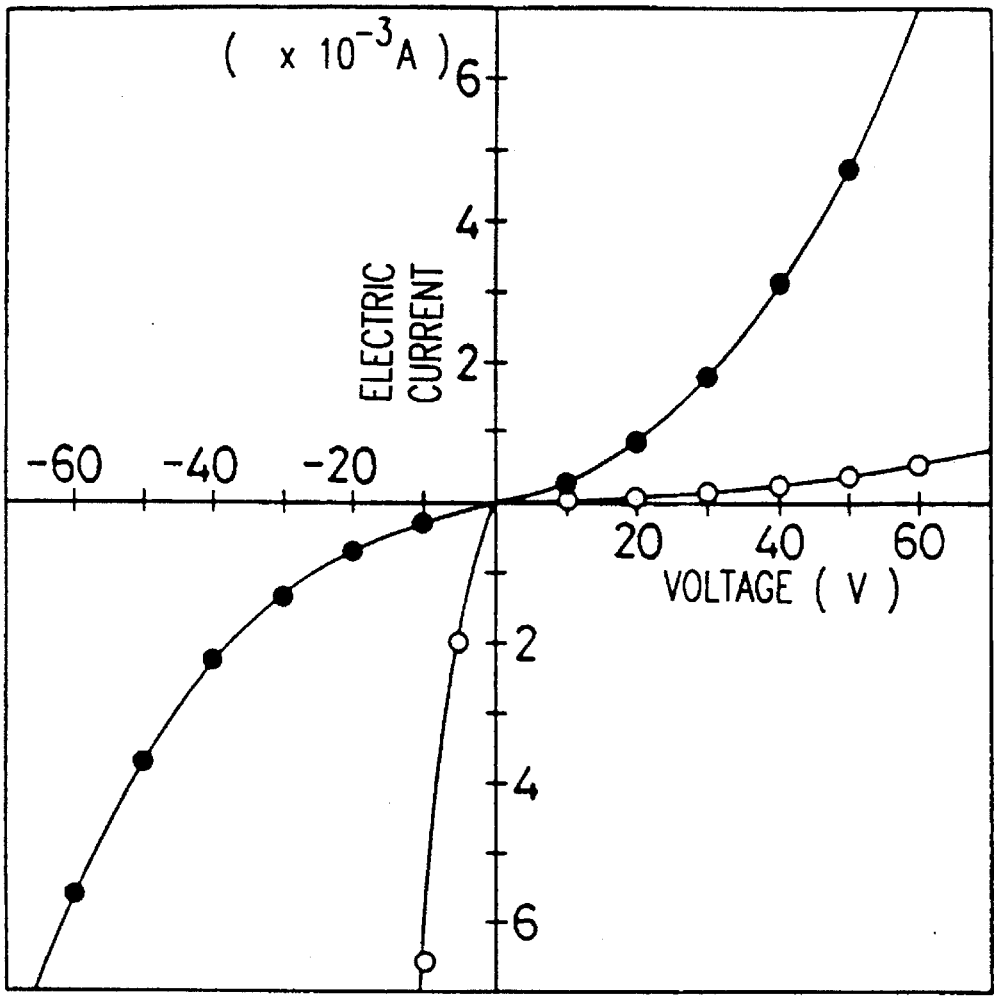

The first layer zone (2*a*) and the second layer zone (2*b*) were formed on the Al substrate (29) turn under the lower film-forming speed conditions shown in Table 12 in the same manner as in EXAMPLE 12 and then the Al electrode (30) was formed. The voltage-electric current characteristics of thus obtained photoconductive member were measured with the results as shown in FIG. 42.

$B_2H_6$ gas marked with * is diluted with the $H_2$ gas at a concentration of 0.2%.

TABLE 12

| Kind of layer | Flow rate of gas introduced (sccm) $SiH_4$ | $C_2H_2$ | $H_2$ | $B_2H_6$※ | Gas pressure (Torr) | High-frequency electric power (W) | Substrate temperature (°C.) | Thickness (μm) | Value of x in $Si_{1-x}C_x$ | B element-content (ppm) |
|---|---|---|---|---|---|---|---|---|---|---|
| Second layer zone | 20 | 1 | 700 | — | 1.20 | 100 | 250 | 0.1 | 0.1 | — |
| First layer zone | 20 | 2 | 700 | 45 | 1.20 | 100 | 250 | 1.0 | 0.2 | 3000 |

The voltage-electric current characteristics of thus obtained a-SiC photoconductive member were measured with applying a voltage to the side of the Al electrode (30) and connecting the flat plate (29) to the earth side with the results as shown in FIG. 42.

In addition, in the present EXAMPLE the $B_2H_6$ gas was not introduced and other film-forming conditions were set in the quite same manner as in the present EXAMPLE to produce the a-SiC photoconductive member having the first layer zone containing no B element. This was used as COMPARATIVE EXAMPLE of which voltage-electric current characteristics were also measured.

Referring to FIG. 42, an axis of abscissa designates the voltage applied to the Al electrode (30), an axis of ordinate designating the value of electric current, ○ marks designating a plot of measured values for the a-SiC photoconductive member according to the present invention, and ● marks designating a plot of measured values for the a-SiC photoconductive member according to COMPARATIVE EXAMPLE.

It is clear from FIG. 42 that with the a-SiC photoconductive member according to the present invention, even though the positive voltage is applied to the Al electrode (30), an electric current is hardly flown, but, in the case where the negative voltage is applied to the electrode (30), a remarkably large electric current is flown.

EXAMPLE 17

The same a-SiC photoconductive layer as in EXAMPLE 16 was formed on the Al substrate and then the organic photosemiconductive layer (having a film-thickness of about 15 microns) mainly comprising TNF in the same manner as in EXAMPLE 7 to obtain the positive charge type electrophotographic sensitive member.

The characteristics of thus obtained electrophotographic sensitive member were measured by means of the electrophotographic characteristic-measuring apparatus with the results that the superior photosensitivity and charge acceptance were obtained and the reduced residual potential was obtained.

EXAMPLE 18

Next, the present inventors formed two kinds of a-SiC photoconductive layer, as shown in Table 13, and then the organic photosemiconductive layer (having a thickness of about 15 microns) mainly comprising TNF in the same manner as in EXAMPLE 7 was formed on the respective a-SiC photoconductive layers to produce two kinds of positive charge type electrophotographic sensitive members.

Flow rate marked with ** is a flow rate of the $B_2H_6$ gas diluted with the $H_2$ gas at a concentration of 0.2%.

TABLE 13

| Sensitive member | Raw material gas $SiH_4$ sccm | $C_2H_2$ sccm | Diluent gas $H_2$ sccm | Impurity gas $B_2H_6$※ sccm | Pressure Torr | Electric power W | Time minute | Temperature °C. | Film-thickness μm |
|---|---|---|---|---|---|---|---|---|---|
| F | 20 | 1 | 700 | 30 | 1.2 | 100 | 30 | 250 | 1.0 |
| | 20 | 1 | 700 | — | 1.2 | 100 | 15 | 250 | 0.5 |

TABLE 13-continued

| Sensitive member | Raw material gas $SiH_4$ sccm | Raw material gas $C_2H_2$ sccm | Diluent gas $H_2$ sccm | Impurity gas $B_2H_6$* sccm | Pressure Torr | Electric power W | Time minute | Temperature °C. | Film-thickness μm |
|---|---|---|---|---|---|---|---|---|---|
| G | 200 | 20 | 300 | 300 | 0.8 | 100 | 6 | 250 | 1.0 |
| | 200 | 20 | 300 | — | 0.8 | 100 | 3 | 250 | 0.5 |

Figure 43:
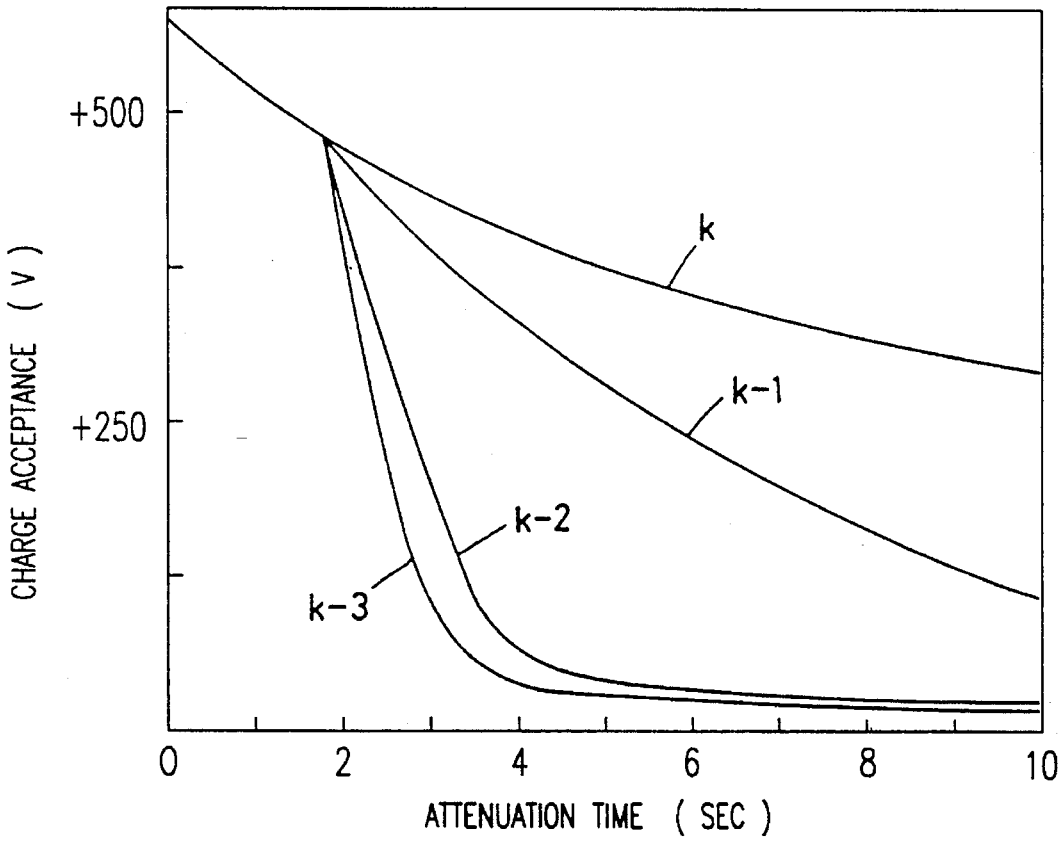
Figure 44:
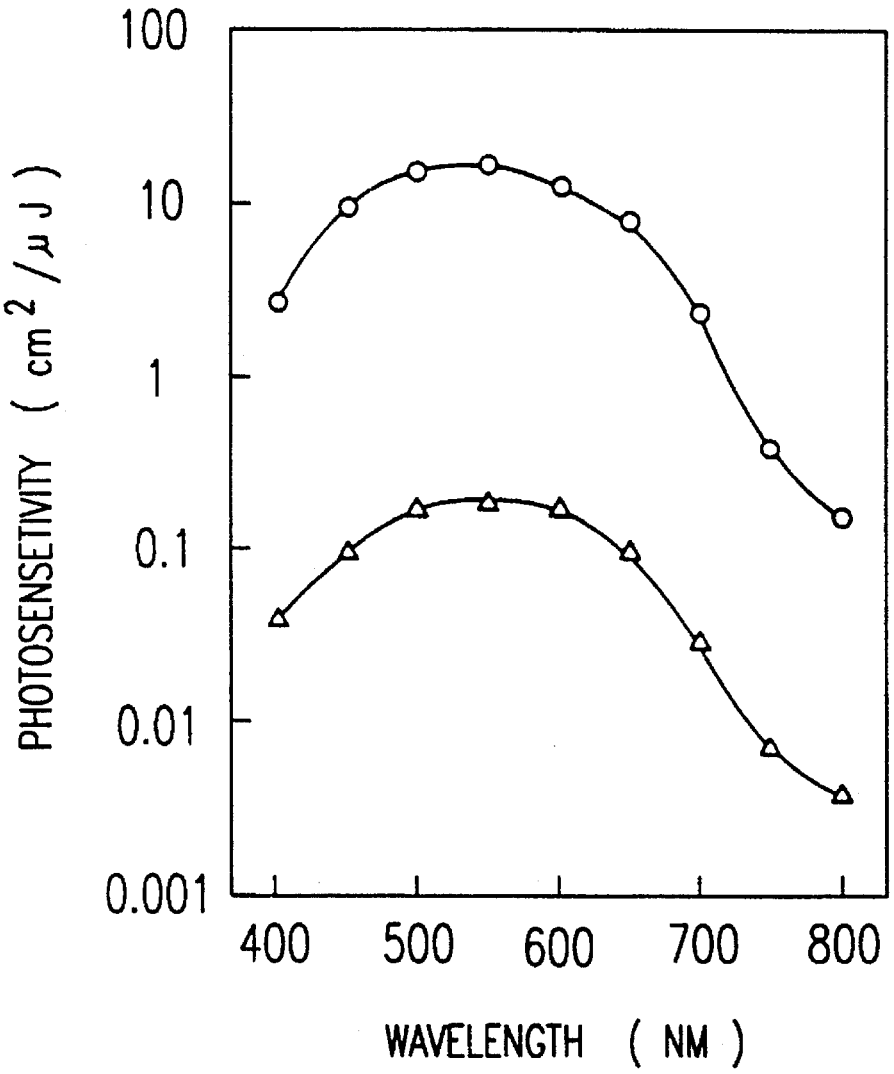

The dark- and photoattenuation characteristics of the sensitive member F were measured with the results as shown in FIG. 43 and the spectral sensitivity characteristics were measured with the results as shown in FIG. 44.

Referring to FIG. 43, an axis of abscissa designates an attenuation time (sec), an axis of ordinate designating the surface potential (volt), k designating a dark attenuation curve, and k-2 and k-3 designating a photoattenuation curve at the exposure wavelength of 400 nm, 450 nm and 550 nm, respectively.

It is clear from FIG. 43 that the electrifying capacity is improved in comparison with that in the first invention.

In addition, referring to FIG. 44, an axis of abscissa designates a wavelength, an axis of ordinate designating a photosensitivity, and o marks designating a plot of measured values for the sensitive member F. In addition, the $B_2H_6$ gas (having a concentration of 0.2%) was added to the Sample No. C-1 at a flow rate of 30 sccm and a thickness of 1.0 micron was given in the formation of the first layer zone and a thickness of 0.5 microns was given under the same film-forming conditions as for the Sample No. C-1 in the formation of the second layer zone to form the a-SiC photoconductive layer as COMPARATIVE EXAMPLE. Then the organic photosemiconductive layer was formed on the a-SiC photoconductive layer in the same manner as in the present EXAMPLE to produce the positive charge type electrophotographic sensitive member. A plot of measured values for this sensitive member is shown by Δ marks.

It is clear from FIG. 44 that the sensitive member F shows the remarkably higher photosensitivity in comparison with that in COMPARATIVE EXAMPLE which is improved in comparison with also that in the first invention.

In addition, the present inventors measured the dark- and photoattenuation characteristics as well as the spectral sensitivity characteristics of the sensitive member G in the same manner as in the present EXAMPLE with the same effect as for the sensitive member F in every case.

Preferred Embodiments of the Third Invention

EXAMPLE 19

The Al flat plate (25 mm×50 mm), of which surface had been ground, was placed within the reaction tube of the glow-discharge decomposition apparatus and the first layer zone (2*a*) and the second layer zone (2*b*) were formed on said flat plate in turn under the film-forming conditions shown in Table 14. Subsequently, the disk-like Al electrode (having a diameter of 3 mm) was formed by the vacuum vapor deposition method to produce photoconductive members as shown in FIG. 40.

$B_2H_6$ gas marked with * is diluted with the $H_2$ gas at a concentration of 0.2%.

The $PH_3$ gas marked with ** is diluted with the $H_2$ gas at a concentration of 17 ppm.

TABLE 14

| Sample No | Kind of layer | Raw material gas $SiH_4$ sccm | Raw material gas $C_2H_2$ sccm | Diluent gas $H_2$ sccm | Impurity gas $B_2H_6$* sccm | Impurity gas $PH_3$** sccm | Pressure Torr | High-frequency electric power W | Time minute | Temperature °C. | Film-thickness μm |
|---|---|---|---|---|---|---|---|---|---|---|---|
| G-1 (Lower speed film-formation) | First layer zone | 20 | 1 | 700 | 30 | | 1.2 | 100 | 30 | 250 | 1.0 |
| | Second layer zone | 20 | 1 | 700 | | 15 | 1.2 | 100 | 15 | 250 | 0.5 |
| G-2 (Higher speed film-formation) | First layer zone | 200 | 20 | 300 | 300 | | 0.8 | 100 | 6 | 250 | 1.0 |
| | Second layer | 200 | 20 | 300 | | 150 | 0.8 | 100 | 3 | 250 | 0.5 |

The C-content, the B element-content and the element-content of the first layer zone (2*a*) and the second layer zone (2*b*) were measured for the respective samples, on which the films had been formed in the above described manner, with the results as shown in Table 15.

TABLE 15

| Sample No | Kind of layer | Value of x in $Si_{1-x}C_x$ | B element-content (ppm) | P element-content (ppm) |
|---|---|---|---|---|
| G-1 | Second layer zone | 0.1 | — | 10 |
| | First layer zone | 0.1 | 2000 | — |
| G-2 | Second layer zone | 0.25 | — | 10 |
| | First layer zone | 0.25 | 2000 | — |

Figure 45:
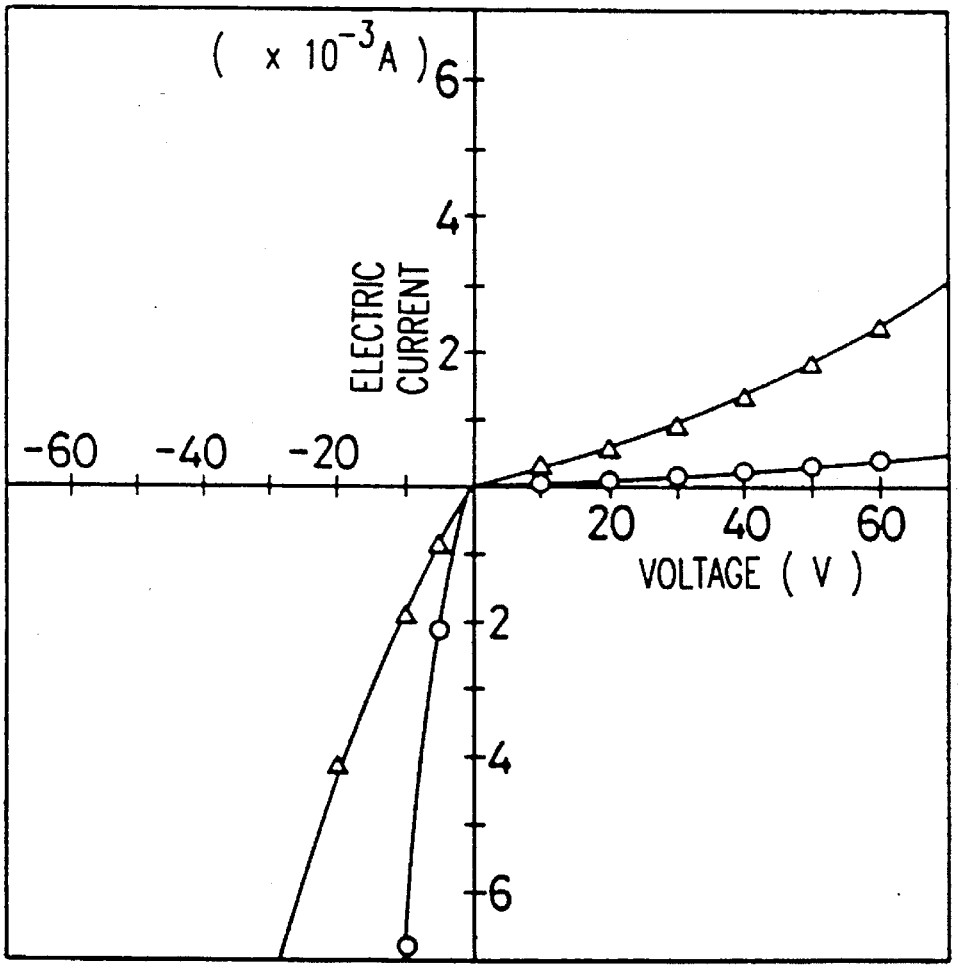
Figure 46:
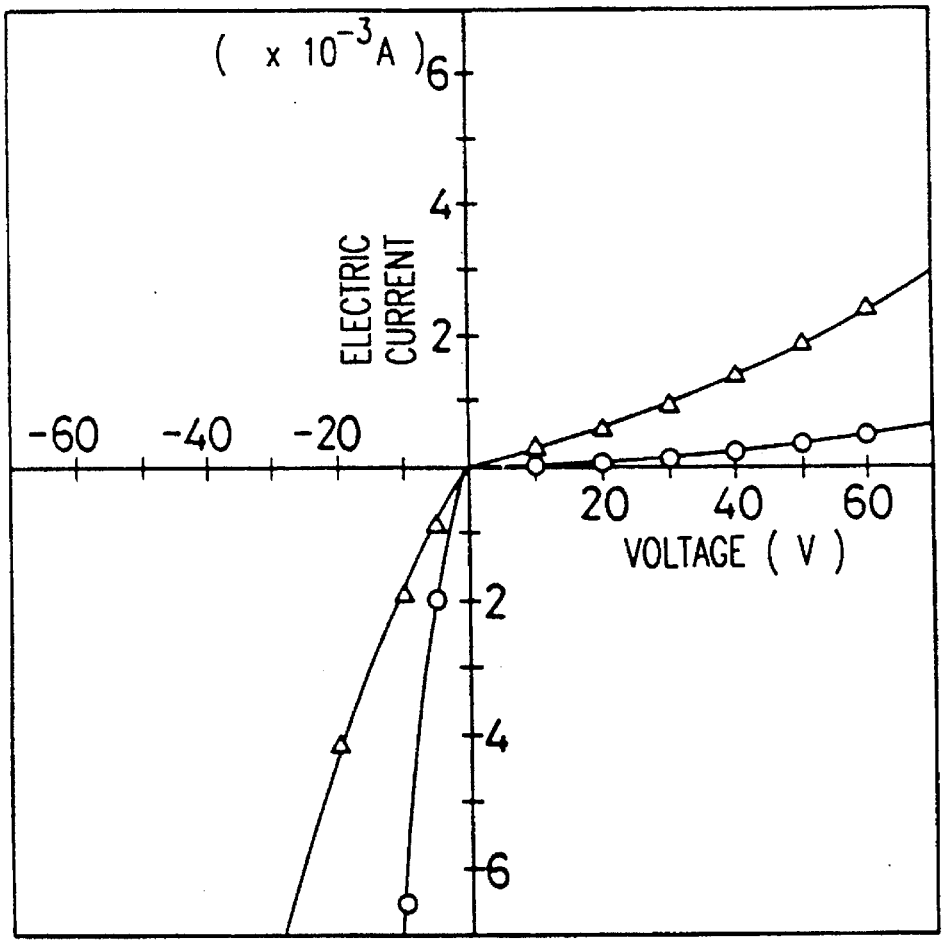

The voltage-electric current characteristics of thus obtained respective photoconductive members were measured with applying a voltage to the side of the Al electrode (30) and connecting the flat plate (29) to an earth side with the results as shown in FIGS. 45 and 46.

FIG. 45 shows the voltage-electric current characteristics for the Sample No. G-1 and FIG. 46 shows the voltage-electric current characteristics for the Sample No. G-2. Referring to FIGS. 45 and 46, an axis of abscissa designates a voltage applied to the Al electrode (30), an axis of ordinate designating an electric current, and o marks designating a plot of measured values.

In both FIG. 45 and FIG. 46 a plot of measured values for COMPARATIVE EXAMPLE is shown by Δ marks. In every case, the $B_2H_6$ gas (having a concentration of 0.2%) was mixed at a flow rate of 30 sccm under the film-forming conditions for the Sample No. C-1 and a thickness of 1.0 micron was given in the formation of the first layer zone (2*a*) and the $PH_3$ gas (having a concentration of 17 ppm) was mixed at a flow rate of 15 sccm and a thickness of 0.5 microns was given in the formation of the second layer zone (2*b*) to produce a-SiC photoconductive layers.

It is clear from FIGS. 45 and 46 that with the a-SiC photoconductive members according to the present invention, even though the positive voltage is applied to the Al electrode (30), an electric current is hardly flown, but, in the case where the negative voltage is applied to the electrode (30), a remarkably large electric current is flown.

In addition, comparing with the second invention, if the voltage applied is positive, the electric current is still more reduced, while, if the voltage applied is negative, the electric current is still more increased, that is, the a-SiC photoconductive members according to the third invention are superior to those according to the second invention in rectification property.

EXAMPLE 20

The same a-SiC photoconductive layer as in EXAMPLE 19 was formed on the Al substrate and then the organic photosemiconductive layer (having a film-thickness of about 15 microns) mainly comprising TNF in the same manner as in EXAMPLE 7 was formed to obtain a positive charge type electrophotographic sensitive member.

Thus, the electrophotographic sensitive members it, I corresponding to the a-SiC photoconductive layers (G-1), (G-2) were produced.

Figure 47:
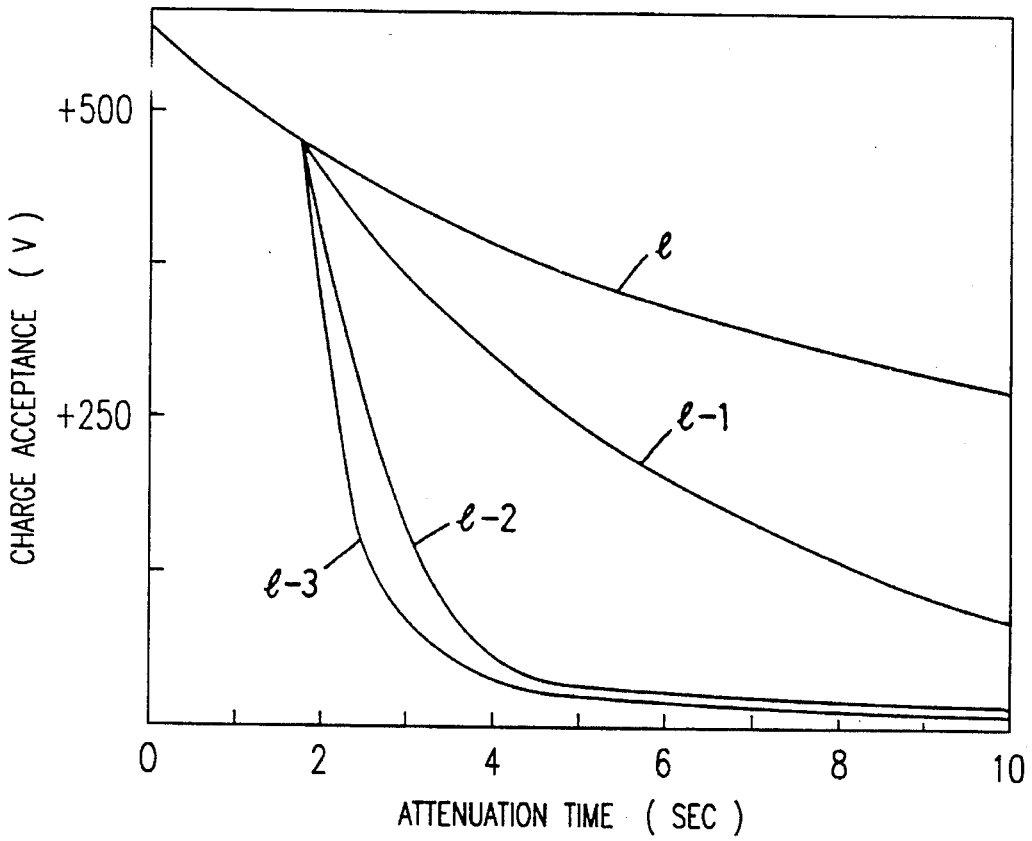

The dark- and photoattenuation characteristics of the sensitive member H were measured with the results as shown in FIG. 47. In addition, the spectral sensitivity characteristics were measured with the results as shown in FIG. 48.

Referring to FIG. 47, an axis of abscissa designates an attenuation time (sec), an axis of ordinate designating a charge acceptance (volt), l designating a dark attenuation curve, and l-1, l-2 and l-3 designating a photoattenuation curve at the exposure wavelength of 400 nm, 450 nm and 550 nm, respectively.

It is clear from FIG. 47 that the electrifying capacity is improved in comparison with the first invention.

Figure 48:
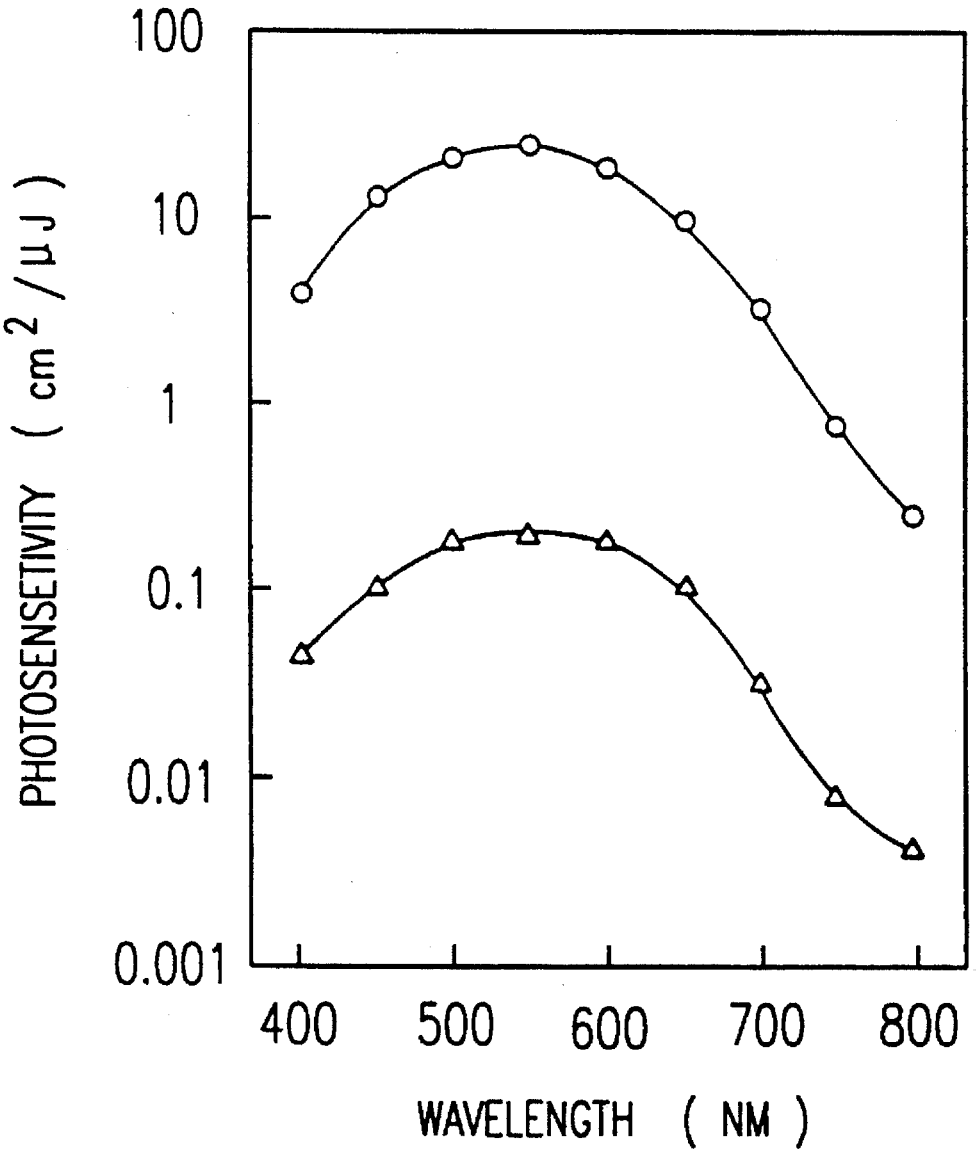

In addition, referring to FIG. 48, an axis of abscissa designates a wavelength, an axis of ordinate designating the photosensitivity, and o marks designating a plot of measured values for the sensitive member H. In addition, for comparison, the organic photosemiconductive layer was similarly formed on the a-SiC photoconductive layer shown FIG. 45 to produce a positive charge type electrophotographic sensitive member. A plot of measured values for this sensitive member is shown by Δ marks.

It is clear from FIG. 48 that the photosensitivity of the sensitive member H is higher in comparison with that in the second invention.

In addition, the dark- and photoattenuation characteristics as well as the spectral sensitivity characteristics of also the sensitive member I were measured by the present inventors with the same effect as in the sensitive member H in every case.

EXAMPLE 21

In addition, the present inventors varied the flow rate of the $PH_3$ gas and the flow rate of $B_2H_6$ gas in the production of the sensitive member I, whereby producing 15 kinds of electrophotographic sensitive member (sensitive members J-1 to J-15) with varied B element-content of the first layer zone and varied P element-content in the second layer zone, as shown in Table 16.

The photosensitivity, charge acceptance and residual potential of these electrophotographic sensitive members were measured with the results as shown in Table 16.

Sensitive members marked with * are outside of the scope of the present invention.

TABLE 16

| Sensitive member | B element-content of the first layer zone (ppm) | P element-content of the second layer zone (ppm) | Photo-sensi-tivity | Charge accept-ance | Residual potential |
|---|---|---|---|---|---|
| J-1* | 0.1 | 15 | Δ | Δ | ○ |
| J-2 | 5 | 30 | ○ | Δ | ○ |
| J-3 | 70 | 30 | ○ | Δ | ○ |
| J-4 | 300 | 2 | ○ | ○ | ○ |
| J-5 | 1500 | 2 | ○ | ○ | ○ |
| J-6 | 300 | 15 | ⊙ | ○ | ⊙ |
| J-7 | 800 | 3 | ⊙ | ⊙ | ⊙ |
| J-8 | 2000 | 20 | ⊙ | ⊙ | ⊙ |
| J-9 | 3500 | 40 | ⊙ | ⊙ | ⊙ |
| J-10 | 7000 | 40 | ○ | ⊙ | ⊙ |
| J-11 | 700 | 70 | ⊙ | ⊙ | ⊙ |
| J-12 | 7000 | 70 | ○ | ○ | ○ |
| J-13 | 700 | 300 | ○ | ○ | ○ |
| J-14* | 12000 | 40 | Δ | Δ | Δ |
| J-15* | 700 | 700 | Δ | Δ | Δ |

It is clear from Table 16 that the sensitive members J-2 to J-13 show the superior photosensitivity, the enhanced charge ,acceptance and the reduced residual potential.

It is, however, found that the sensitive member J-1 is inferior in photosensitivity and charge acceptance and the sensitive members J-14 and J-15 are not improved in photosensitivity, charge acceptance and residual potential.

EXAMPLE 22

An Al flat plate (25 mm×50 mm), of which surface had been ground, was placed within the reaction tube of the glow-discharge decomposition apparatus and the first layer zone (2*a*) and the second layer zone (2*b*) were formed on said flat plate in turn under the film-forming conditions shown in Table 17. Subsequently, a disk-like Al electrode (having a diameter of 3 mm) was formed by the vacuum vapor deposition method to produce a photoconductive member as shown in FIG. 40.

$B_2H_6$ gas marked with * is diluted with the $H_2$ gas at a concentration of 0.2%.

The $PH_3$ gas marked with ** is diluted with the $H_2$ gas at a concentration of 40 ppm.

Numerical values marked with *** designate a flow rate of gases at the start of film-formation and the finish of film-formation and show the gradual decrease.

TABLE 17

| Sample No | Kind of layer | Raw material gas $SiH_4$ sccm | Raw material gas $C_2H_2$ sccm | Diluent gas $H_2$ sccm | Impurity gas $B_2H_6$ sccm | Impurity gas $PH_3$ sccm | Pressure Torr | High-frequency electric power W | Time minute | Temperature °C. | Film-thickness μm |
|---|---|---|---|---|---|---|---|---|---|---|---|
| H-1 (Lower speed film-formation) | First layer zone | 20 | 1 | 700 | 60 → 0 | | 1.2 | 100 | 30 | 250 | 1.0 |
| | Second layer zone | 20 | 1 | 700 | | 15 | 1.2 | 100 | 15 | 250 | 0.5 |
| H-2 (Higher speed film-formation) | First layer zone | 200 | 20 | 300 | 600 → 0 | | 0.8 | 100 | 6 | 250 | 1.0 |
| | Second layer zone | 200 | 20 | 300 | | 150 | 0.8 | 100 | 3 | 250 | 0.5 |

The C-content, the maximum B element-content and the P element-content of the respective samples, on which the films had been formed in the above described manner, were measured with the results as shown in Table 18.

TABLE 18

| Sample No | Kind of layer | Value of x in $Si_{1-x}C_x$ | Maximum B element-content (ppm) | P element-content (ppm) |
|---|---|---|---|---|
| H-1 | Second layer zone | 0.1 | — | 25 |
| | First layer zone | 0.1 | 4000 | — |
| H-2 | Second layer zone | 0.25 | — | 25 |
| | First layer zone | 0.25 | 4000 | — |

Figure 49:
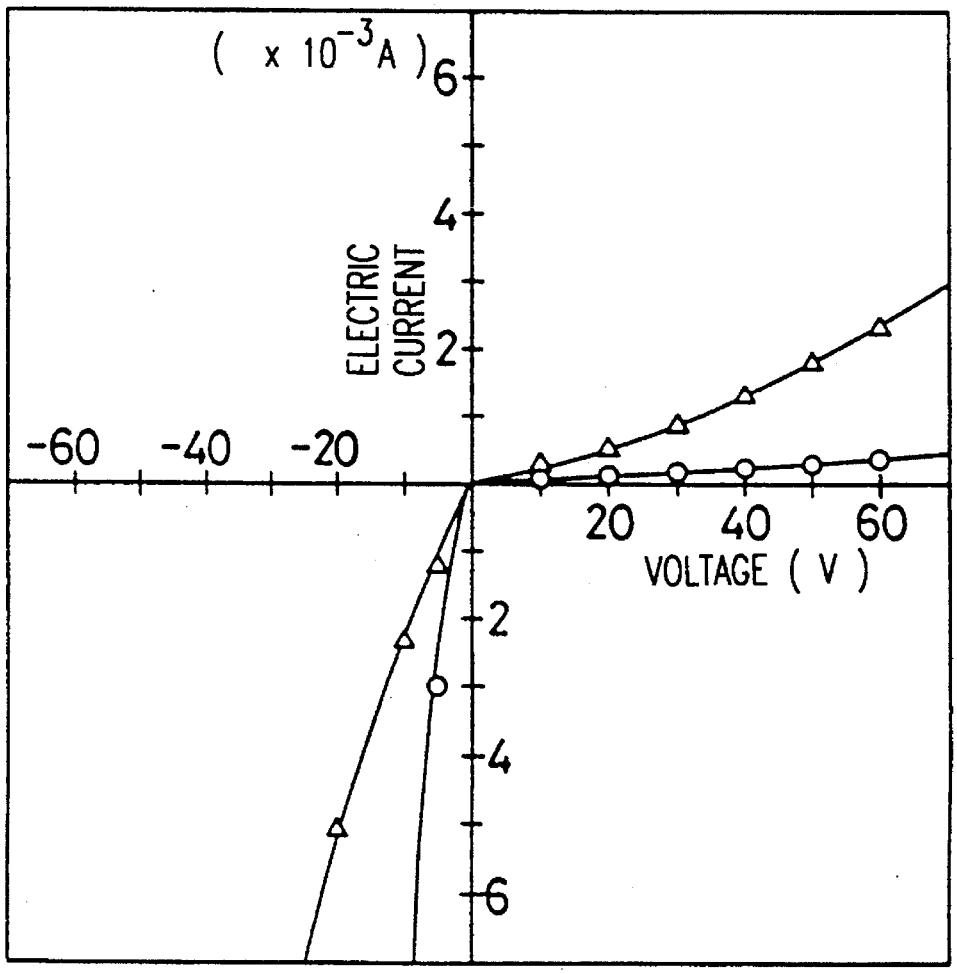
Figure 50:
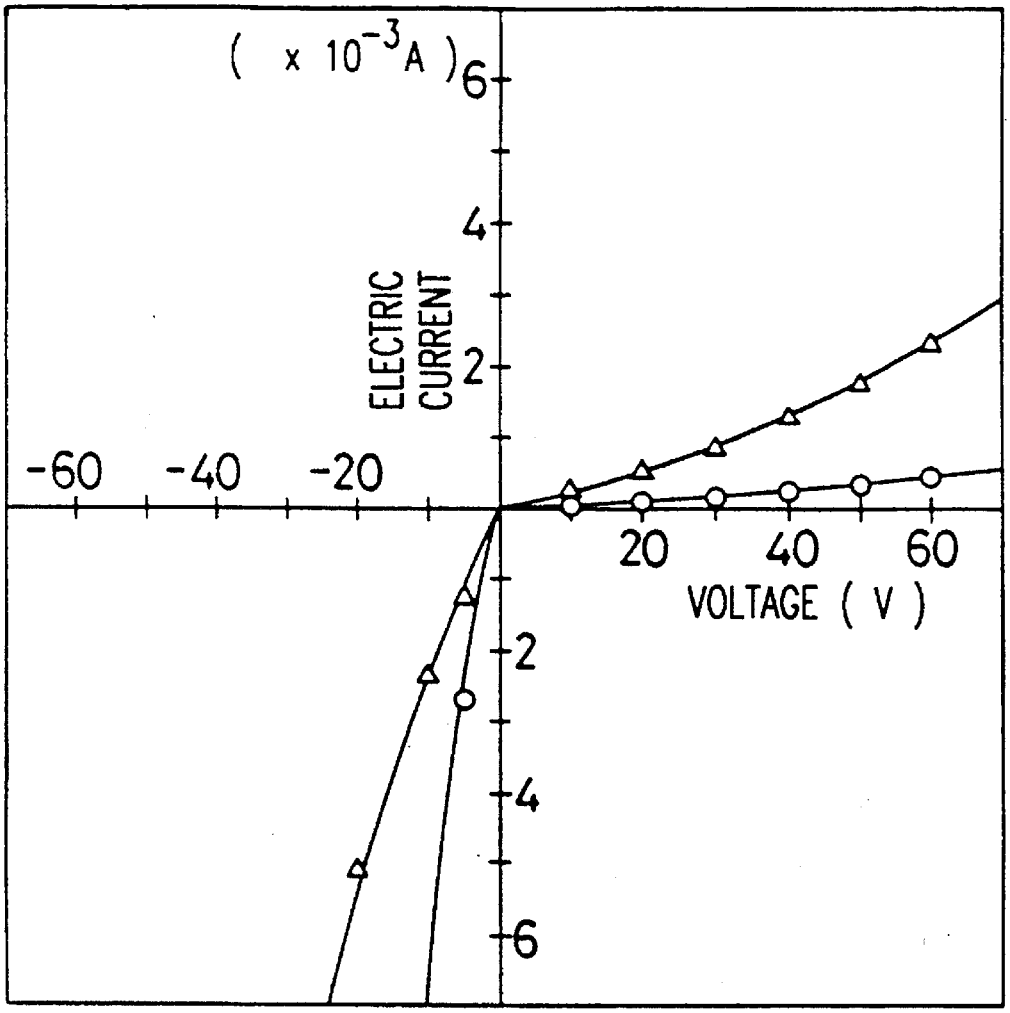

The voltage-electric current characteristics of thus obtained respective a-SiC photoconductive members were measured with applying a voltage to the side of the Al electrode (30) and connecting the flat plate (29) to the earth side, as shown in FIG. 40 with the results as shogun in FIGS. 49 and 50.

FIG. 49 shows the voltage-electric current characteristics for the Sample No. H-1 and FIG. 50 shows the voltage-electric current characteristics for the Sample No. H-2. In addition, referring to FIGS. 49 and 50, an axis of abscissa designates a voltage applied to the Al electrode (30), an axis of ordinate designating an electric current, and o marks designating a plot of measured values.

In both FIG. 49 and FIG. 50 a plot of measured values for COMPARATIVE EXAMPLE is shown by Δ marks. In every case, the $B_2H_6$ gas (having a concentration of 0.2%) was mixed with varying the flow rate thereof within a range of 60 to 0 sccm and a thickness of 1.0 micron was given under the film-forming conditions for the Sample No. C-1 in the formation of the first layer zone and the $PH_3$ gas (having a concentration of 40 sccm) was mixed at a flow rate of 15 sccm and a thickness of 0.5 microns was given in the formation of the second layer zone to produce a-SiC photoconductive layers.

As obvious from FIGS. 49 and 50, with the a-SiC photoconductive members according to the present invention, even though the positive voltage is applied to the Al electrode (30), an electric current is hardly flown, but, in the case where the negative voltage is applied to the electrode (30), a remarkably large electric current is flown.

In addition, comparing with the second invention, if the voltage applied is positive, the electric current is still more reduced, while, if the voltage applied is negative, the electric current is still more increased, that is, the a-SiC photoconductive members according to the third invention are superior to those according to the second invention in rectification property.

EXAMPLE 23

The same a-SiC photoconductive layer as in EXAMPLE 22 was formed on the Al substrate and then the organic photosemiconductive layer (having a film-thickness of about 15 microns) mainly comprising TNF in the same manner as in EXAMPLE 7 to obtain a positive charge type electrophotographic sensitive member.

Thus, the electrophotographic sensitive member K, L corresponding to the a-SiC photoconductive layer (H-1) and (H-2) were produced.

Figure 51:
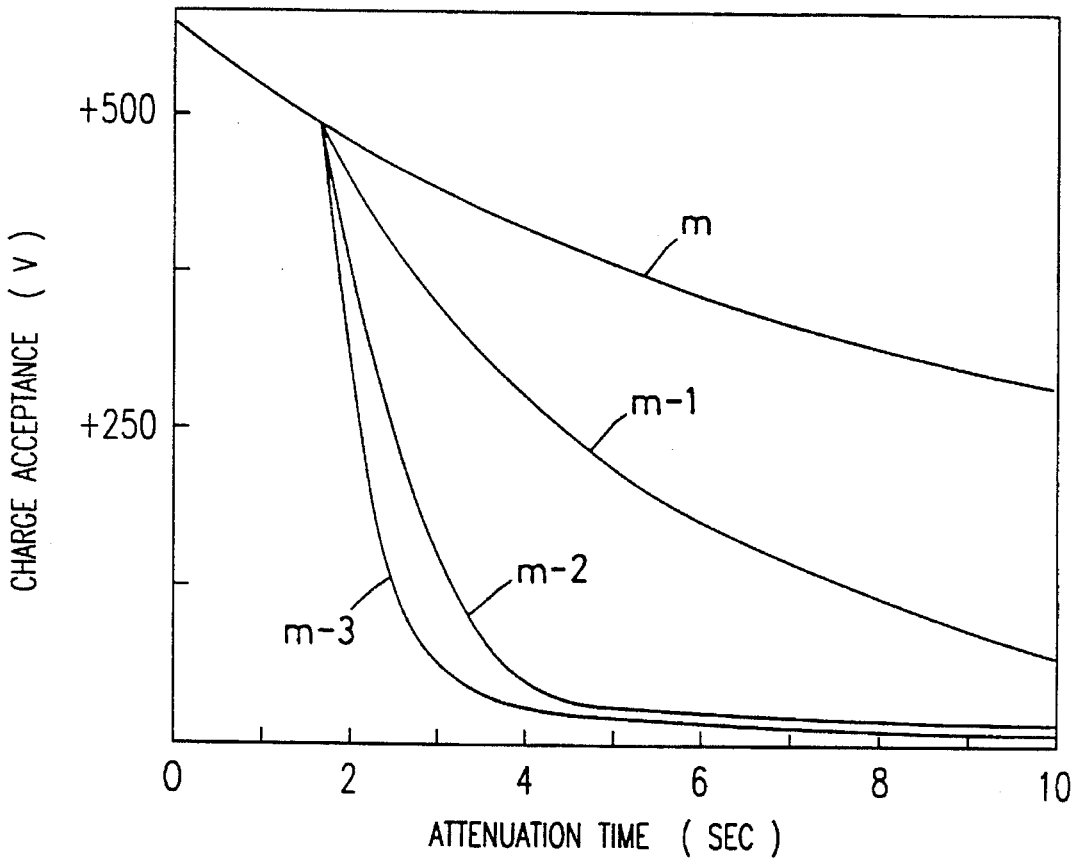

The dark- and photoattenuation characteristics of the sensitive member K were measured with the results as shown in FIG. 51. In addition, the spectral sensitivity characteristics were measured with the results as shown in FIG. 52.

Referring to FIG. 51, an axis of abscissa designates an attenuation time (sec), an axis of ordinate designating the charge acceptance (volt), m designating a dark attenuation curve, and m-1, m-2 and m-3 designating a photoattenuation curve at the exposure wavelength of 400 nm, 450 nm and 550 nm, respectively.

As obvious from FIG. 51, it can be confirmed that the electrifying capacity is improved in comparison with the first invention and the residual potential is reduced in comparison with FIG. 47 shown in EXAMPLE 20.

Figure 52:
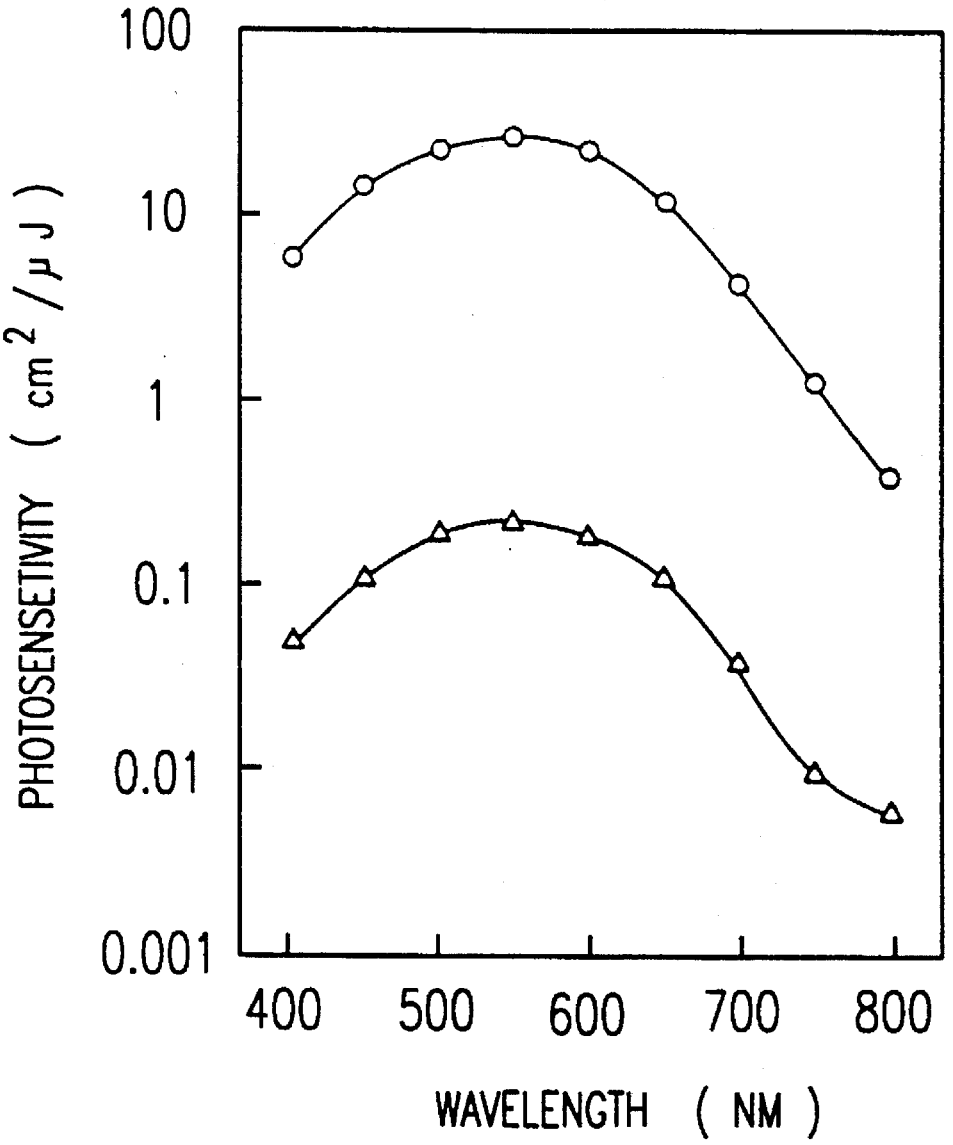

In addition, referring to FIG. 52, an axis of abscissa designates a wavelength, an axis of ordinate designating the photosensitivity, and o marks designating a plot of measured values for the sensitive member K. For comparison, the organic photosemiconductive layer was similarly formed on the a-SiC photoconductive layer shown in FIG. 49 to produce a positive charge rye electrophotographic sensitive member. A plot of measured values for this sensitive member is shown Δ marks.

As obvious from FIG. 52, the photosensitivity of the sensitive member K is higher in comparison with that in the second invention.

In addition, the present inventors measured the dark- and photoattenuation characteristics as well as the spectral sensitivity characteristics for also the sensitive member L were measured with the same effect as the sensitive member K in every case.

EXAMPLE 24

In addition, the present inventors varied the maximum flow rate of the $B_2H_6$ gas and the flow rate of the $PH_3$ gas in the formation of the sensitive member L to produce 15 kinds of electrophotographic sensitive member (sensitive members M-1 to M-15) with varied maximum B element-content of the first layer zone and varied P element-content of the second layer zone, as shown in Table 19.

The photosensitivity, the charge acceptance and the residual potential of these electrophotographic sensitive members were measured with the results as shown in Table 19.

Sensitive members marked with * are outside of the scope of the present invention.

TABLE 19

| Sensitive member | Maximum B element-content of the first layer zone (ppm) | P element-content of the second layer zone (ppm) | Photo-sensi-tivity | Charge accept-ance | Residual potential |
|---|---|---|---|---|---|
| M-1* | 0.3 | 10 | Δ | Δ | ○ |
| M-2 | 5 | 20 | ○ | Δ | ○ |
| M-3 | 70 | 10 | ○ | Δ | ○ |
| M-4 | 400 | 3 | ○ | ○ | ○ |
| M-5 | 2000 | 3 | ○ | ○ | ○ |
| M-6 | 400 | 10 | ⊙ | ○ | ⊙ |
| M-7 | 1000 | 8 | ⊙ | ⊙ | ⊙ |
| M-8 | 2000 | 20 | ⊙ | ⊙ | ⊙ |
| M-9 | 4000 | 35 | ⊙ | ⊙ | ⊙ |
| M-10 | 8000 | 35 | ○ | ⊙ | ⊙ |
| M-11 | 4000 | 70 | ○ | ○ | ○ |
| M-12 | 8000 | 70 | ○ | ○ | ○ |
| M-13 | 50 | 300 | ○ | ○ | ○ |
| M-14* | 12000 | 35 | Δ | Δ | Δ |
| M-15* | 50 | 700 | Δ | Δ | Δ |

As obvious from Table 19, the sensitive members M-4 to M-13 showed the superior photosensitivity, the enhanced charge acceptance and the reduced residual potential and the sensitive members M-2 and M-3 were superior in photosensitivity and residual potential.

It is, however, found that the sensitive member M-1 is inferior in photosensitivity and charge acceptance and the sensitive members M-14 and M-15 are not improved in charge acceptance and residual potential.

Preferred Embodiments of the Fifth Invention

EXAMPLE 25

An Al flat plate (25 mm×50 mm), of which surface had been ground, was placed within the reaction tube of the glow-discharge decomposition apparatus and the first layer zone (2a) and the second layer zone (2b) were formed on said flat plate in turn under the film-forming conditions shown in Table 20.

Subsequently, a disk-like Al electrode (having a diameter of 3 mm) was formed by the vacuum vapor deposition method to produce photoconductive members as shown in FIG. 40.

The $B_2H_6$ gas and the $PH_3$ gas marked with * is diluted with the $H_2$ gas at a concentration of 40 ppm, respectively.

TABLE 20

| Sample No | Layer zone | Raw material gas $SiH_4$ sccm | Raw material gas $C_2H_2$ sccm | Diluent gas $H_2$ sccm | Impurity gas $B_2H_6$ sccm* | Impurity gas $PH_3$ sccm* | Gas pressure Torr | High-frequency electric power W | Time minute | Temperative °C. | Thickness μm |
|---|---|---|---|---|---|---|---|---|---|---|---|
| I-1 (Lower speed film-formation) | First layer zone | 20 | 1 | 700 | — | 15 | 1.2 | 100 | 30 | 250 | 1.0 |
| | Second layer zone | 20 | 1 | 700 | 30 | — | 1.2 | 100 | 15 | 250 | 0.5 |
| I-2 (Higher speed film-formation) | First layer zone | 200 | 20 | 300 | — | 150 | 0.8 | 100 | 6 | 250 | 1.0 |
| | Second layer zone | 200 | 300 | 300 | — | 0.8 | 100 | 3 | 250 | 0.5 | |

The C-content, the P element-content and the B element-content of thus formed first layer zone (2a) and second layer zone (2b) were measured with the results as shown in Table 21.

TABLE 21

| Sample No | Kind of layer | Value of x in $Si_{1-x}C_x$ | P element-content (ppm) | B element-content (ppm) |
|---|---|---|---|---|
| I-1 | Second layer zone | 0.1 | — | 40 |
| | First layer zone | 0.1 | 20 | — |
| I-2 | Second layer zone | 0.25 | — | 40 |
| | First layer zone | 0.25 | 20 | — |

Figure 53:
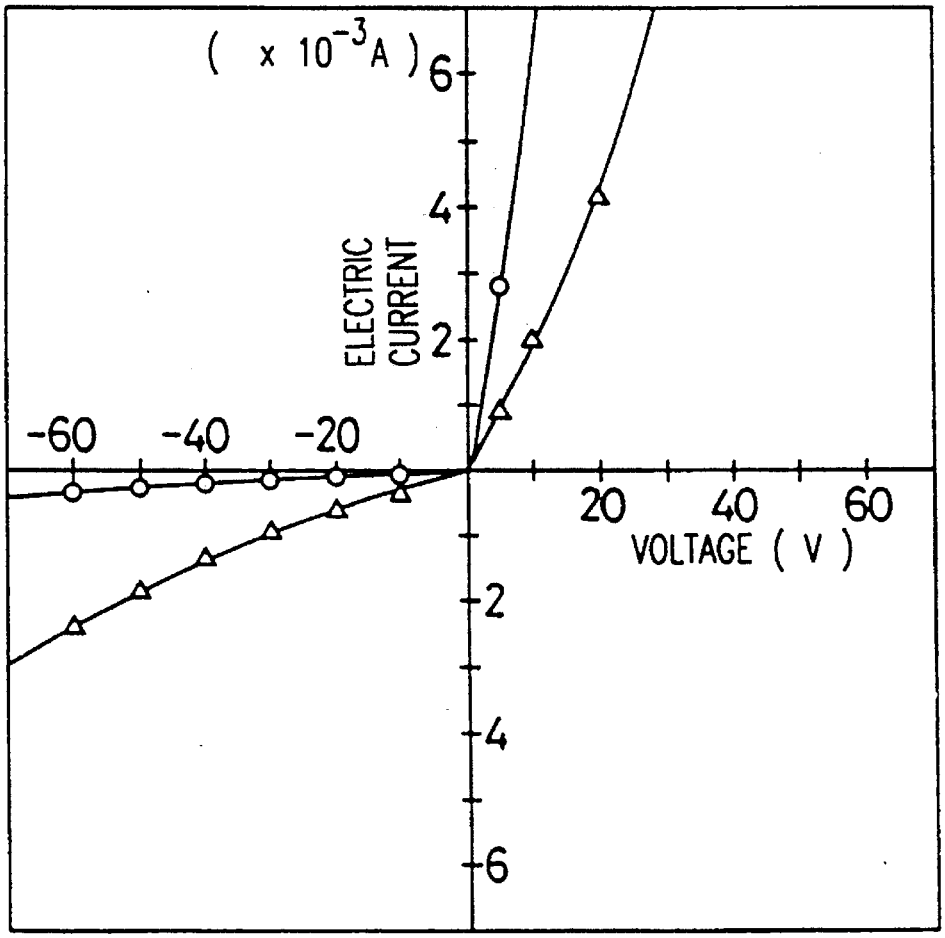
Figure 54:
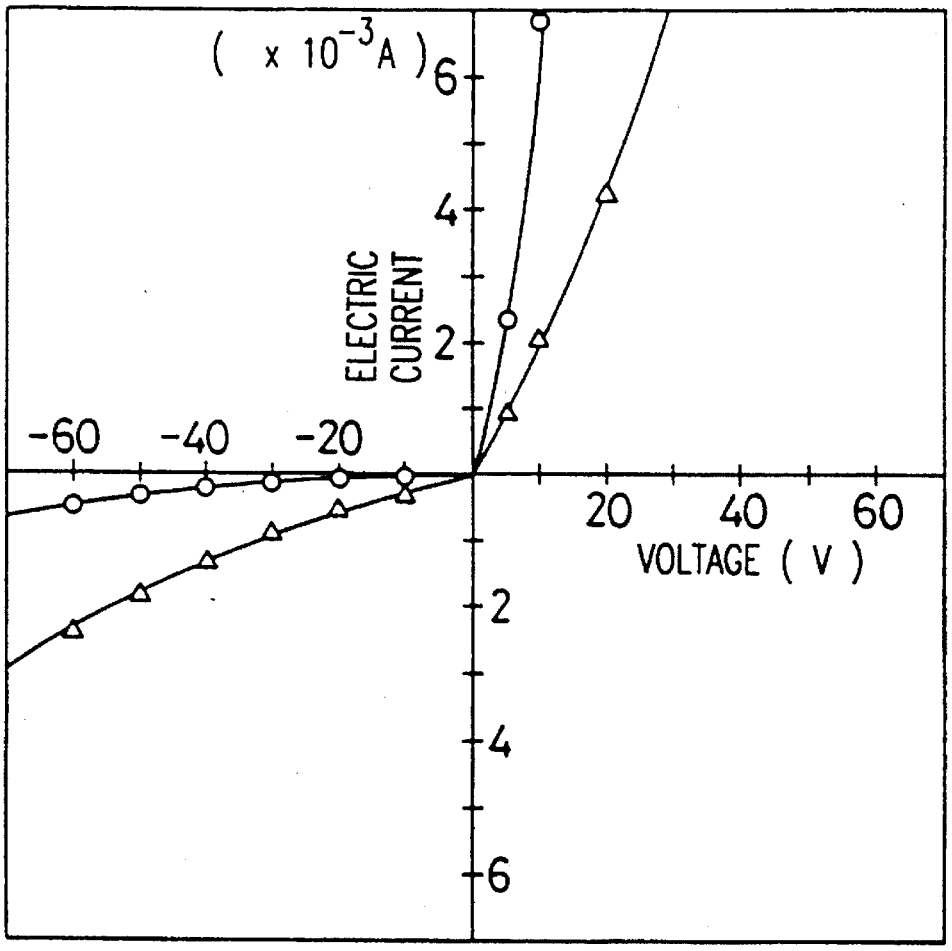

The voltage-electric current characteristics of thus obtained a-SiC photoconductive members were measured with applying a voltage to the side of the Al electrode (30) and connecting the flat plate (29) to the earth side, as shown in FIG. 40, with the results as shown in FIGS. 53 and 54.

FIG. 53 shows the voltage-electric current characteristics of the Sample No. I-1 and FIG. 54 shows the voltage-electric current characteristics of the Sample No. I-2. Referring to FIGS. 53 and 54, an axis of abscissa designates a voltage applied to the Al electrode (30), an axis of ordinate designating an electric current, and ○ marks designating a plot of measured values.

In both FIG. 53 and FIG. 54 a plot of measured values for COMPARATIVE EXAMPLE was shown by Δ marks. In every case, the $PH_3$ gas (having a concentration of 40 ppm) was mixed at a flow rate of 15 sccm and a thickness of 1.0 micron was given under the film-forming conditions of the Sample No. C-1 in the formation of the first layer zone and the $B_2H_6$ gas (having a concentration of 40 ppm) was mixed at a flow rate of 30 sccm and a thickness of 0.5 microns was given in the formation of the second layer zone to produce the a-SiC photoconductive layers.

As obvious from FIGS. 53 and 54, with the a-SiC photoconductive members according to the present invention, even though the negative voltage is applied to the Al electrode (30), an electric current is hardly flown, but, in the case where the positive voltage is applied to the Al electrode (30), a remarkably large electric current is flown.

EXAMPLE 26

The same a-SiC photoconductive layer as in EXAMPLE 25 was formed on the Al substrate and then the organic photosemiconductive layer (having a film-thickness of about 15 microns) comprising hydrazone compounds dispersed therein in the same manner as in EXAMPLE 11 was formed to obtain a negative charge type electrophotographic sensitive member.

Thus, electrophotographic sensitive members N, o corresponding to the a-SiC photoconductive layers (I-1), (I-2), respectively, were produced.

Figure 55:
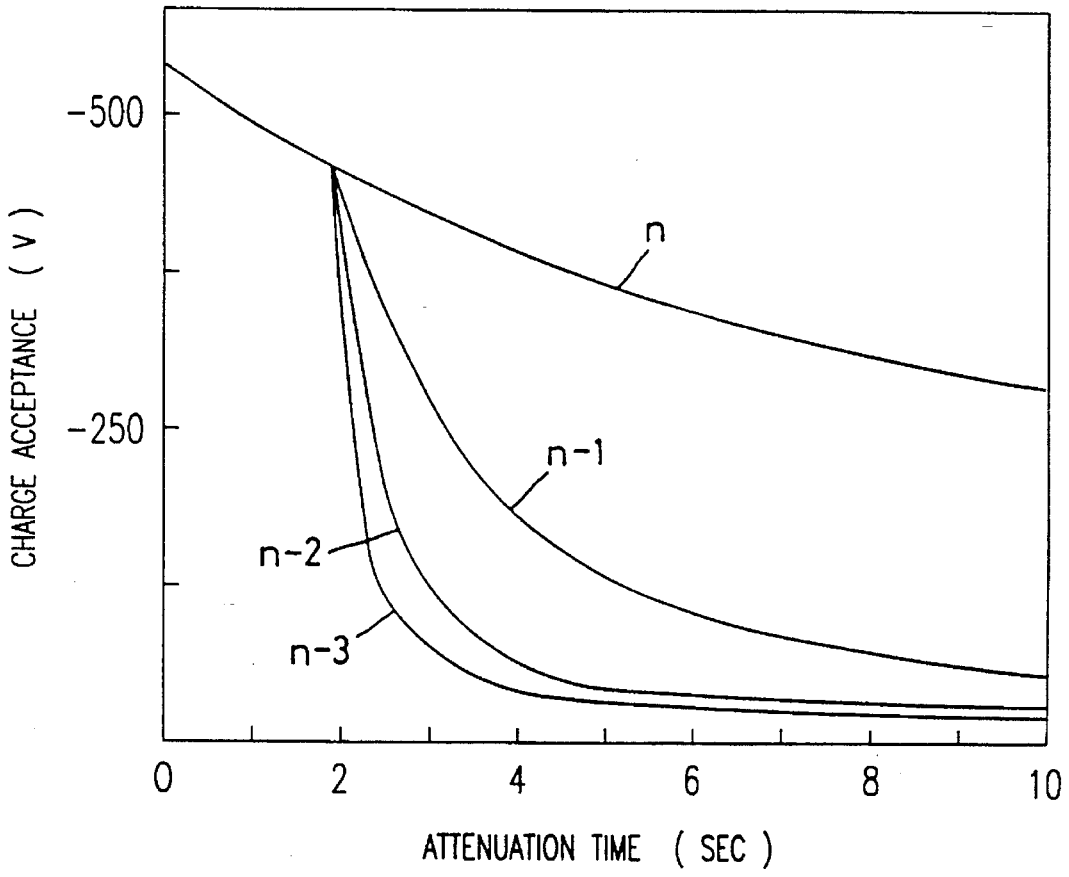
Figure 56:
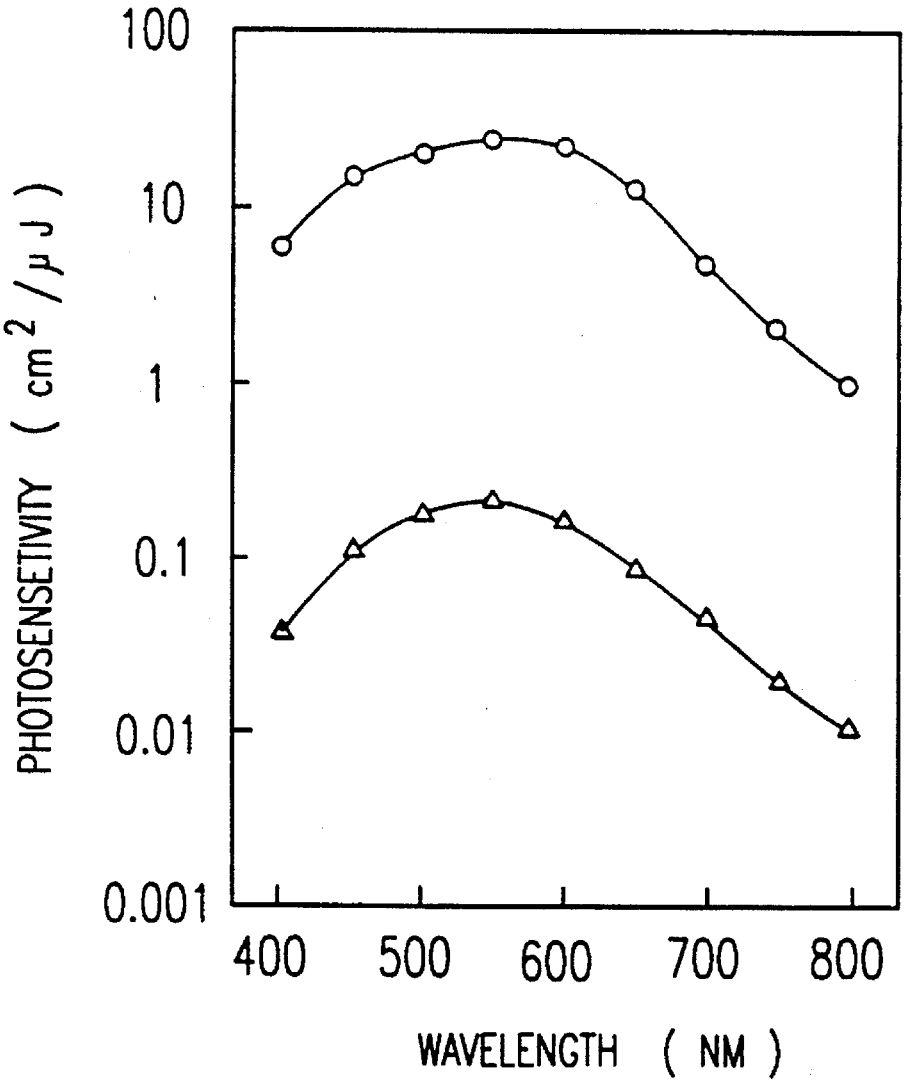

The dark- and photoattenuation characteristics of the sensitive member N were measured with the results as shown in FIG. 55 and the spectral sensitivity characteristics were measured with the results as shown in FIG. 56.

Referring to FIG. 55, an axis of abscissa designates an attenuation time (sec), an axis of ordinate designating a charge acceptance (volt), n designating a dark attenuation curve, and n-1, n-2 and n-3 designating a photoattenuation curve at an exposure wavelength of 400 nm, 450 nm and 550 nm, respectively.

As obvious from FIG. 55, the improvement of the electrifying capacity in comparison with the fourth invention was found.

In addition, referring to FIG. 56, an axis of abscissa designates a wavelength, an axis of ordinate designating a photosensitivity, and o marks designating a plot of measured values for the sensitive member N. For comparison, the organic photosemiconductive layer was similarly formed on the a-SiC photoconductive layer shown in FIG. 53 to produce an electrophotographic sensitive member. A plot of measured values for this sensitive member is shown by Δ marks.

As obvious from FIG. 56, the sensitive member N showed the higher photosensitivity than that in COMPARATIVE EXAMPLE, which was higher also than that in the fourth invention.

In addition, the present inventors measured the dark- and photoattenuation characteristics as well as the spectral sensitivity characteristics of also the sensitive member o with the same effect as the sensitive member N in every case.

EXAMPLE 27

Next, the present inventors formed the first layer zone (2*a*) and the second layer zone (2*b*) in turn under the film-forming conditions shown in Table 22 and formed two kinds of a-SiC photoconductive layers J-1, J-2 followed by forming the organic photosemiconductive layer (having a thickness of about 15 microns) comprising hydrazone compounds dispersed therein in the same manner as in EXAMPLE 11 to a negative charge type electrophotographic member.

The $B_2H_6$ gas marked with * is diluted with the $H_2$ gas at a concentration of 40 ppm.

TABLE 22

| Sample No | Layer zone | Raw material gas $SiH_4$ sccm | Raw material gas $C_2H_2$ sccm | Diluent gas $H_2$ sccm | Impurity gas $B_2H_6$ sccm※ | pressure Torr | High-frequency electric power W | Time minute | Temperature °C. | Thickness μm |
|---|---|---|---|---|---|---|---|---|---|---|
| J-1 (Lower speed film-formation) | First layer zone | 20 | 1 | 700 | — | 1.2 | 100 | 30 | 250 | 1.0 |
| | Second layer zone | 20 | 1 | 700 | 30 | 1.2 | 100 | 15 | 250 | 0.5 |
| J-2 (Higher speed film-formation) | First layer zone | 200 | 20 | 300 | — | 0.8 | 100 | 6 | 250 | 1.0 |
| | Second layer zone | 200 | 20 | 300 | 300 | 0.8 | 100 | 3 | 250 | 0.5 |

The dark- and photoattenuation characteristics as well as the spectral sensitivity characteristics of thus obtained two kinds of sensitive member were measured with the same results as in EXAMPLE 26.

EXAMPLE 28

The present inventors varied the flow rate of the $PH_3$ gas and the flow rate of the $B_2H_6$ gas in the production of an electrophotographic sensitive member corresponding to the a-SiC photoconductive layer J-2 to produce 15 kinds of electrophotographic sensitive member (sensitive members P-1 to P-15) with the P element-content of the first layer zone and the B element-content of the second layer zone varied as shown in Table 23.

Sensitive members marked with * are outside of the scope of the present invention.

TABLE 23

| Kind of sensitive member | P element-content of the first layer zone (ppm) | B element-content of the second layer zone (ppm) | Photosensitivity | Residual potential | Charge acceptance |
|---|---|---|---|---|---|
| P-1 | 0 | 10 | Δ | Δ | ○ |
| P-2 | 0 | 100 | ⊙ | ⊙ | ⊙ |
| P-3 | 100 | 3 | ○ | Δ | ○ |
| P-4※ | 50 | 0.5 | x | x | ○ |
| P-5 | 1800 | 2 | ○ | ○ | ○ |
| P-6 | 500 | 40 | ⊙ | ⊙ | ⊙ |
| P-7 | 2500 | 70 | ⊙ | ⊙ | ⊙ |
| P-8 | 4000 | 70 | ○ | ⊙ | ⊙ |
| P-9 | 2500 | 200 | ○ | ○ | ○ |
| P-10 | 4000 | 200 | ○ | ○ | ○ |
| P-11 | 2500 | 400 | Δ | Δ | Δ |
| P-12 | 1800 | 700 | Δ | Δ | Δ |
| P-13※ | 2500 | 1300 | x | x | Δ |
| P-14※ | 7000 | 200 | x | x | Δ |
| P-15※ | 13000 | 100 | x | x | x |

As obvious from Table 23, the sensitive members P-1 to P-3 and P-5 to P-12 showed the superior photosensitivity, the enhanced charge acceptance and the reduced residual potential.

It is, however, found that the sensitive members P-4, P-13 and P-14 are inferior in photosensitivity and charge acceptance and the sensitive member P-15 is not improved in photosensitivity, charge acceptance and residual potential.

Preferred Embodiments of the Sixth Invention

EXAMPLE 29

An Al flat plate (25 mm×50 mm), of which surface had been ground, was placed within the reaction tube of the glow-discharge decomposition apparatus and the first layer zone (2*a*) and the second layer zone (2*b*) were formed on said flat plate in turn under the high-speed film-forming conditions shown in Table 24.

Subsequently, a disk-like Al electrode (having a diameter of 3 mm) was formed by the vacuum vapor deposition method to produce photoconductive members as shown in FIG. 40.

The $B_2H_6$ gas and the $PH_3$ gas marked with * is diluted with the $H_2$ gas at a concentration of 40 ppm, respectively.

Numerical values marked with ** designate a flow rate of gases at the start of film-formation rand the finish of film-formation and show the gradual decrease.

Figure 57:
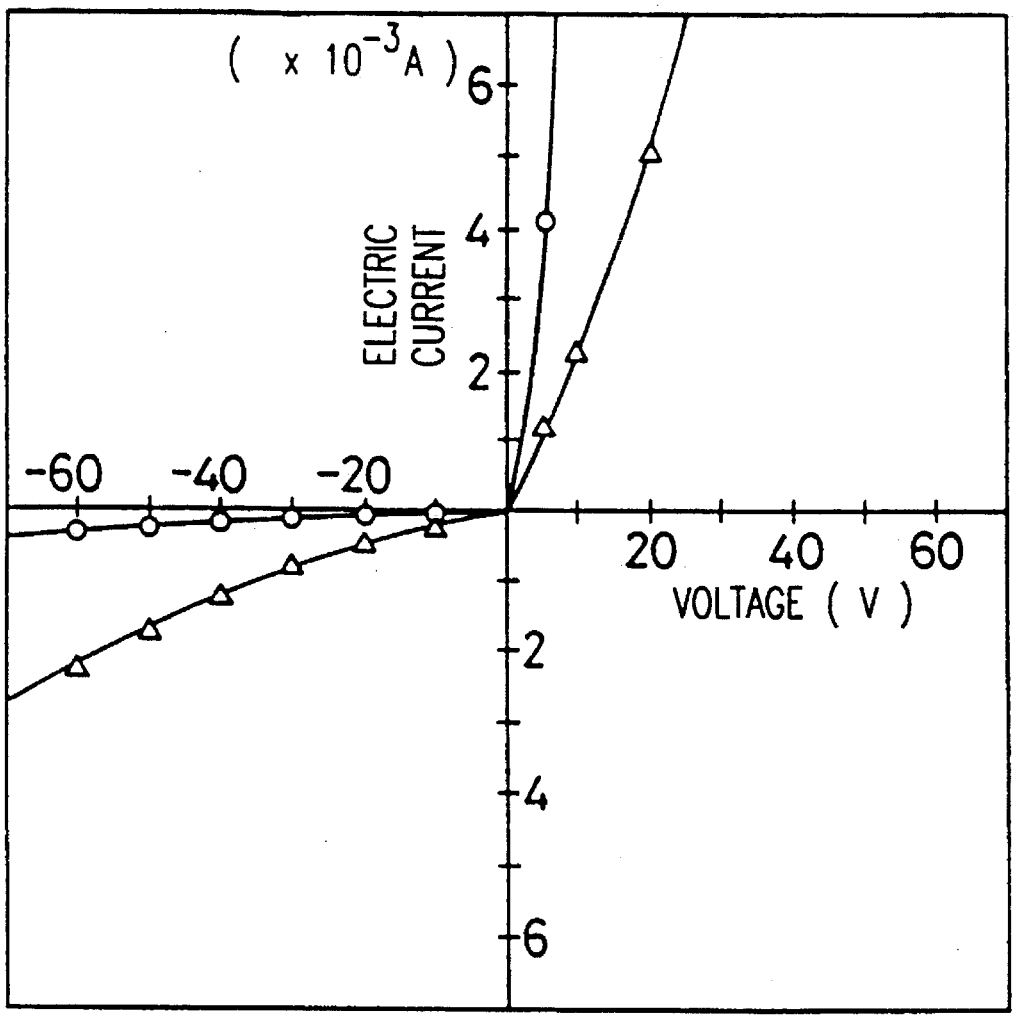
Figure 58:
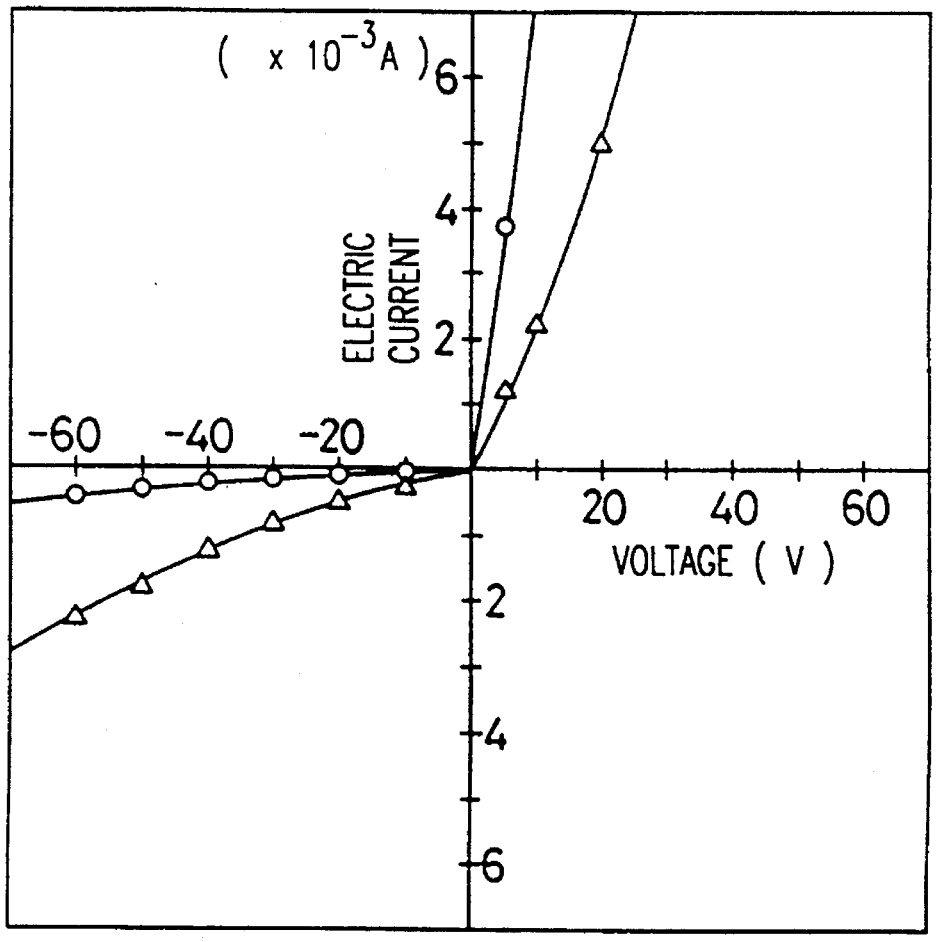

FIG. 57 shows the voltage-electric current characteristics of the Sample No. K-1 and FIG. 58 shows the voltage-electric current characteristics of the Sample No. K-2. In addition, referring to FIGS. 57, 58, an axis of abscissa designates a voltage applied to the Al electrode (30), an axis of ordinate designating an electric current, and o marks designating a plot of measured values.

In both FIG. 57 and FIG. 58 a plot of measured values for COMPARATIVE EXAMPLE is shown by Δ marks. In every case, the flow rate of the $PH_3$ gas (having a concentration of 40 ppm) was gradually reduced from 30 sccm to 0 sccm and a thickness of 1.0 micron was given under the film-forming conditions for the Sample No. C-1 in the formation of the first layer zone and the $B_2H_6$ gas (having a concentration of 40 ppm) was mixed at a flow rate of 30 sccm and a thickness of 0.5 microns was given in the formation of the second layer zone to produce a-SiC photoconductive layers.

As obvious from FIGS. 57 and 58, with the a-SiC photoconductive members according to the present invention, even though the negative voltage is applied to the Al electrode (30), an electric current is hardly flown, but, in the case where the positive voltage is applied to the Al electrode (30), a remarkably large electric current is flown.

In addition, in the case where the positive voltage was applied, the electric current was increased in comparison with that in FIGS. 53 and 54 of the fifth invention.

TABLE 24

| Sample No | Layer zone | Raw material gas $SiH_4$ sccm | Raw material gas $C_2H_2$ sccm | Diluent gas $H_2$ sccm | Impurity gas $PH_3$ sccm | Impurity gas $B_2H_6$ sccm | Gas pressure Torr | High-frequency electric power W | Time minute | Temperature °C. | Thickness μm |
|---|---|---|---|---|---|---|---|---|---|---|---|
| K-1 (Lower speed film-formation) | First layer zone | 20 | 1 | 700 | 30 → 0** | — | 1.2 | 100 | 30 | 250 | 1.0 |
| | Second layer zone | 20 | 1 | 700 | — | 30 | 1.2 | 100 | 15 | 250 | 0.5 |
| K-2 (Higher speed film-formation) | First layer zone | 200 | 20 | 300 | 300 → 0** | | 0.8 | 100 | 6 | 250 | 1.0 |
| | Second layer zone | 200 | 20 | 300 | — | 300 | 0.8 | 100 | 3 | 250 | 0.5 |

The C-content, the maximum P element-content and the B element-content of thus formed first layer zone (2*a*) and second layer zone (2*b*) were measured with the results as shown in Table 25.

TABLE 25

| Sample No | Kind of layer | Value of x in $Si_{1-x}C_x$ | Maximum P element-content (ppm) | B element-content (ppm) |
|---|---|---|---|---|
| K-1 | First layer zone | 0.1 | — | 40 |
| | Second layer zone | 0.1 | 50 | — |
| K-2 | First layer zone | 0.25 | — | 40 |
| | Second layer zone | 0.25 | 50 | — |

The voltage-electric current characteristics of thus obtained a-SiC photoconductive members were measured with applying a voltage to the side of the Al electrode (30) and connecting the flat plate (29) to the earth side, as shown in FIG. 40, with the results as shown in FIGS. 57 and 58.

EXAMPLE 30

The same a-SiC photoconductive layer as in EXAMPLE 29 was formed on the Al substrate and then the organic photosemiconductive layer (having a film-thickness of about 15 microns) comprising hydrazone compounds dispersed therein in the same manner as in EXAMPLE 11 was formed to obtain negative charge type electrophotographic sensitive members.

Thus, the electrophotographic sensitive member Q, R corresponding to the a-SiC photoconductive layer (K-1), (K-2), respectively, were produced.

Figure 59:
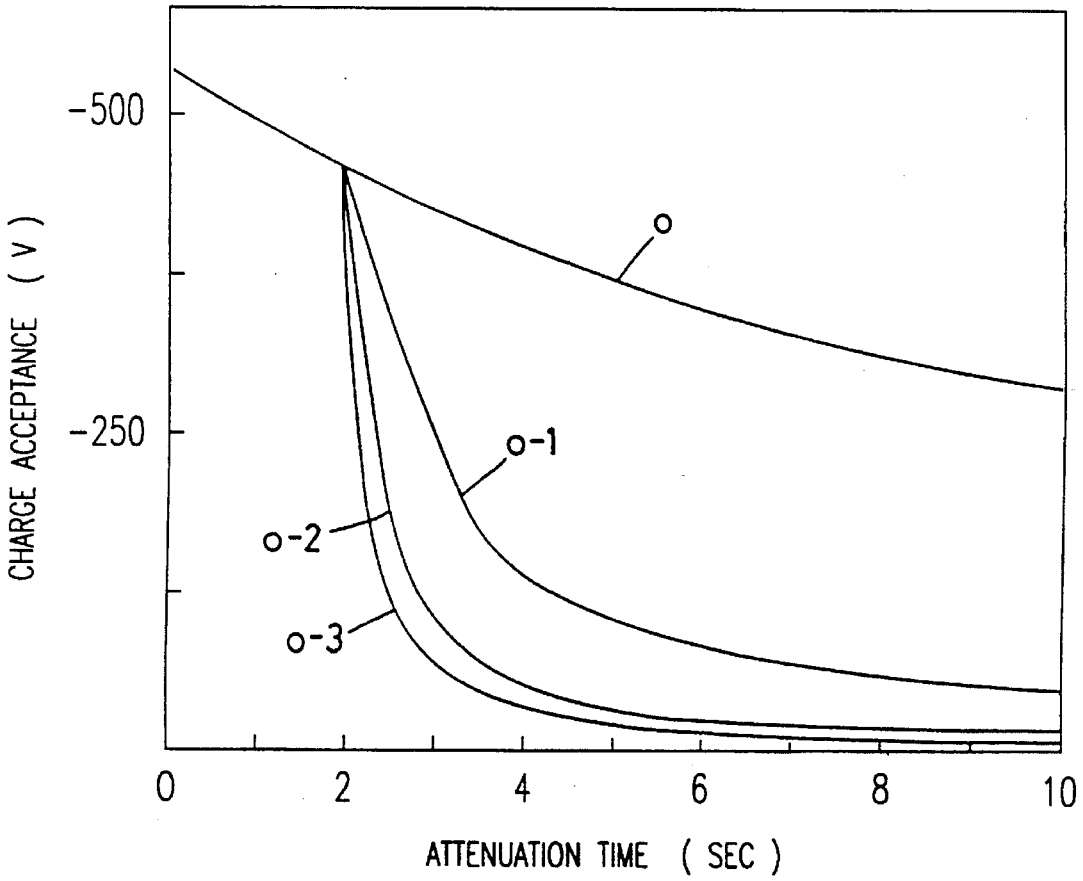
Figure 60:
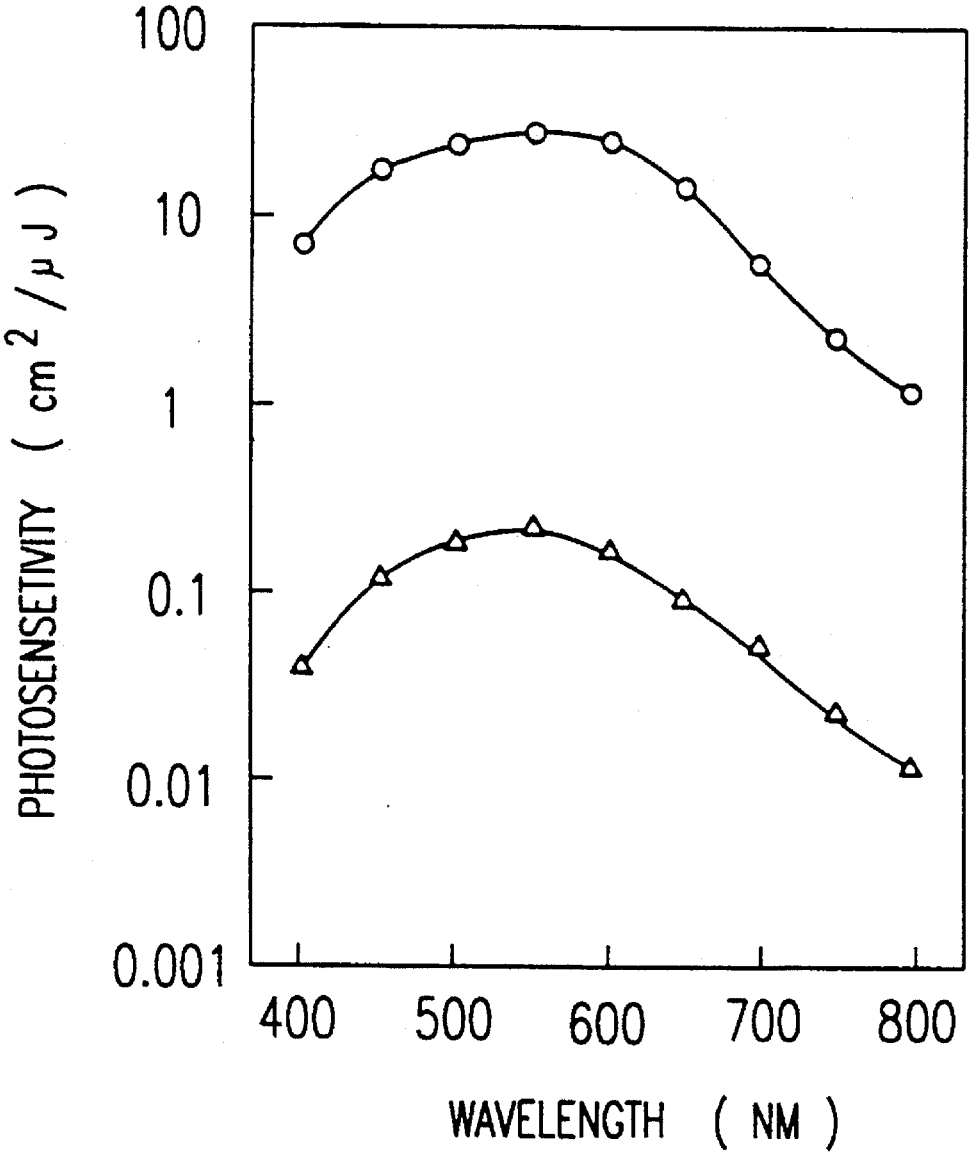

The dark- and photoattenuation characteristics of the sensitive member Q were measured with the results as shown in FIG. 59 and the spectral sensitivity characteristics were measured with the results as shown in FIG. 60.

Referring to FIG. 59, an axis of abscissa designates an attenuation time (sec), an axis of ordinate designating a charge acceptance (volt), O designating a dark attenuation curve, and O-1, O-2 and O-3 designating a photoattenuation curve at an exposure wavelength of 400 nm, 450 nm and 550 nm, respectively.

As obvious from FIG. 59, the improvement of the electrifying capacity in comparison with that in the fourth invention was found and the reduction of the residual potential in comparison with that in the fifth invention was confirmed.

In addition, referring to FIG. 60, an axis of abscissa designates a wavelength, an axis of ordinate designating a photosensitivity, and o marks designating a plot of measured values for the sensitive member Q. For comparison, the organic photosemiconductive layer was similarly formed on the a-SiC photoconductive layer shown in FIG. 57 to produce an electrophotographic sensitive member. A plot of measured values for this sensitive member is shown by Δ marks, As obvious from FIG. 60, the sensitive member Q showed the higher photosensitivity in comparison with that in COMPARATIVE EXAMPLE, which was higher than that in the fourth and fifth inventions.

In addition, the present inventors measured the dark- and photoattenuation characteristics as well as the spectral sensitivity characteristics also for the sensitive member R in the same manner as in the present EXAMPLE with the same effect as that of the sensitive member Q.

EXAMPLE 31

In addition, the present inventors varied the maximum flow rate of the $PH_3$ gas and the flow rate of the $B_2H_6$ gas in the production of the sensitive member R to produce 14 kinds of electrophotographic sensitive member (sensitive members S-1 to S-14) with the maximum P element-content of the first layer zone and the B element-content in the second layer zone varied as shown in Table 26.

Sensitive members marked with * are outside of the scope of the present invention.

TABLE 26

| Kind of sensitive member | Maximum P element-content of the first layer zone (ppm) | B element-content of the second layer zone (ppm) | Photo sensitivity | Charge acceptance | Residual potential |
|---|---|---|---|---|---|
| S-1 | 5 | 20 | Δ | Δ | Δ |
| S-2 | 5 | 100 | ◎ | ◎ | ◎ |
| S-3 | 180 | 2 | ○ | ○ | ○ |
| S-4* | 30 | 0.5 | x | x | ○ |
| S-5 | 2000 | 2 | ○ | ○ | ○ |
| S-6 | 600 | 40 | ◎ | ◎ | ◎ |
| S-7 | 2000 | 50 | ◎ | ◎ | ◎ |
| S-8 | 5000 | 70 | ○ | ◎ | ◎ |
| S-9 | 2500 | 200 | ○ | ○ | ○ |
| S-10 | 5000 | 200 | ○ | ○ | ○ |
| S-11 | 2500 | 400 | Δ | Δ | Δ |
| S-12 | 1500 | 700 | Δ | Δ | Δ |
| S-13* | 1500 | 1300 | x | x | Δ |
| S-14* | 12000 | 70 | x | x | x |

As obvious from Table 26, the sensitive members S-1 to S-3 and S-5 to S-12 showed the superior photosensitivity, the enhanced charge acceptance and the reduced residual potential.

It is, however, found that the sensitive member S-4 is inferior in photosensitivity and charge acceptance and the sensitive members S-13 and S-14 are not improved in photosensitivity, charge acceptance and residual potential.

Industrially Possible Availability

As above described, in an electrophotographic sensitive member according to the present invention an a-SiC photoconductive layer is composed of elements, such as Si- and C element as well as H element or halogen element, said a-SiC photoconductive layer comprising a first layer zone and a second layer zone formed in turn, and said layer zones containing the IIIa group elements or the Va group elements in a quantity within an appointed range, whereby the high-capacity and high-quality electrophotographic sensitive member, of which photosensitivity can be improved, charge acceptance being able to be enhanced, and residual potential being able to be reduced, can be obtained.

What is claimed is:

1. An electrophotographic sensitive member comprising:

an electrically conductive substrate, an amorphous silicon carbide photoconductive layer on the substrate, and an organic photosemiconductive layer on the photoconductive layer, the amorphous silicon carbide photoconductive layer comprising, as constituent elements, an Si element, a C element, and an H element or a halogen element, the H element or the halogen element being expressed by an A element, the amorphous silicon carbide photoconductive layer defining an elemental ratio expressed as $[Si_{1-x}C_x]_{1-y}A_y$, where x is within a range of 0 to 0.5 and y is within a range of 0.2 to 0.5.

2. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising a first layer zone and a second layer zone on the first layer zone, the first layer zone comprising elements of the IIIa group in the periodic table in a quantity of 1 to 10,000 ppm, the second layer zone comprising, as constituent elements, an Si element, a C element, and an H element or a halogen element, the H element or the halogen element being expressed by an A element, the amorphous silicon carbide photoconductive layer defining an elemental ratio expressed as $[Si_{1-x}C_x]_{1-y}A_y$, where x is within a range of 0 to 0.5 and y is within a range of 0.2 to 0.5.

3. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising a first layer zone and a second layer zone on the first layer zone, the first layer zone comprising elements of the IIIa group in the periodic table in a quantity of 1 to 10,000 ppm, and the second layer zone comprising elements of the Va group in the periodic table in a quantity of 0 to 500 ppm.

4. The electrophotographic sensitive member of claim 10 or claim 3, wherein the electrophotographic sensitive member defines a surface and wherein the quantity of elements of the IIIa group in the periodic table gradually decreases from the substrate to the surface of the electrophotographic sensitive member.

5. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising, as constituent elements, an Si element, a C element, and an H element or a halogen element, the H element or the halogen element being expressed by an A element, the amorphous silicon carbide photoconductive layer defining an elemental ratio expressed as $[Si_{1-x}C_x]_{1-y}A_y$, where x is within a range of 0 to 0.5 and y is within a range of 0.2 to 0.5, and the amorphous silicon carbide photoconductive layer comprising elements of the IIIa group in the periodic table in a quantity of 1 to 10,000 ppm.

6. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising a first layer zone and a second layer zone on the first layer zone, the first layer zone comprising elements of the Va group in the periodic table in a quantity of not greater than 5,000 ppm, and the second layer zone comprising elements of the IIIa group in the periodic table in a quantity of 1 to 1,000 ppm.

7. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising a first layer zone and a second layer zone on the first layer zone, the first layer zone comprising substantially no element of the Va group in the periodic table, and the second layer zone comprising elements of the IIIa group in the periodic table in a quantity of 1 to 1,000 ppm.

8. An electrophotographic sensitive member, comprising:

an electrically conductive substrate, an amorphous silicon carbide photoconductive layer on the substrate, and an organic photosemiconductive layer on the photoconductive layer, the amorphous silicon carbide photoconductive layer comprising a first layer zone and a second layer zone on the first layer zone, the first layer zone comprising elements of the Va group in the periodic table in a quantity of not greater than 10,000 ppm, wherein the electrophotographic sensitive member defines a surface and wherein the quantity of elements of the Va group in the periodic table gradually decreases from the substrate to the surface of the electrophotographic sensitive member, and the second layer zone comprising elements of the IIIa group in the periodic table in a quantity of 1 to 1,000 ppm.

* * * * *